US012716325B2

(12) United States Patent
Werries et al.

(10) Patent No.: US 12,716,325 B2
(45) Date of Patent: Aug. 25, 2026

(54) RELEASABLE DOWNHOLE COMPONENT FOR SUBTERRANEAN DEPLOYMENT ALONG A WELLBORE STRING

(71) Applicant: NCS MULTISTAGE INC., Calgary (CA)

(72) Inventors: Michael Werries, Calgary (CA); Rio Whyte, Calgary (CA); Brock Gillis, Calgary (CA)

(73) Assignee: NCS Multistage Inc., Calgary (CA)

( * ) Notice: Subject to any disclaimer, the term of this patent is extended or adjusted under 35 U.S.C. 154(b) by 132 days.

(21) Appl. No.: 18/550,810

(22) PCT Filed: Mar. 18, 2022

(86) PCT No.: PCT/CA2022/050409
§ 371 (c)(1),
(2) Date: Sep. 15, 2023

(87) PCT Pub. No.: WO2022/193024
PCT Pub. Date: Sep. 22, 2022

(65) Prior Publication Data

US 2024/0151118 A1 May 9, 2024

Related U.S. Application Data

(60) Provisional application No. 63/163,364, filed on Mar. 19, 2021.

(51) Int. Cl.
*E21B 34/14* (2006.01)
*E21B 33/12* (2006.01)
*E21B 34/10* (2006.01)

(52) U.S. Cl.
CPC ..... *E21B 34/106* (2013.01); *E21B 2200/06* (2020.05)

(58) Field of Classification Search
CPC ..... E21B 33/122; E21B 33/128; E21B 33/124
See application file for complete search history.

(56) References Cited

U.S. PATENT DOCUMENTS 8,739,879 B2 * 6/2014 King ..... E21B 43/26 166/383
8,936,101 B2 * 1/2015 McGlothen ..... E21B 33/1285 166/120

(Continued)

OTHER PUBLICATIONS

International Search Report and Written Opinion for International (PCT) Patent Application No. PCT/CA2022/050409, dated Jun. 17, 2022, 8 pages.

(Continued)

*Primary Examiner* — Tara Schimpf
*Assistant Examiner* — Ursula Lee Norris
(74) *Attorney, Agent, or Firm* — Sheridan Ross P.C.

(57) ABSTRACT

A downhole component for integration in wellbore string is provided. The downhole component includes fluid conduits enabling fluid flow therethrough and a sealing element connected to the fluid conduits and operable between a disengaged configuration, where the sealing element is disengaged from an inner surface of the wellbore, and an engaged configuration. The downhole component also includes an actuation assembly having a blocking member releasably secured to the fluid conduits and a fluid-pressure operable actuation member slidably connected to the fluid conduits adapted to engage and operate the sealing element from the disengaged configuration to the engaged configuration. The downhole component has a release mechanism operable to release the blocking member to enable the sealing element to revert to the disengaged configuration, wherein the release mechanism is adapted to be selectively (Continued)

and independently operated relative to additional release mechanisms associated with adjacent downhole components along the wellbore string.

18 Claims, 26 Drawing Sheets

(56) References Cited

U.S. PATENT DOCUMENTS

| | | | | |
|---|---|---|---|---|
| 9,234,405 | B2 | 1/2016 | Brandsdal | |
| 10,107,072 | B2 | 10/2018 | Harris et al. | |
| 10,519,747 | B2 | 12/2019 | Purkis | |
| 10,626,689 | B2 | 4/2020 | Moyes | |
| 12,352,129 | B2 * | 7/2025 | Alders | E21B 43/14 |
| 2012/0012342 | A1 * | 1/2012 | Wilkin | E21B 33/1285 166/387 |
| 2012/0055671 | A1 | 3/2012 | Stromquist et al. | |
| 2016/0273287 | A1 * | 9/2016 | Scott | E21B 23/00 |
| 2019/0353006 | A1 | 11/2019 | Getzlaf et al. | |
| 2024/0011362 | A1 * | 1/2024 | Silva | E21B 17/06 |

OTHER PUBLICATIONS

Supplementary European Search Report for Europe Patent Application No. 22770145.5, dated Jan. 2, 2025, 5 pages.

* cited by examiner

RELEASABLE DOWNHOLE COMPONENT FOR SUBTERRANEAN DEPLOYMENT ALONG A WELLBORE STRING

CROSS REFERENCE TO RELATED APPLICATIONS

This application is a national stage application under 35 U.S.C. 371 and claims the benefit of PCT Application No. PCT/CA2022/050409 having an international filing date of 18 Mar. 2022, which designated the United States, and which PCT application claimed the benefit of U.S. Provisional Application No. 63/163,364 filed 19 Mar. 2021, the contents of both of which are incorporated herein by reference in their entireties.

TECHNICAL FIELD

The present disclosure relates to technologies for subterranean operations and, more particularly, to valve assemblies, systems and methods that can be used to inject or produce fluids and isolate wellbore sections within subterranean formations.

BACKGROUND

Recovering hydrocarbons from an underground formation can be enhanced by fracturing the formation in order to form fractures through which hydrocarbons can flow from the reservoir into a well. Fracturing can be performed prior to primary recovery where hydrocarbons are produced to the surface without imparting energy into the reservoir. Fracturing can be performed in stages along the well to provide a series of fractured zones in the reservoir. Following primary recovery, it can be of interest to inject fluids to increase reservoir pressure and/or displace hydrocarbons as part of a secondary recovery phase. Tertiary recovery can also be performed to increase the mobility of the hydrocarbons, for example by injecting mobilizing fluid and/or heating the reservoir. Tertiary recovery of oil is often referred to as enhanced oil recovery (EOR). Depending on various factors, primary recovery can be immediately followed by tertiary recovery without conducting any secondary recovery.

In addition, some recovery operations include pressurization, isolation and/or displacement of fluids for mobilizing the hydrocarbons. The well completion can therefore include multiple components having to be deployed downhole to cooperate with one another in desired configurations to perform the desired operations. Deploying the various components down the wellbore, injecting fluids into a fractured reservoir, and recovering hydrocarbons involves various challenges and there is a need for enhanced technologies in this field.

SUMMARY

Techniques described herein relate to valve assemblies, methods and system for injection of a fluid into a formation and recovery of fluids from the formation. In some implementations, there is provided a downhole component for integration within a wellbore string disposed along a wellbore defined within a subterranean reservoir, and including a sealing element and a fluid pressure-operable actuation assembly. Fluid pressure can be provided to cause movement of components of the actuation assembly to cause the sealing element to be compressed and engage the wellbore, for example, to seal wellbore intervals from one another. The downhole component can correspond to a valve assembly, and can also include an injection segment that can be activated by fluid pressure, e.g., where additional fluid pressure causes a burst disc to rupture to provide fluid communication with the formation. The down hole component can have various systems for locking in a configuration where the sealing element is engaged with the wellbore, and for releasing from the locked configuration to release the sealing element for displacement or retrieval of the wellbore string. Various implementations and features are described herein.

According to an aspect of the present disclosure, a downhole component for integration along a wellbore string extending along a wellbore is provided. The downhole component includes one or more fluid conduits connectable to the wellbore string and defining a conduit passage enabling fluid flow therethrough. The downhole component also includes a sealing element connected to the fluid conduits, the sealing element being operable between a disengaged configuration, where the sealing element is disengaged from an inner surface of the wellbore, and an engaged configuration, where the sealing element is engaged with the inner surface of the wellbore and seals portions of the wellbore on either side thereof. The downhole component also includes an actuation assembly having a blocking member releasably secured to the fluid conduits on a first side of the sealing element; and an actuation member slidably connected to the fluid conduits on a second side of the sealing element, the actuation member being fluid-pressure operable to engage and operate the sealing element from the disengaged configuration to the engaged configuration. The downhole component has a release mechanism operatively connected to the blocking member and operable to release the blocking member to enable movement thereof away from the actuation member to enable the sealing element to revert to the disengaged configuration, wherein the release mechanism is adapted to be selectively and independently operated relative to additional release mechanisms associated with adjacent downhole components along the wellbore string.

According to a possible implementation, the actuation member comprises a piston assembly having a tubular wall slidably coupled to the fluid conduits and a piston head connected to the tubular wall adjacent the sealing element, the piston head defining radial surfaces adapted to have fluid exert pressure thereon to fluid-pressure operate the actuation member.

According to a possible implementation, the downhole component further comprises a locking mechanism operatively connected to the actuation member and configurable in a locked configuration to prevent disengagement of the actuation member from the sealing element.

According to a possible implementation, the locking mechanism comprises a ratcheting system configured to enable movement of the actuation member toward the sealing element and prevent movement of the actuation member away from the sealing element.

According to a possible implementation, the ratcheting system comprises a lock ring provided between at least one of the fluid conduits and the actuation member, the lock ring being configured to at least partially control relative movement between the fluid conduits and the actuation member.

According to a possible implementation, the lock ring is secured to the fluid conduits and comprises an outer ring surface provided with first set of angled teeth, and wherein the actuation member comprises an inner surface provided with a second set of angled teeth adapted to cooperate with the first set of angled teeth to enable ratcheting the actuation member toward the sealing element.

According to a possible implementation, the release mechanism comprises a release member connected to the fluid conduits and adapted to engage the blocking member, and further comprises a biasing member adapted to releasably secure the release member in engagement with the blocking member to prevent movement thereof.

According to a possible implementation, upon operation of the release mechanism, the blocking member is allowed to axially slide along the fluid conduit away from the actuation member to enable the sealing element to revert to the disengaged configuration.

According to a possible implementation, the blocking member is releasably secured about a portion of one of the fluid conduits, and wherein the release member extends radially through a thickness of the fluid conduit to engage the blocking member, and wherein the biasing member is operatively coupled within the fluid conduit to bias the release member outwardly from within the conduit passage.

According to a possible implementation, the biasing member comprises a release sleeve slidably coupled to the fluid conduit along the conduit passage, the release sleeve being adapted to engage the release member from within the conduit passage, and is further adapted to be shifted along the conduit passage to disengage the release member and enable disengagement of the release member from the blocking member.

According to a possible implementation, the release mechanism comprises a defeatable member configured to releasably secure to the release sleeve within the fluid conduit in a desired position.

According to a possible implementation, the defeatable member is configured to releasably secure to the release sleeve within the fluid conduit in general alignment with the release member to bias same in engagement with the blocking member.

According to a possible implementation, the defeatable member comprises at least one shear pin.

According to a possible implementation, the release sleeve is selectively shiftable within the fluid conduit using a shifting tool deployed on a coiled tubing, a wireline, a slickline, a tubing or a dart.

According to a possible implementation, the release sleeve is shiftable in a downhole direction.

According to a possible implementation, the fluid conduit comprises a plurality of slots extending through a thickness thereof, and wherein the release member comprises a plurality of pegs positioned in respective slots and having a bottom end communicating with the conduit passage for engagement with the biasing member, and a top end adapted to engage the blocking member.

According to a possible implementation, the pegs are adapted to move radially outwardly within respective slots when the release mechanism is in the secured position, and are adapted to move radially inwardly within respective slots when the release mechanism is in the released position.

According to a possible implementation, operating the release mechanism deactivates the piston assembly to prevent engagement of the actuation member with the sealing element.

According to a possible implementation, operating the release mechanism isolates the internal radial surfaces to prevent fluid from exerting pressure thereon, thereby preventing engagement of the actuation member with the sealing element.

According to a possible implementation, the sealing element is positioned uphole of the release mechanism and downhole of the locking mechanism.

According to an aspect of the present disclosure, a valve assembly for integration within a wellbore string disposed along a wellbore defined within a subterranean reservoir is provided. The valve assembly includes a valve housing comprising a tubular wall defining a passage therethrough, an injection segment slidably coupled to the valve housing and comprising a fluid passageway allowing fluid to flow through the injection segment, the injection segment further comprising an injection head provided with an injection port defined through the injection head for establishing fluid communication with the surrounding reservoir and enable injection of fluid within the reservoir; an injection segment mandrel connected to and extending from the injection head, the injection segment mandrel being adapted to extend at least partially into the passage of the valve housing; a flow restriction component configured to restrict fluid flow between the fluid passageway and the injection port; and a sealing element connected to the injection segment mandrel between the injection head and the valve housing, the sealing element being actuatable between a run-in configuration, where the sealing element is spaced from an inner surface of the wellbore, and an operational configuration, where the sealing element engages the inner surface of the wellbore and sets the position of the valve assembly along the wellbore. The valve assembly includes an actuation assembly slidably mounted within the valve housing and operatively connected to the injection segment, the actuation assembly being fluid pressure-operable to displace the injection segment and actuate the sealing element from the run-in configuration to the operational configuration.

According to a possible implementation, the valve assembly further includes a breakable barrier installed within the injection port, the breakable barrier being fluid pressure-activated to operate the injection segment between a closed configuration where the breakable barrier occludes the injection port for preventing fluid flow into the reservoir, and an open configuration where the breakable barrier is removed from within the injection port for allowing fluid flow into the reservoir.

According to another aspect of the present disclosure, a valve assembly for integration within a wellbore string disposed along a wellbore defined within a subterranean reservoir is provided. The valve assembly includes a valve housing comprising a tubular wall defining a passage therethrough; an injection segment slidably coupled to the valve housing and comprising a fluid passageway allowing fluid to flow through the injection segment, the injection segment further comprising: an injection head provided with an injection port defined through the injection head for establishing fluid communication with the surrounding reservoir and enable injection of fluid within the reservoir; an injection segment mandrel connected to and extending from the injection head, the injection segment mandrel being adapted to extend at least partially into the passage of the valve housing; a flow restriction component configured to restrict fluid flow between the fluid passageway and the injection port; and a breakable barrier installed within the injection port, the breakable barrier being fluid pressure-activated to operate the injection segment between a closed configuration where the breakable barrier occludes the injection port for preventing fluid flow into the reservoir, and an open configuration where the breakable barrier is removed from within the injection port for allowing fluid flow into the reservoir. The valve assembly has a sealing element connected to the injection segment mandrel between the injection head and the valve housing, the sealing element being actuatable between a run-in configuration, where the sealing element is spaced from an inner surface of the wellbore, and an operational configuration, where the sealing element engages the inner surface of the wellbore and sets the position of the valve assembly along the wellbore; and an actuation assembly operatively connected to the valve housing and being fluid pressure-operable to displace the valve housing relative to the sealing element to actuate the sealing element from the run-in configuration to the operational configuration, wherein a breakable barrier activation pressure is greater than an actuation assembly operation pressure.

According to a possible implementation, the actuation assembly operation pressure is between about 1000 psi and about 2500 psi.

According to a possible implementation, the valve assembly comprises one or more tubing string segments connected to the injection segment and extending through the valve housing, and wherein the valve housing is slidably coupled to the tubing string segments and to the injection segment, the valve housing being configured to be displaced uphole via fluid pressure thereby engaging the sealing element.

According to a possible implementation, the tubing string segment comprises a first tubing string segment having a first segment head connected to the injection segment mandrel and a first segment mandrel extending from the first segment head, and wherein the first segment head is releasably connected to the tubular wall and is adapted to remain connected to the tubular wall when pressure within the fluid passageway is below the actuation assembly operation pressure.

According to a possible implementation, the first segment head is releasably connected to the tubular wall via one or more shear pins, and wherein the shear pins are adapted to break when the pressure within the fluid passageway reaches the actuation assembly operation pressure.

According to a possible implementation, the tubing string segments define a string fluid passage in fluid communication with the fluid passageway of the injection segment to enable fluid flow through the valve assembly, and wherein the injection segment mandrel is adapted to extend at least partially within and engage the first segment head.

According to a possible implementation, the injection segment mandrel and tubular wall define an annular gap therebetween, the first segment head being coupled between the injection segment mandrel and tubular wall, thereby sealing a downhole end of the annular gap and defining a fluid compartment.

According to a possible implementation, the actuation assembly comprises a coupling element having a generally cylindrical body secured to an uphole end of the tubular wall and adapted to receive the injection segment mandrel therethrough, and wherein a downhole portion of the cylindrical body extends within the valve housing between the injection segment mandrel and tubular wall to seal an uphole end of the fluid compartment, and wherein fluid flowing into the fluid compartment exerts pressure on the downhole portion of the cylindrical body to displace the coupling element and tubular wall uphole.

According to a possible implementation, the downhole portion of the coupling element includes a coupling element surface having a surface area of about four square inches against which fluid is adapted to exert pressure.

According to a possible implementation, the injection segment mandrel is provided with one or more openings for establishing fluid communication between the fluid passageway and the fluid compartment.

According to a possible implementation, the valve housing comprises a partition ring connected to an inner surface of the tubular wall and extending radially inwardly within the passage and defines a central aperture, and wherein the first segment mandrel is adapted to extend through the central aperture.

According to a possible implementation, the first segment head is adapted to limit uphole movement of the partition ring and of the tubular wall.

According to a possible implementation, the partition ring includes a partition ring surface communicating with the string fluid passage, and wherein fluid flowing along the string fluid passage exerts pressure on the partition ring surface to move the tubular wall uphole.

According to a possible implementation, the partition ring surface defines a ring surface area of about four square inches against which fluid is adapted to exert pressure.

According to a possible implementation, the first segment mandrel and tubular wall define a second annular gap therebetween, and wherein the second segment head is coupled between the first segment mandrel and the tubular wall, thereby sealing a downhole end of the second annular gap and defining a second fluid compartment, the partition ring being adapted to seal an uphole end of the second fluid compartment, and wherein fluid flowing into the second fluid compartment exerts pressure on the partition ring surface.

According to a possible implementation, the fluid pressure exerted on the partition ring surface is substantially the same as the fluid pressure exerted on the coupling element surface.

According to a possible implementation, the first segment mandrel is provided with one or more mandrel openings for establishing fluid communication between the string fluid passage and the second fluid compartment.

According to a possible implementation, the first fluid compartment is in fluid communication with the second fluid compartment such that the fluid pressure within the first fluid compartment is substantially the same as the fluid pressure within the second fluid compartment.

According to a possible implementation, the sealing element is positioned between the injection head and the coupling element, and wherein the injection head comprises a first abutment surface adapted to engage the sealing element on a first side thereof, and the coupling element comprises a second abutment surface adapted to engage the sealing element on a second side thereof, and wherein displacement of the coupling element via operation of the actuation assembly displaces the second abutment surface toward the first abutment surface, thereby squeezing the sealing element therebetween and urging a portion thereof radially outwardly to engage the inner surface of the wellbore and create an annular seal between the valve assembly and the wellbore.

According to a possible implementation, the first and second abutment surfaces are angled away from one another.

According to a possible implementation, the valve assembly further includes a locking assembly adapted to prevent downhole movement of the coupling element, the tubular wall and the partition ring when the sealing element is in the operational configuration.

According to a possible implementation, the locking assembly includes a ratcheting system adapted to enable uphole movement of the tubular wall and prevent downhole movement thereof.

According to a possible implementation, the ratcheting system includes a ratcheting mandrel slidably mounted along the valve housing and coupled between the second tubing segment and the tubular wall, and wherein the ratcheting mandrel includes a first set of angled teeth adapted to cooperate with the tubular wall to enable the tubular wall to be ratcheted uphole.

According to a possible implementation, the second tubing segment includes a retaining member adapted to receive a downhole portion of the ratcheting mandrel and limit downhole movement of the tubular wall.

According to a possible implementation, an uphole portion of the ratcheting mandrel is connected between the second tubing segment and the tubular wall via compression fit.

According to a possible implementation, the ratcheting system further includes a ratcheting ring provided between the ratcheting mandrel and the tubular wall of the valve housing, wherein the ratcheting ring comprises an inner surface provided with a second set of angled teeth configured to engage the first set of angled teeth to enable ratcheting the tubular wall uphole.

According to a possible implementation, the ratcheting ring comprises an outer surface provided with a third set of angled teeth, and wherein the tubular wall is provided with a fourth set of angled teeth configured to engage the third set of angled teeth to enable downhole movement of the tubular wall via a downhole shifting tool.

According to a possible implementation, the locking assembly comprises a release mechanism operable to disengage the ratcheting system and enable downhole movement of the tubular wall.

According to a possible implementation, the release mechanism comprises at least one peg positioned around the second tubing segment and extending through a thickness thereof such that a bottom end of the peg communicates with the string fluid passage, and wherein the release mechanism further comprises a release sleeve slidably mounted along the string fluid passage and adapted to engage the bottom end of the peg for urging the pegs radially outwardly and against the ratcheting mandrel.

According to a possible implementation, the release sleeve is shiftable along the string fluid passage to disengage the peg and release the ratcheting mandrel such that the first set of angled teeth of the ratcheting mandrel is disengaged, thereby enabling downhole movement of the tubular wall.

According to a possible implementation, the sealing element comprises resilient components configured to revert the sealing element from the operational configuration back to the run-in configuration when the pressure within the surrounding reservoir is greater than the pressure within the valve assembly.

According to a possible implementation, the resilient components comprise garter springs.

According to a possible implementation, the breakable barrier is configured to prevent fluid flow through the injection port when pressure within the fluid passageway is below the breakable barrier activation pressure, and rupture once the breakable barrier activation pressure is reached to allow fluid flow through the injection port.

According to a possible implementation, the breakable barrier activation pressure is between about 1500 psi and 5000 psi.

According to a possible implementation, the injection segment comprises a valve sleeve provided with the flow restriction component, the valve sleeve being positioned relative to the valve housing such that the flow restriction component restricts fluid flow between the fluid passageway and the injection port.

According to a possible implementation, the valve sleeve is securely connected to the inner surface of the tubular wall, and wherein the flow restriction component comprises a fluid channel is defined between an outer surface of the valve sleeve and the inner surface of the tubular wall.

According to a possible implementation, the fluid channel has a channel inlet defined in an inner surface of the valve sleeve, and a channel outlet defined in the outer surface of the valve sleeve, the fluid channel allowing fluid flow therethrough and fluidly connecting the fluid passageway and the injection port.

According to a possible implementation, the fluid channel is shaped and configured to provide a resistance to fluid flow.

According to a possible implementation, the fluid channel extends circumferentially around at least part of the valve assembly.

According to a possible implementation, the fluid channel defines a tortuous path.

According to a possible implementation, the fluid channel comprises a boustrophedonic pattern.

According to a possible implementation, the injection segment comprises a single injection port for injecting injection fluid into the reservoir.

According to a possible implementation, the valve assembly further includes a production segment comprising a production port defined through the tubular wall for establishing fluid communication between the passage of the valve housing and the surrounding reservoir and enable production operations.

According to a possible implementation, the first segment head comprises an inset region spaced from the tubular wall and defining a production chamber, the piston head being further provided with a secondary production port extending therethrough for establishing fluid communication between the production chamber and the string fluid passage, and wherein the production port communicates with the production chamber.

According to a possible implementation, the first segment head comprises a downhole surface provided with axial openings adapted to enable fluid located between the downhole surface and the partition ring to flow into the production chamber and reach the secondary production port.

According to a possible implementation, the production port comprises a plurality of elongated slits provided around the tubular wall.

According to a possible implementation, the production port comprises between about 5 and 100 slits.

According to a possible implementation, the slits are provided at regular intervals about the circumference of the tubular wall.

According to a possible implementation, the slits have a width between about 0.008 inches and about 0.25 inches, and a length between about 0.0625 inches and about 12 inches.

According to a possible implementation, the slits have a length being about 5 to 50 times greater than a width thereof.

According to a possible implementation, the first segment head comprises a single secondary production port.

According to a possible implementation, the secondary production port is provided with a plurality of production holes adapted to restrict fluid flow through the secondary production port and into the string fluid passage.

According to a possible implementation, the secondary production port is provided with a flow control device configured to control the direction of the fluid flowing through the secondary production port.

According to a possible implementation, the flow control device is a check valve.

According to a possible implementation, the valve assembly further includes a locking assembly configured to allow displacement from the run-in configuration to the operational configuration and prevent displacement from the operational configuration toward the run-in confirmation.

According to a possible implementation, wherein the locking assembly comprises a ratchet mechanism.

According to a possible implementation, the ratchet mechanism comprises a ratcheting mandrel having teeth on inner and outer surfaces, the teeth on the outer surface engaging teeth operatively connected to an inner surface of the valve housing and the inner surface teeth engaging teeth operatively connected to an outer surface of a component secured to the injection segment.

According to a possible implementation, the locking assembly is located on a downhole side of the sealing element.

According to a possible implementation, the valve assembly further includes a release mechanism operatively connected to the locking assembly and configured to unlock the locking assembly to permit displacement from the operational configuration toward a released configuration where the sealing element is released and/or decompressed and/or unset.

According to a possible implementation, the release mechanism comprises a release sleeve shiftable between a secure position and a release position, the release mechanism comprising at least one peg engaged by the release sleeve and configured to hold the locking assembly in a locked position while the release sleeve is in the secure position and to release the locking assembly to an unlocked position when the release sleeve is shifted to the release position.

According to a possible implementation, the release mechanism is located downhole of the sealing element.

According to a possible implementation, the release mechanism is located uphole of the sealing element.

According to a possible implementation, the peg of the release mechanism comprises outer teeth than form part of the locking mechanism.

According to a possible implementation, the release mechanism comprises a collet located in between the peg and the locking mechanism, the collet releasing the locking mechanism when the release sleeve is shifted to the release position and the peg disengages the collet.

According to a possible implementation, the reservoir is a hydrocarbon-containing reservoir.

According to a possible implementation, the reservoir is fractured as part of a plug-and-pert operation.

According to a possible implementation, fluids are produced as part of geothermal or acid solution mining operations.

According to another aspect of the present disclosure, a method comprising injecting a fluid into a wellbore having a well system comprising a plurality of the valve assemblies as defined above, at a fluid flowrate adapted to operate the actuation assembly and cause the breakable barriers to break and enable fluid communication between the valve assemblies and a surrounding reservoir is provided.

According to another aspect of the present disclosure, a well completion system for producing fluids from a reservoir via a wellbore provided in the reservoir is provided. The well completion system includes a wellbore string extending along the wellbore and comprising a valve assembly, the valve assembly comprising: a valve housing comprising a tubular wall defining a passage therethrough; an injection segment slidably coupled to the valve housing and comprising a fluid passageway allowing fluid to flow through the injection segment, the injection segment further comprising: an injection head provided with an injection port defined through the injection head for establishing fluid communication with the surrounding reservoir and enable injection of fluid within the reservoir; an injection segment mandrel connected to and extending from the injection head, the injection segment mandrel being adapted to extend at least partially into the passage of the valve housing; a flow restriction component configured to restrict fluid flow between the fluid passageway and the injection port; and a breakable barrier installed within the injection port, the breakable barrier being fluid pressure-activated to operate the injection segment between a closed configuration where the breakable barrier occludes the injection port for preventing fluid flow into the reservoir, and an open configuration where the breakable barrier is removed from within the injection port for allowing fluid flow into the reservoir; a sealing element connected to the injection segment mandrel between the injection head and the valve housing, the sealing element being actuatable between a run-in configuration, where the sealing element is spaced from an inner surface of the wellbore, and an operational configuration, where the sealing element engages the inner surface of the wellbore and sets the position of the valve assembly along the wellbore; an actuation assembly slidably mounted within the valve housing and operatively connected to the injection segment, the actuation assembly being fluid pressure-operable to displace the valve housing and actuate the sealing element from the run-in configuration to the operational configuration, wherein a breakable barrier activation pressure is greater than an actuation assembly operation pressure; and a production segment comprising a production port for establishing fluid communication between the passage and the surrounding reservoir to enable flow of production fluid from the reservoir into the passage, the tubular housing further including injection fluid passageways allowing injection fluid to flow through the production segment.

According to a possible implementation, the valve assembly comprises any one of the features defined above.

According to an aspect of the present disclosure, a method for recovering fluids via a well provided in a subterranean reservoir using the well completion system as defined above is provided. The method includes injecting an injection fluid down the wellbore string and through one or more injection segments into the reservoir to displace fluids from a first region of the reservoir to a second region of the reservoir; and producing a production fluid from the second region of the reservoir via one or more production segments.

According to a possible implementation, the steps of injecting fluid and producing fluid are performed in alternance.

According to a possible implementation, the reservoir is a hydrocarbon-containing reservoir.

According to a possible implementation, the reservoir is fractured as part of a plug-and-pert operation.

According to a possible implementation, fluids are injected into the reservoir as part of a waterflooding operation.

According to a possible implementation, fluids are injected into the reservoir as part of a CO2 flooding operation.

According to a possible implementation, the reservoir is a geothermal reservoir, and wherein fluids are produced as part of geothermal operations.

According to a possible implementation, fluids are injected into and produced from the reservoir as part of acid solution mining operations.

According to another aspect of the present disclosure, a valve assembly for integration within a wellbore string is provided. The valve assembly includes a valve housing comprising a tubular wall defining a passage therethrough; an injection segment slidably coupled to the valve housing and comprising one or more injection ports enabling injection of fluid into a surrounding reservoir, the injection segment comprising: a flow controller coupled to the injection port and being configured to be fluid pressure-activated from a closed configuration preventing fluid flow into the surrounding reservoir to an open configuration for establishing fluid communication between the wellbore string and the surrounding reservoir; and a valve sleeve fixedly secured within the injection segment and overlaying the injection port, the valve sleeve having a fluid channel shaped and configured such that fluid flowrate to the injection port is restricted; a sealing element operatively connected to the injection segment selectively operable to engage the wellbore surrounding the valve assembly and set a position of the valve assembly along the wellbore; and an actuation assembly mounted within the valve housing and being fluid pressure-activatable, the actuation assembly being operatively coupled to the valve housing in a manner such that activating the actuation assembly causes the valve housing to operate the sealing element for engaging the sealing element with the surrounding wellbore.

According to another aspect of the present disclosure, a downhole component for integration along a wellbore string is provided. The downhole component includes conduit segments coupled together and defining a conduit passage adapted to enable fluid flow through the conduit segments; a housing comprising a tubular wall defining a passage therethrough adapted to receive the conduit segments therein, the tubular wall being slidably coupled to one or more of the conduit segments; a sealing element operatively connected to the conduit segments and being operable between a run-in configuration, where the sealing element is disengaged from an inner surface of the wellbore, an operational configuration, where the sealing element is engaged with the inner surface of the wellbore, and a released configuration, where the sealing element is allowed to disengage the inner surface of the wellbore; an actuation assembly comprising an actuation member connected to the tubular wall and being fluid pressure-activatable to cause the actuation member to engage and operate the sealing element from the run-in configuration to the operational configuration; and a locking assembly operatively coupled to the actuation assembly and operable between a locked configuration to prevent the sealing element from operating in the released configuration once in the operational configuration, and an unlocked configuration to enable the sealing element to operate from the operational configuration to the released configuration; and a release mechanism operatively connected to the locking assembly and being operable between a secured position where the locking assembly is maintained in the locked configuration, and a released position where the locking assembly is operated in the unlocked configuration, wherein the release mechanism is adapted to be selectively and independently operated relative to additional release mechanisms associated with adjacent downhole components along the wellbore string.

According to a possible implementation, the conduit segments comprise a lockable conduit, and wherein the locking assembly comprises a lock ring provided between and engaging the lockable conduit and the tubular wall to at least partially control relative movement therebetween.

According to a possible implementation, the lock ring, the lockable conduit and the tubular wall are adapted to cooperate and define a ratcheting system configured to enable movement of the actuation member and the tubular wall in a first direction relative to the conduit segments and prevent movement of the actuation member and the tubular wall in a second direction relative to the conduit segments when operating the locking assembly in the locked configuration.

According to a possible implementation, the release mechanism comprises a release member connected to the lockable conduit, and further comprises a biasing member adapted to releasably secure the release member in engagement with the lock ring to maintain the locking assembly in the locked configuration.

According to a possible implementation, the release member extends radially through a thickness of the lockable conduit to communicate with the conduit passage, and wherein the biasing member is operatively coupled within the lockable conduit to bias the release member outwardly from within the conduit passage.

According to a possible implementation, the biasing member comprises a release sleeve slidably coupled to the lockable conduit along the conduit passage, the release sleeve being adapted to engage the release member from within the conduit passage when in the secured position, and is further adapted to be shifted along the conduit passage to the released position to disengage the release member and enable disengagement of the lock ring from the tubular wall.

According to a possible implementation, the release mechanism comprises a defeatable member configured to releasably secure to the release sleeve within the lockable conduit in the secured position.

According to a possible implementation, the defeatable member is configured to releasably secure to the release sleeve within the lockable conduit in general alignment with the release member.

According to a possible implementation, the defeatable member comprises at least one shear pin.

According to a possible implementation, the release sleeve is selectively shiftable from the secured position to the released position within the lockable conduit using a shifting tool deployed on a coiled tubing, a wireline, a slickline, a tubing or a dart.

According to a possible implementation, the release sleeve is shiftable from the secured position to the released position in a downhole direction.

According to a possible implementation, the ratcheting system includes a first set of complementarily-shaped ratcheting members configured to engage one another to enable movement of the tubular wall in the first direction relative to the lock ring and the lockable conduit, and prevent movement of the tubular wall in the second direction relative to the lock ring and the lockable conduit.

According to a possible implementation, the lock ring comprises an outer ring surface and the tubular wall comprises an inner wall surface, and wherein the first set of complementarily-shaped ratcheting members comprises a first set of angled teeth provided along the outer ring surface and a second set of angled teeth provided along the inner wall surface to enable the tubular wall and the actuation assembly to be ratcheted in the first direction relative to the lock ring.

According to a possible implementation, the ratcheting system includes a second set of complementarily-shaped ratcheting members configured to engage one another to secure the lock ring relative to the lockable conduit.

According to a possible implementation, the biasing member is adapted to bias the second set of complementarily-shaped ratcheting members in engagement with one another to secure the lock ring to the lockable conduit.

According to a possible implementation, the lock ring comprises an inner ring surface and the release member comprises an outer ratcheting surface, and wherein the second set of complementarily-shaped ratcheting members comprises a third set of angled teeth provided along the inner ring surface and a fourth set of angled teeth provided along the outer ratcheting surface.

According to a possible implementation, the lockable conduit comprises a plurality of slots extending through a thickness thereof, and wherein the release member comprises a plurality of pegs positioned in respective slots and having a bottom end communicating with the conduit passage for engagement with the release sleeve, and a top end provided with the outer ratcheting surface.

According to a possible implementation, the pegs are adapted to move radially outwardly within respective slots when the release mechanism is in the secured position, and are adapted to move radially inwardly within respective slots when the release mechanism is in the released position.

According to a possible implementation, the actuation member comprises a piston mechanism defining internal radial surfaces adapted to have fluid exert pressure thereon to move the actuation member to engage the sealing element.

According to a possible implementation, moving the release mechanism from the secured position to the released position deactivates the piston mechanism to prevent engagement of the actuation member with the sealing element.

According to a possible implementation, moving the release mechanism from the secured position to the released position isolates the internal radial surfaces to prevent fluid from exerting pressure thereon, thereby preventing engagement of the actuation member with the sealing element.

According to a possible implementation, the sealing element is bonded with one of the conduit segments.

According to a possible implementation, wherein the sealing element is positioned uphole of the locking assembly and the release mechanism.

A downhole assembly comprising downhole components for integration along a wellbore string extending along a wellbore, each downhole components having fluid conduits connectable to the wellbore string and enabling fluid flow therethrough; a sealing element operatively connected to the fluid, the sealing element being operable between a run-in configuration, where the sealing element is disengaged from an inner surface of the wellbore, an operational configuration, where the sealing element is engaged with the inner surface of the wellbore and sets the position of the downhole component along the wellbore, and a released configuration, where the sealing element is allowed to disengage the inner surface of the wellbore; an actuation member slidably connected to the fluid conduits, the actuation member being fluid-pressure operable to engage and operate the sealing element from the run-in configuration to the operational configuration; a locking assembly operatively coupled to the actuation member and configurable in a locked configuration to prevent operation of the sealing element from the operational configuration to the released configuration, the locking assembly being further configurable in an unlocked configuration to allow operation of the sealing element from the operational configuration to the released configuration; and a release mechanism operatively connected to the locking assembly and being operable to configure the locking assembly in the unlocked configuration, wherein the release mechanism is adapted to be selectively and independently operated relative to adjacent release mechanisms associated with adjacent downhole components along the wellbore string.

According to a possible implementation, the actuation member comprises a piston assembly having a tubular wall slidably coupled to the fluid conduits and a piston head connected to the tubular wall adjacent the sealing element, the piston head defining radial surfaces adapted to have fluid exert pressure thereon to fluid-pressure operate the actuation member.

According to a possible implementation, the release mechanism comprises a piston-defeater adapted to prevent fluid-pressure operation of the actuation member upon operating the release mechanism to configure the locking assembly in the unlocked configuration.

According to a possible implementation, the downhole components of the downhole assembly further includes any one of the features defined above.

According to a possible implementation, the downhole component is a valve assembly as defined above.

According to another aspect of the present disclosure, a process for retrieving a wellbore string provided with a plurality of the downhole components as defined above from a wellbore is provided. The process includes operating the release mechanism of a first downhole component to configure the locking assembly in the unlocked configuration to allow disengagement of the actuation member from the sealing element; operating the release mechanism of subsequent downhole components along the wellbore string; and pulling on the wellbore string for retrieval.

According to a possible implementation, the sealing element is bonded with one of the conduit segments to define a bonded conduit segment, and wherein the process further comprises pulling on the bonded conduit segment to disengage the sealing element from the inner surface of the wellbore.

DETAILED DESCRIPTION

Figure 1:
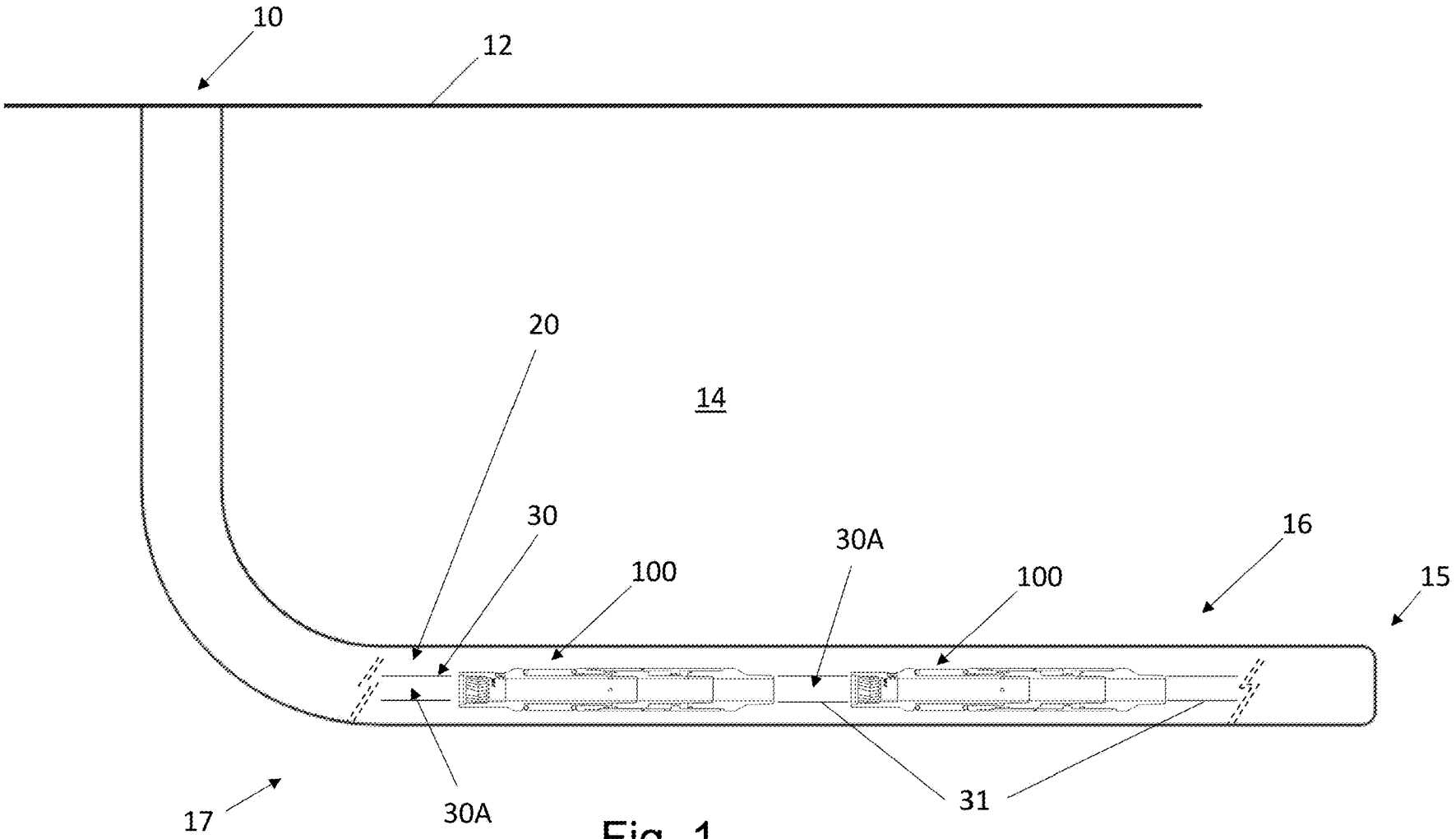
FIG. 1 is a transverse cut view of a wellbore with downhole components integrated along a wellbore string in a horizontal section extending in a reservoir, according to an implementation.

As will be explained below in relation to various implementations, the present disclosure describes apparatuses, systems and methods for various operations, such as the recovery of hydrocarbon material from a subterranean formation.

More particularly, the present disclosure describes a valve assembly for downhole deployment within a wellbore extending into the subterranean reservoir. The valve assembly can be deployed in a well in a run-in configuration, such as a closed configuration, and is converted to an operational configuration, such as an open configuration, using fluid pressure for operation of a sealing mechanism (e.g., packer) adapted to set the valve assembly in place in the wellbore in a sealed arrangement, and to subsequently defeat a barrier (e.g., burst disk) blocking a port to enable injection into the reservoir. The fluid pressure can thus set the packer within the annulus of the wellbore and then create fluid communication between the inside and outside of the valve by defeating the burst disk.

The valve assembly is shaped, sized and adapted to be integrated as part of a wellbore string, with the sealing mechanism being further adapted to separate the well into stages, such as injection and production stages, for example. The sealing mechanism includes fluid-activatable sealing elements configured to use fluid flow, such as injection fluid flow, to engage the wellbore and set the position of the valve assembly. It should thus be understood that the valve assembly can be generally secured within the wellbore via the injection of fluids down the wellbore string. As will be described further below, the valve assembly is operable between various configurations for allowing fluid to be injected within the reservoir, and reservoir fluid to be produced from the reservoir into the valve assembly for recovery to surface.

In example implementations, the valve assembly is operable to inject fluid (e.g., a fluid for stimulating hydrocarbon production via a drive process, such as waterflooding, or via a cyclic process, such as "huff and puff") into the subterranean formation, and to produce reservoir fluids containing hydrocarbons. In other words, the valve assembly can be configured to allow both injection and production operations within the reservoir. The valve assembly can be operated using various fluids, such as liquids, gases, or mixtures of liquids and gases. For instance, in some implementations, the injection fluid can include water, steam, solvent (propane, LPG, xylene, etc.) or a combination thereof. In some implementations, the injection fluid can include $CO_2$ gas and/or supercritical $CO_2$. Further, in some implementations, the injection fluid may include polymers, surfactants, and the like.

As will be described further below, the valve assembly and corresponding structural features of the completion system can be operated for the injection and/or recovery of fluids via the wellbore. The valve assembly can include an injection segment provided with a flow restriction component, such as a tortuous path, in fluid communication with the port of the valve assembly such that fluid injection via the port is restricted once the barrier is defeated. The valve assembly can also include a production segment configured to enable production of fluid from the reservoir via the valve assembly. In addition, the sealing mechanism can include a fluid-activatable actuation assembly adapted to cooperate with the sealing element, whereby operation of the actuation assembly engages the sealing element to set the valve assembly within the well and/or define two or more stages of the well.

In some implementations, the sealing mechanism can be integrated as part of the valve assembly, and is thus adapted to be displaced along with it. The valve assembly can further be provided with a locking mechanism configured to lock the sealing mechanism when engaging the wellbore, thereby securing the valve assembly in position and allowing fluid flow to be decreased or halted without unsetting the valve assembly from within the well. In addition, the valve assembly can include a release mechanism configured to selectively unlock the valve assembly and enable retrieval of the valve assembly from the wellbore.

It is noted that the various implementations of the valve assembly described herein can be implemented in various wellbores, formations, and for various applications such as hydrocarbon recovery and geothermal applications. In some implementations, the wellbore can be straight, curved, or branched, and can have various wellbore sections. A wellbore section should be considered to be an axial length of a wellbore. A wellbore section can be characterized as "vertical" or "horizontal" even though the actual axial orientation can vary from true vertical or true horizontal, or can tend to undulate or corkscrew or otherwise vary. The term "horizontal", when used to describe a wellbore section, refers to a horizontal or highly deviated wellbore section as understood in the art, such as a wellbore section having a longitudinal axis that is between 70 and 110 degrees from vertical. For simplicity, it is noted that the conduits, channels, passageways, pipes, tubes and/or other similar components referred to in the present disclosure have a cross-section that is preferably circular or annular, although it should be appreciated that other shapes are also possible.

In some implementations, reservoir fluids are recovered from the reservoir by initially injecting a fluid (which can be referred to as a mobilizing fluid or an injection fluid) within the reservoir via the injection segment of the valve assembly. In some applications, the injection fluid is adapted to mobilize hydrocarbons contained in the reservoir and drive the hydrocarbons towards the production segment, or towards a production well for recovery of the hydrocarbons. In hydrocarbon recovery operations, the production segments are adapted for receiving fluid that can include mobilized hydrocarbons from the reservoir and for producing the mobilized hydrocarbons to ultimately recover the hydrocarbons at surface. In some implementations, the valve assembly is toollessly operable, i.e., does not require the intervention of downhole tools, such as shifting tools deployed on coiled tubing, to open the valve assembly and enable fluid communication with the surrounding formation. Such a toollessly-operable valve assembly can be fluid pressure activated, as will be described in further detail below.

Figure 2:
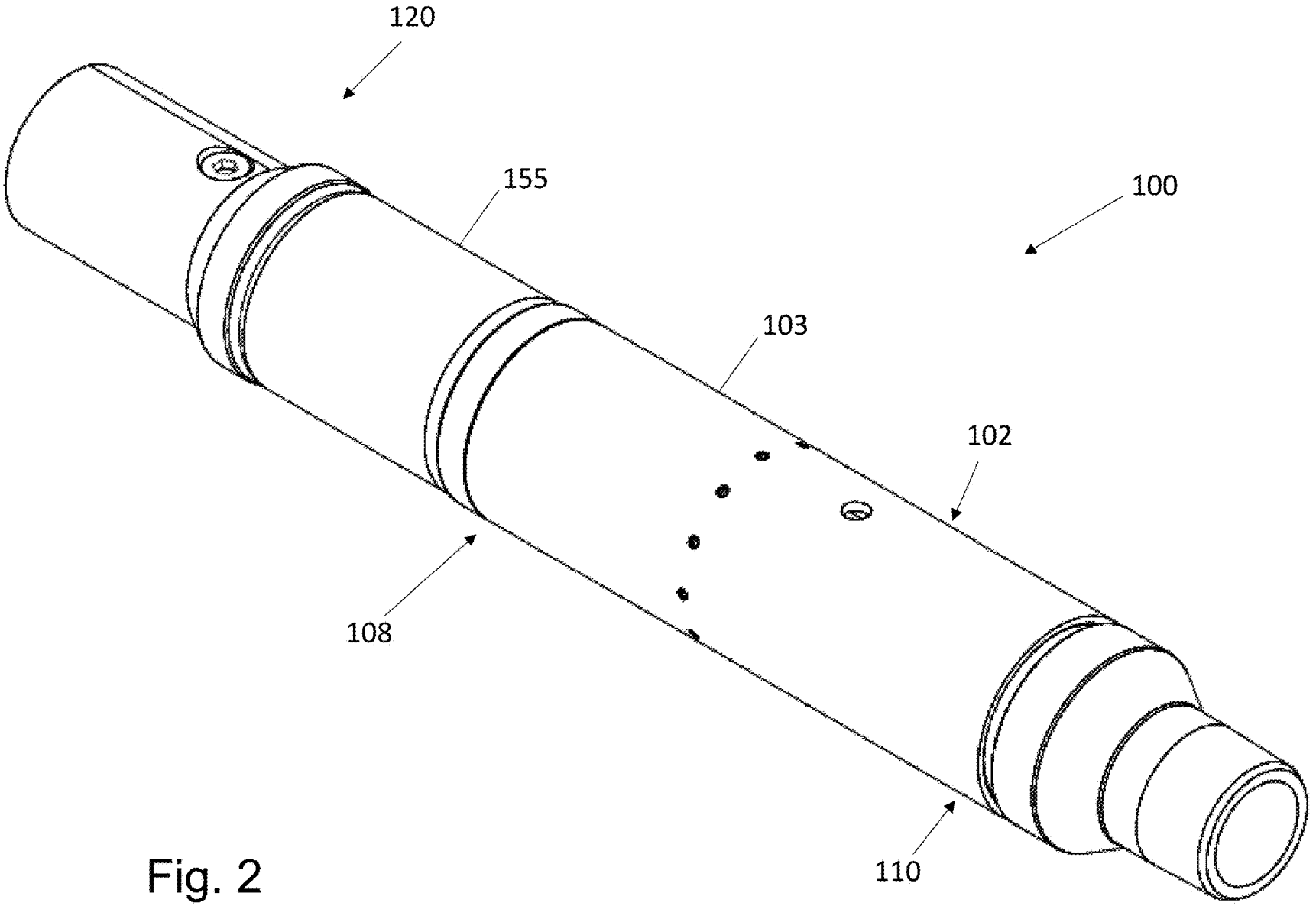
FIG. 2 is a perspective view of a downhole component corresponding to a valve assembly comprising a port to enable fluid communication between the wellbore and the wellbore string, according to an implementation.

With reference to FIGS. 1 and 2, a wellbore 10 extends from the surface 12 and into a reservoir 14. A well completion system 20 including one or more valve assemblies 100 can be integrated as part of a wellbore string 30 extending within the wellbore 10. The wellbore string 30 defines a wellbore string passage 30A for conducting fluid between the surface 12 and the reservoir 14. In some implementations, the valve assemblies each include at least one passage allowing fluid flow therethrough. It should therefore be understood that the valve assemblies include passages that can form part of the wellbore string passage 30A along at least a portion of the wellbore, such that fluid communication between the surface 12 and the reservoir 14 can be established via the valve assemblies 100. More specifically, and as will be described below, the valve assembly 100 can be provided with one or more ports at respective locations along the wellbore for establishing fluid communication between the wellbore string 30 and the reservoir 14. It is also noted that conduits 31 of the wellbore string 30 can be located on either end of the valve assembly 100 and can be coupled to respective ends thereof by any suitable method. It is also possible to connect some or all of the valve assemblies end-to-end without any intervening conduits 31.

As seen in FIG. 1, the wellbore 10 can include a horizontal wellbore section 16 having a toe 15 and a heel 17 at respective ends thereof. It should be understood that, as used herein, the expression "toe" refers to an end region of the horizontal wellbore section, such as the end region furthest from surface. Similarly, the expression "heel", as used herein, refers to the opposite end region of the horizontal section, i.e., the beginning of the horizontal wellbore section 16, and may include at least part of the curved transition section between the horizontal and vertical sections of the wellbore 10. Therefore, the expressions "downhole" and "uphole" used herein can refer to directional features, whereby uphole is in a general direction towards the heel 17, and downhole is in a general direction towards the toe 15.

Figure 9:
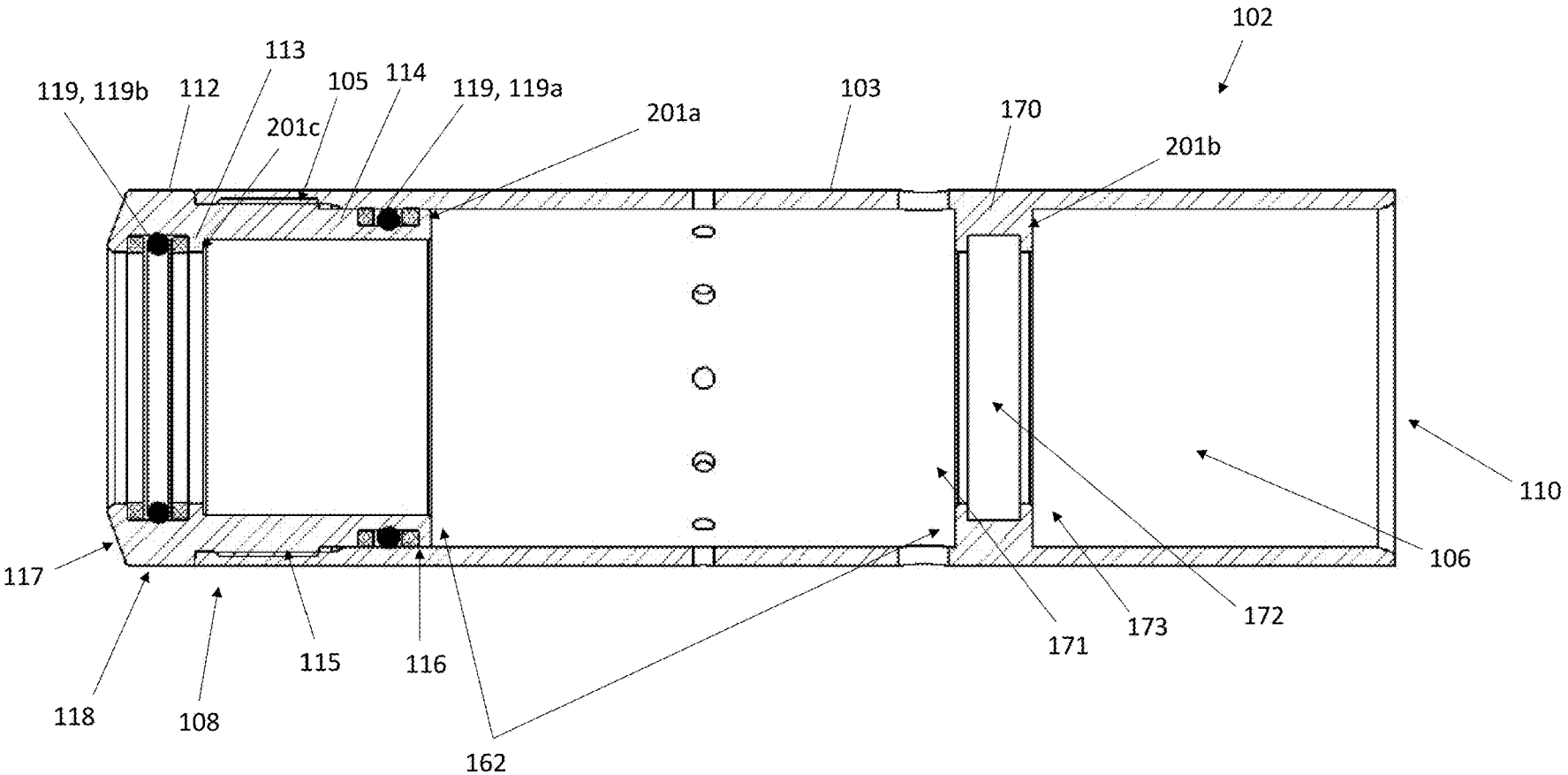
FIG. 9 is an enlarged view of the actuation assembly, showing a piston head connected to a tubular housing, according to an implementation.

With reference to FIGS. 3 to 9, in addition to FIGS. 1 and 2, the valve assembly 100 includes a valve housing 102 having a tubular wall 103 defining a central passage 106 for enabling fluid communication through the housing 102 (e.g., axially through the housing 102). In other words, the central passage 106 can act as a fluid passage configured to allow a flow of fluid therethrough and along the wellbore string. Referring more specifically to FIG. 9, the valve housing 102 has an uphole end 108 and a downhole end 110 connectable between lengths of conduits or other components of the valve assembly 100, in order to integrate the valve assembly with the wellbore string. In some implementations, the valve housing 102 can be provided with a coupling element 112 provided proximate the uphole end 108 and configured to receive and hold a component of the valve assembly 100 therein.

In the illustrated implementation, the coupling element 112 includes a generally cylindrical body 114 connected to the tubular wall 103. As seen in FIG. 9, the cylindrical body 114 can have a downhole portion 116 adapted to be at least partially inserted within the tubular wall 103, for example, via interference fit, although other connection methods are possible, such as via fasteners. The body 114 of the coupling element 112 can further include an uphole portion 118 having a greater outer diameter (e.g., relative to the downhole portion 116) such that the uphole portion 118 abuts against the uphole end of the tubular wall 103, thereby blocking downhole movement of the coupling element 112. In some implementations, the outer diameter of the uphole portion 118 is substantially the same as the outer diameter of the tubular wall 103 thereby defining a generally smooth outer surface of the valve housing 102, although it is appreciated that other suitable outer diameters are possible. As will be described further below in relation to other components of the valve assembly 100, the body 114 can define an abutment surface 117 extending circumferentially about the uphole end 118 of the coupling element 112. As seen in FIG. 9, the abutment surface 117 can be perpendicular, or angled relative to the fluid passage 106 for abutting against a component positioned uphole of the valve housing 102.

In the illustrated implementation, the coupling element 112 has an outer surface, part of which is complementarily shaped with respect to an inner surface of the tubular wall 103. As such, engagement of the coupling element 112 within the tubular wall 103 can lock the coupling element 112 in place via the engagement of the complementarily shaped surfaces with one another. For example, in this implementation, the inner surface of the tubular wall 103 is provided with a wall slot 105 extending circumferentially thereabout, while the outer surface of the coupling element 112 (e.g., of the downhole portion 116) includes a coupling protrusion 115 shaped and sized to key into the wall slot 105 to block axial and/or radial movement of the coupling element 112 relative to the tubular wall 103. The coupling element 112 can be further provided with one or more seals 119 (e.g., O-rings) for preventing fluid flow into the annular gap between the coupling element 112 and tubular wall 103, or between the coupling element 112 and the uphole component connected thereto. For example, the coupling element 112 can include a first seal, such as an external seal 119*a*, positioned around the downhole portion 116 for engaging the inner surface of the tubular wall 103; and a second seal, such as an internal seal 119*b*, positioned within the uphole portion 118 for engaging the component extending into the valve housing 102 through the coupling element 112, as will be described below.

Figure 5:
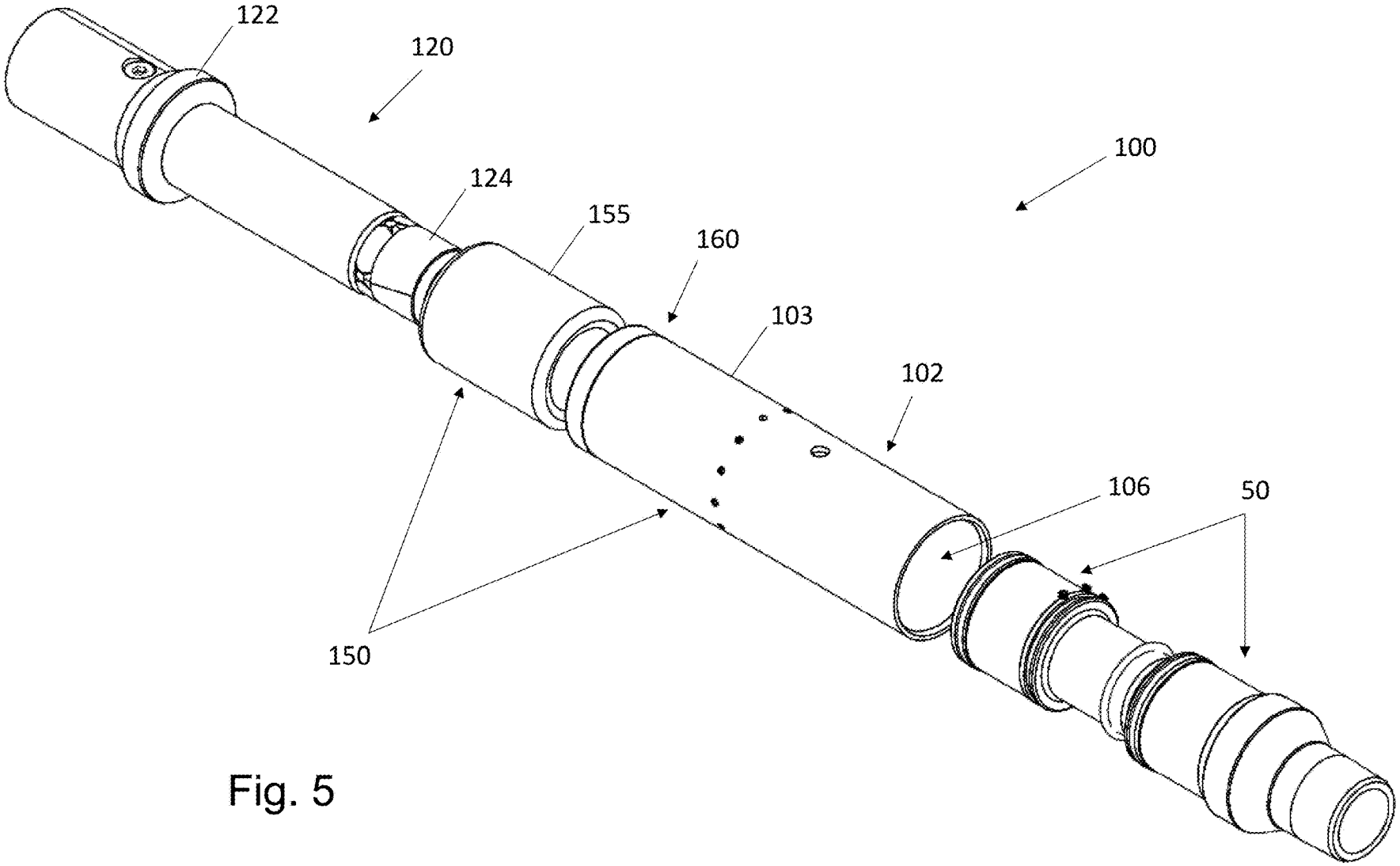
FIG. 5 is a perspective exploded view of the valve assembly shown in FIG. 2, showing an actuation assembly coupled to fluid conduits for engaging a sealing element, according to an implementation.
Figure 10:
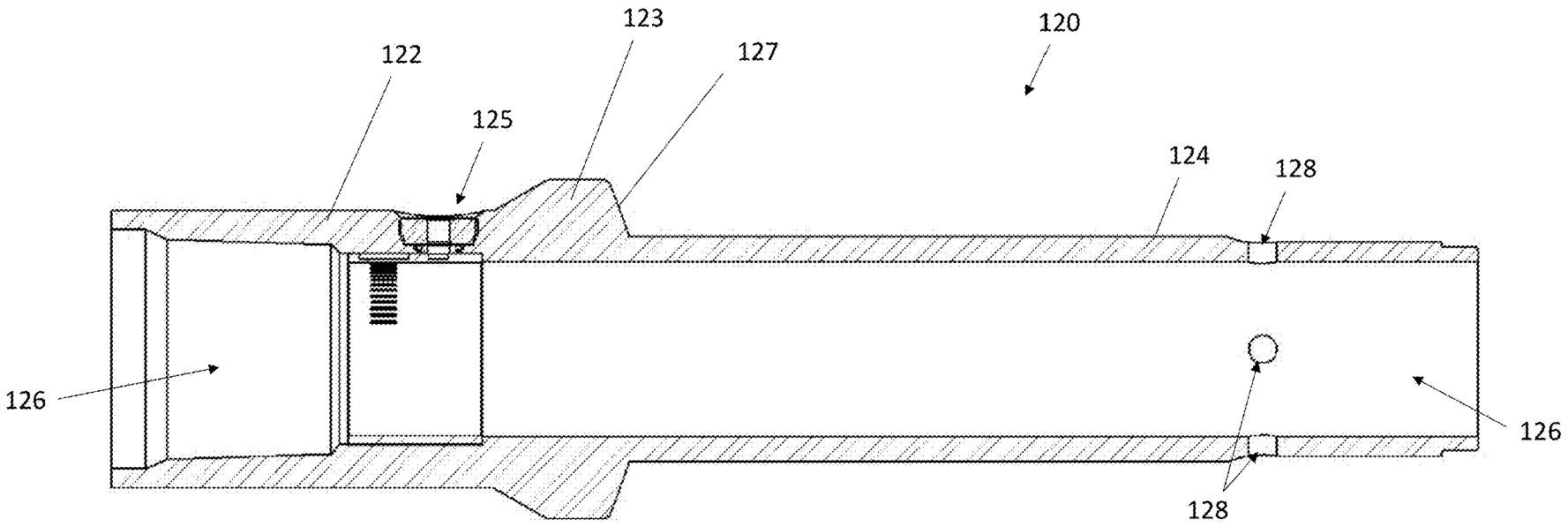
FIG. 10 is an enlarged view of the injection segment shown in FIG. 8, showing an injection head and an injection mandrel, according to an implementation.
Figure 11:
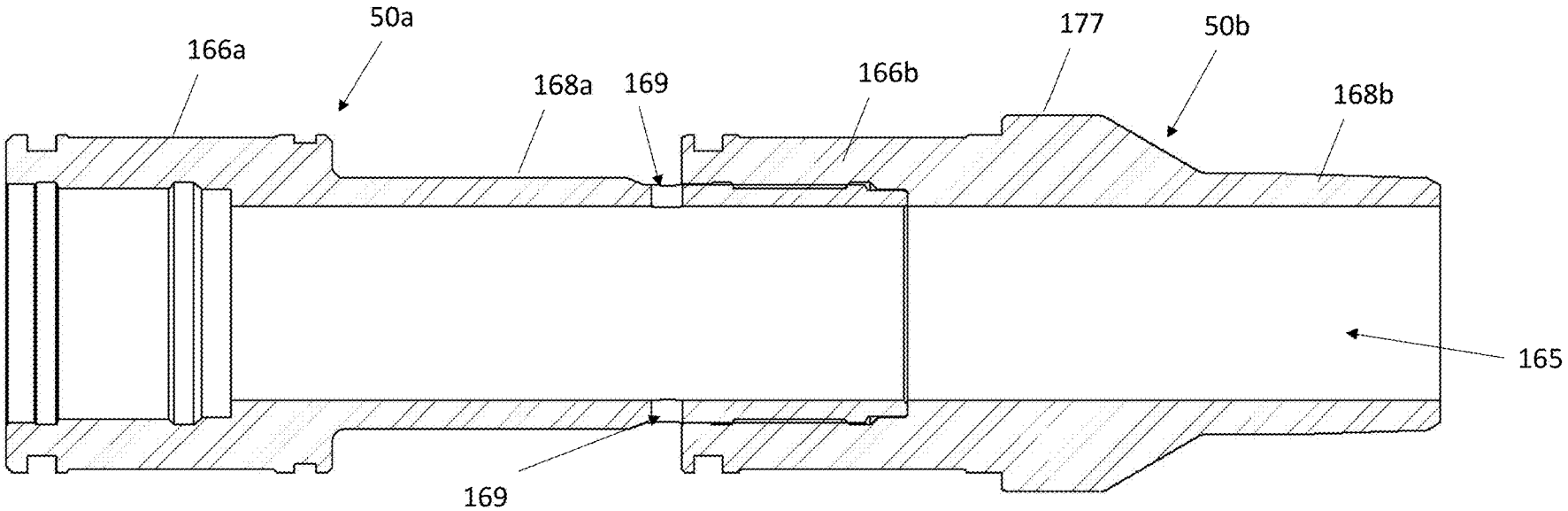
FIG. 11 is a transverse cut view of fluid segments connectable to one another, according to an implementation.

Now referring to FIG. 10, in addition to FIGS. 5 and 9, the valve assembly 100 includes an injection segment 120 adapted to be coupled to the valve housing 102. The injection segment 120 at least partially extends within the fluid passage 106 and engages the coupling element 112. In some implementations, the injection segment 120 is provided with one or more injection ports 125, through which fluid communication between the passage 106 and an environment external to the valve assembly 100 (e.g., the reservoir) is established. In this implementation, the injection segment 120 includes an injection head 122 provided with the one or more injection ports 125, and an injection segment mandrel 124 extending from the injection head 122 and configured to extend within the valve housing 102. The injection segment 120 defines a fluid passageway 126 extending therethrough and enabling fluid to flow axially through the injection segment 120. It should thus be noted that the fluid passageway 126 of the injection segment 120 can be in fluid communication with the fluid passage 106 of the valve housing 102 such that fluid can flow axially through both the injection segment and valve housing.

In some implementations, the injection head 122 can correspond to the upholemost component of the valve assembly 100, and is thereby adapted to be connected to an uphole component of the wellbore string. For example, in this implementation, the injection head 122 can be shaped and adapted to receive a conduit 31 therein, as shown in FIG. 1, although it is appreciated that other components can be connected to the injection head 122, such as another valve assembly 100. The conduit 31 can be connected to the injection head 122 via any suitable method, such as via threaded connectors, via interference fit, via a slot and key connection or via fasteners, for example.

Figure 6:
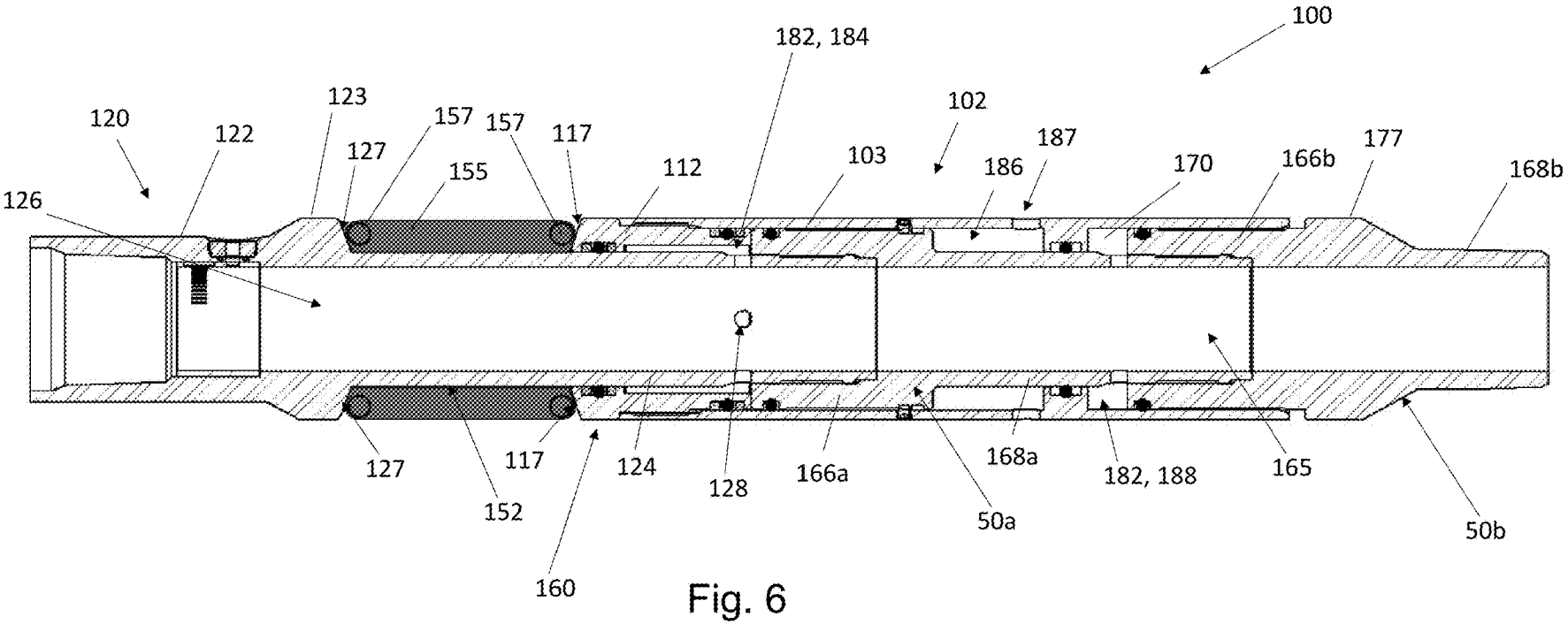
FIG. 6 is a transverse cut view of the valve assembly shown in FIG. 3, showing a piston mechanism coupled to the sealing element for operation thereof, according to an implementation.
Figure 7:
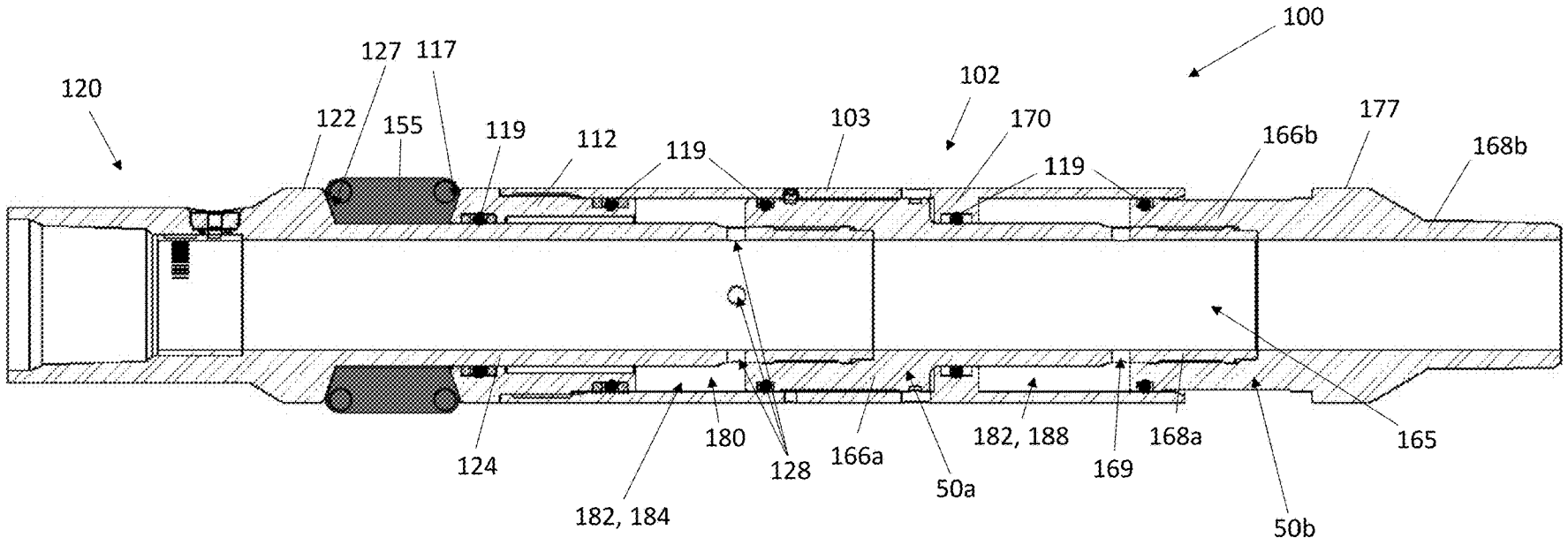
FIG. 7 is a transverse cut view of the valve assembly shown in FIG. 4, showing the piston mechanism engaged with the sealing element for operation thereof in the operational configuration, according to an implementation.
Figure 8:
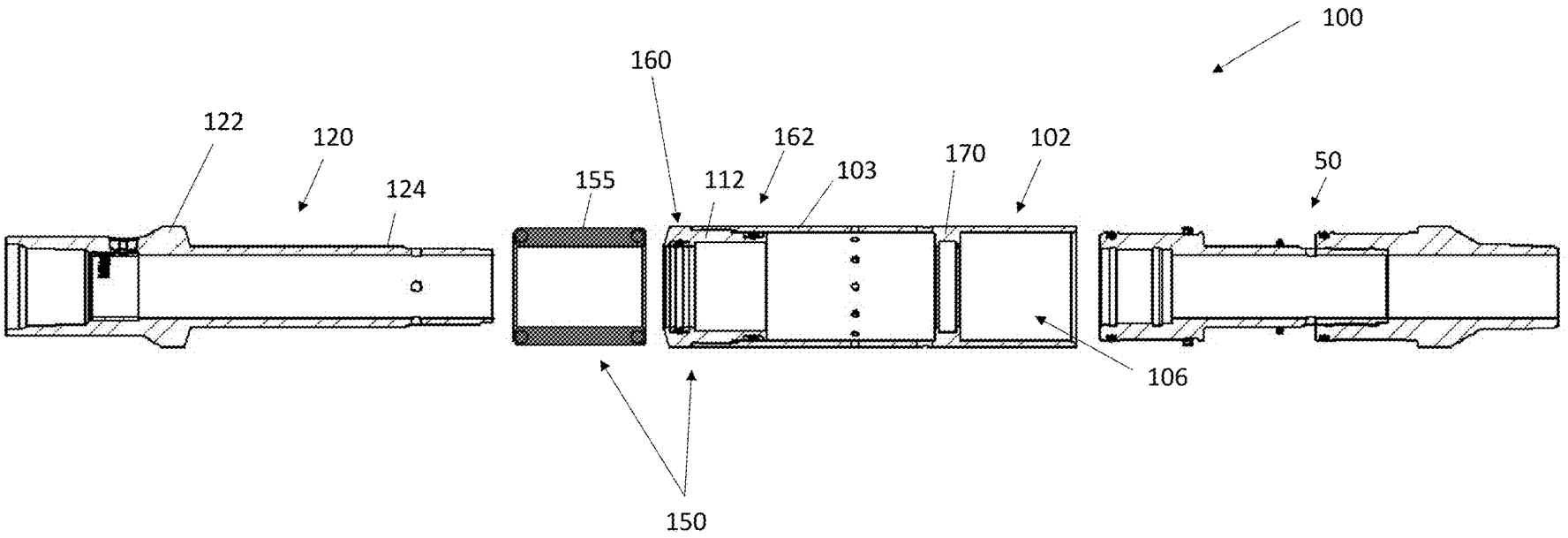
FIG. 8 is an exploded transverse cut view of the valve assembly shown in FIG. 2, showing an injection segment provided with an injection port, and an actuation assembly comprising the piston mechanism, according to an implementation.

In the illustrated implementation, the injection segment mandrel 124 is adapted to extend within the valve housing 102 and be coupled thereto. More specifically, the injection segment mandrel 124 engages and extends through the coupling element 112 to connect the injection segment 120 to the valve housing 102. In this implementation, the injection segment 120 is slidably connected to the valve housing 102 such that axial movement of the injection segment 120 relative to the valve housing 102 is possible. As seen in FIG. 10, the injection head 122 can be provided with a protruding portion 123 extending radially outward and therefore having a greater outer diameter than the other portions of the injection segment 120 (e.g., the injection segment mandrel 124). For example, the protruding portion 123 can have an outer diameter which is substantially the same as that of the tubular wall 103 and the uphole portion 118 of the coupling element 112, thereby preventing entry of the tubular head 122 within the valve housing 102 and limiting axial movement of the injection segment mandrel 124 within the valve housing 102. In this implementation, the protruding portion 123 defines an abutment surface 127 adapted to abut against a component positioned downhole of the injection head 122, as will be described further below. As seen in FIGS. 6 and 7, the internal seal 119*b* of the coupling element 112 can be configured to engage the injection segment mandrel 124 to prevent fluid to flow out of the valve housing 102, e.g., between the injection segment mandrel 124 and the coupling element 112.

With reference to FIG. 10, the injection segment 120 can include a plurality of ports (e.g., two, three, four, six, eight, etc.) or can alternatively include a single injection port 125. When a plurality of ports are present, they can be distributed about a circumference of the injection head 122, and may be adjacent to and uphole of the protruding portion 123. The injection port 125 can be formed as a generally tubular opening through the injection head 122. In some implementations, each injection segment 120 is configurable in a plurality of operational configurations, and each one of the operational configurations, independently, corresponds to a state of fluid communication, via the injection ports 125, between the passageway 126 (and thus the wellbore string) and the surrounding reservoir outside of the valve assembly 100. In other words, fluid flow through the injection port 125 can be at least partially controlled via a change in the operational configuration of the injection segment 120 (e.g., a change from a first operational configuration to a second operational configuration).

For example, the injection segment 120 can be operated in the first operational configuration, such as a closed configuration, where the injection ports 125 are occluded, therefore preventing fluid flow into the reservoir. In addition, the injection segment 120 can be operated from the closed configuration to the second operational configuration, such as an open configuration, where one or more of the injection ports 125 are at least partially open or fully open. It is appreciated that in the open configuration, the injection segment 120 enables fluid to flow through the one or more injection ports 125 and into the reservoir. As will be described further below, the injection segment 120 can be operable from the closed configuration to the open configuration using fluid flow. As such, the injection segment 120 can be toollessly operated from the closed configuration to the open configuration, for example, via an increase in the fluid pressure within the valve assembly 100. It is noted that, once a flow of injection fluid is initiated along the wellbore, the injection segment 120 does not require intervention from downhole tools, such as shifting tools deployed on coiled tubing to transition the valve to the open configuration. Nevertheless, it is noted that certain other implementations of the valve assembly can be provided such that downhole tools can actuate or shift certain components.

In some implementations, the valve assembly 100 can include one or more tubing string segments 50 adapted to be coupled to the injection segment 120 and extend through the valve housing 102. As seen in FIGS. 6 and 7, the tubing string segments 50 can include a first tubing string segment 50*a* connected to the injection segment mandrel 124 and extending toward the downhole end 110 of the valve housing 102. In addition, the tubing string segments can include a second tubing string segment 50*b* connected to the first tubing string segment 50*a* and extending further downhole (e.g., further than the tubular wall 103). It should thus be noted that, in this implementation, the second tubing string segment 50*b* is adapted to be connected to a separate length of conduit positioned downhole of the valve assembly 100 in order to integrate the valve assembly with the wellbore string. Therefore, in this implementation, the valve assembly 100 is integrated to the wellbore string 30 (see FIG. 1) via the injection segment 120 at the uphole end, and via the second tubing string segment 50*b* at the downhole end.

Referring back to FIGS. 1 to 4, in some implementations, the wellbore 10 includes a casing 250 lining an inner surface of the wellbore 10. The casing 250 can be adapted to contribute to the stabilization of the reservoir 14 after the wellbore 10 has been drilled, e.g., by contributing to the prevention of the collapse of the walls of the wellbore 10. In some implementations, the casing 250 includes one or more successively deployed concentric casing strings, each of which is positioned within the wellbore 10. In some implementations, each casing string includes a plurality of jointed segments of pipe. The jointed segments of pipe typically have threaded connections although other configurations are possible and may be used.

It can be desirable to seal an annulus formed within the wellbore between the casing string 250 and the reservoir 14. Sealing of the annulus can be desirable for preventing injection fluid from flowing into remote zones of the reservoir, thereby providing greater assurance that the injected fluid is directed to the intended zones of the reservoir. To prevent or at least interfere with injecting fluid into an unintended zone of the reservoir, this annulus can be filled with an isolation material, such as cement, thereby cementing the casing to the reservoir 14. It should be noted that the cement can also provide one or more of the following functions: (a) strengthens and reinforces the structural integrity of the wellbore, (b) prevents, or substantially prevents, produced fluids of one zone from being diluted by water from other zones, (c) mitigates corrosion of the casing 250, and (d) at least contributes to the support of the casing 250.

It is further noted that the casing 250 includes a plurality of casing outlets 255 for allowing fluid flow between the wellbore string 30 and the reservoir (e.g., via injection and production segments of the valve assembly 100). In some implementations, in order to facilitate fluid communication between the wellbore string 30 and the reservoir 14, each of the casing outlets 255 can be substantially aligned with, or at least proximate to, a corresponding one of the injection or production segments of the valve assembly 100. In this respect, in implementations where the wellbore 10 includes the casing 250, injection fluid is injected from the surface down the wellbore string 30 in order to reach the injection segments 120 of the valve assembly 100. Injection fluid then flows through the open injection ports 125 of the corresponding valve assemblies and into an annular space 245 (see FIG. 4) defined between certain portions of the wellbore string 30 and the casing string 250, and finally into the reservoir 14 via the casing outlets 255.

Referring now to FIGS. 5 to 8, in addition to FIGS. 1 to 4, the valve assembly 100 can be provided with a sealing mechanism 150 operable to substantially seal the annular space 245 defined between the valve assembly 100 and the reservoir 14. Moreover, the sealing mechanism 150 can be adapted to set the position of the valve assembly 100 along the wellbore (e.g., within the casing 250). In this implementation, the sealing mechanism 150 includes a sealing element 155, and an actuation assembly 160 operatively connected to the sealing element 155 and adapted to actuate the sealing element 155 from an unsealed configuration to a sealed configuration. In some implementations, the sealing element 155 is actuatable between a run-in configuration (e.g., unsealed configuration) for allowing the valve assembly 100 to be deployed and move along the wellbore, and an operational configuration (e.g., sealed configuration) for sealing the annular space 245 and setting the position of the valve assembly 100 within the wellbore. It is appreciated that setting the position of the valve assembly 100 within the wellbore facilitates injection operations via the injection segment 120 to be performed. It is therefore noted that the actuation assembly 160 can be configured to actuate the sealing element 155 between the run-in and operational configurations.

Figure 3:
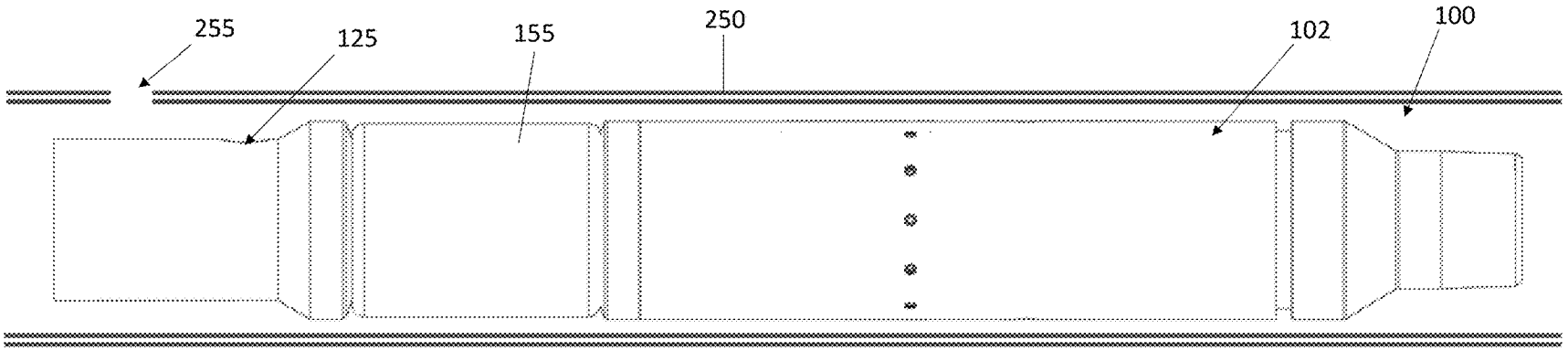
FIGS. 3 and 4 are side views of the valve assembly shown in FIG. 2 provided within a casing string, showing the valve assembly in a run-in configuration (FIG. 3), and in an operational configuration (FIG. 4), according to implementations.
Figure 4:
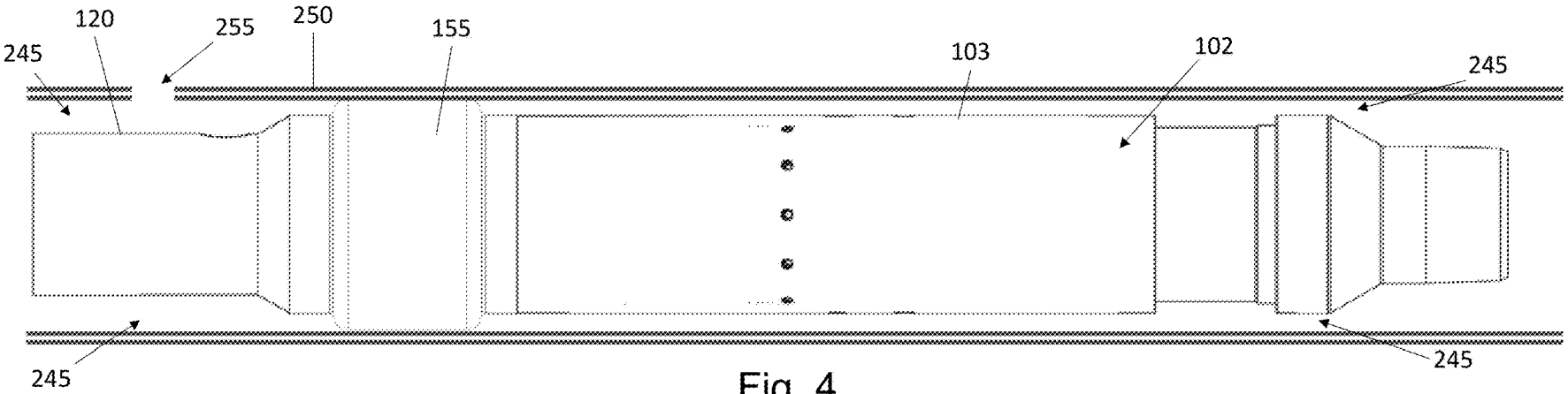

In the illustrated implementation, the sealing element 155 is coupled about the injection segment mandrel 124 in between the coupling element 112 and the protruding portion 123; while the actuation assembly 160 is positioned within the valve housing 102 and is connected to the injection segment 120. As will be described further below, the actuation assembly 160 is generally secured to the injection segment mandrel 124 and is adapted to prevent disengagement of the injection segment 120 from the valve housing 102. With reference to FIGS. 3 and 6, the sealing element 155 is shown in the run-in configuration, according to a possible implementation where the sealing element 155 is spaced away from the casing 250 (see FIG. 3) such that the valve assembly 100 can move along the wellbore. With reference to FIGS. 4 and 7, the sealing element 155 is shown in its operational configuration, according to a possible implementation where the sealing element 155 extends radially to engage the casing 250 (seen in FIG. 4), thereby sealing the annular space 245 and preventing further movement of the valve assembly 100 along the wellbore, thus setting the position thereof.

As described above, the injection segment mandrel 124 has a smaller outer diameter relative to the injection head 122 (e.g., relative to the protruding portion 123) and the valve housing 102. Therefore, when the injection segment mandrel 124 is coupled to the valve housing 102 (e.g., via the coupling element 112), an intermediate section of the injection segment mandrel 124 extends between the protruding portion 123 and the coupling element 112, and defines an inset region 152. More specifically, the inset region 152 is defined by the portion of the injection segment mandrel 124 located between the abutment surface 117 of the coupling element 112 and the abutment surface 127 of the protruding portion 123. In this implementation, and as seen in FIG. 6, the sealing element 155 is coupled about the injection segment mandrel 124 within the inset region 152 such that, in the run-in configuration, the sealing element 155 can be flush or inset relative to the outer diameter of the injection head 122 and/or the valve housing 102.

In the illustrated implementation, the actuation assembly 160 is adapted to displace the housing 102 relative to the injection segment 120, enabling compression of the sealing element 155. It is noted that the displacement of the housing 102 axially compresses the sealing element 155 and thus urges the sealing element 155 toward the casing 250 surrounding the valve assembly 100 in order to create an annular seal between the valve assembly 100 and the wellbore, and to set the position of the valve assembly 100 in the wellbore. More specifically, operation of the actuation assembly 160 displaces the housing 102 uphole relative to the injection segment 120, thereby moving the abutment surface 127 of the protruding portion 123 toward the abutment surface 117 of the coupling element 112 (or vice versa). It is appreciated that the abutment surfaces 117, 127 engage the sealing element 155 positioned therebetween, and that operating the actuation assembly 160 causes the sealing element 155 to be actuated and arranged in the operational configuration (seen in FIGS. 4 and 7). In other words, the sealing element 155 is axially squeezed between the abutment surfaces 117, 127 and extends radially outwardly (i.e., away from the injection segment mandrel 124) in order to engage the surrounding casing and create the annular seal between the valve assembly and the wellbore. However, in alternate implementations, the sealing element 155 can be a swellable sealing element configured to swell (e.g., inflate) via an absorption of fluid, such as during the injection of fluid down the wellbore.

It is therefore appreciated that the sealing element 155 is configured to extend within the annular space 245 and seal a section thereof for defining two separate zones, or intervals, on either side thereof. As described above, the sealing element 155 is adapted to extend outwardly from the rest of the valve assembly to engage the inner surface of the wellbore. It should be understood that, in implementations where the wellbore includes the casing 250, the inner surface of the wellbore corresponds to the inner surface of the casing string 250, and that, in implementations where the wellbore does not include the casing string 250, the sealing element 155 can engage the inner surface of the wellbore that is part of the reservoir itself.

In some implementations, the sealing element 155 can be configured for isolating a section of the wellbore. More specifically, a pair of adjacent valve assemblies 100, each having a sealing element 155 engaging the wellbore, define a generally isolated section therebetween (i.e., between the pair of sealing elements). It should be thus understood that a pair of sealing elements 155 can be adapted to define a corresponding operational zone of the well completion system 20 therebetween for injection-only or production-only operation. For example, a pair of sealing elements 155 installed on either side of an injection segment effectively defines an injection zone of the well therebetween. Similarly, a pair of sealing element 155 installed on either side of a production segment effectively defines a production zone therebetween. It should be noted that the well completion system can define a plurality of subsequent injection zones, followed by a plurality of production zones. Alternatively, the well completion system can define alternating injection and production zones along the wellbore. In such implementations, it should be understood that a sealing element is installed between each injection and production zone. The well completion system can also include further independent sealing elements (e.g., not associated with a valve assembly) provided uphole, downhole or between a pair of valve assemblies.

It should be understood that, as used herein, the expression "injection zone" can refer to a section of the well where injection fluid is injected into the reservoir. Similarly, the expression "production zone" can refer to a section of the well where production fluid is recovered from the reservoir. It is appreciated that more than one sealing element 155 can be installed between adjacent production and/or injection segments, thereby defining "blank" zones in which no injection or production operations are being performed. It is also appreciated that more than one injection or production segment could be installed for a given injection or production zone, respectively. In a well that includes a casing string 250, each zone can include one or more casing outlets 255 for fluid communication with the reservoir.

As seen in FIGS. 6 and 7, the abutment surfaces 117, 127 can be at least partially tapered in order to facilitate outward extension of the sealing element 155 towards the casing, and to facilitate retraction into the flush or inset position (e.g., the run-in configuration). In some implementations, the abutment surfaces 117, 127 are tapered away from one another at any suitable angle, although other configurations are possible. It should be noted that the sealing element 155 is preferably made of resilient material adapted to be deformed under pressure (e.g., when squeezed or compressed). The sealing element 155 can also be composed of a material that is capable of at least partially reverting back to its initial form or configuration upon release of the pressure. In some implementations, the sealing element 155 can include garter springs 157 adapted to minimize the extent of axial extrusion of the sealing element 155 during expansion (e.g., during compression between the abutment surfaces), and also facilitate retraction. For example, the sealing element 155 can be made of oilfield elastomers, hydrogenated nitrile rubber (HNBR), Viton, Aflas, Kalrez or any combination thereof. Similarly, the garter springs 157 can be made of corrosion-resistant material, such as Elgiloy, Inconel or any suitable material, combination or alloy thereof.

It is noted that if the sealing element 155 reverts back to its initial configuration, the sealing element 155 disengages the casing, and enables movement of the valve assembly within the wellbore, e.g., for retrieval and/or repositioning of the valve assembly 100. In some implementations, the valve assembly 100 can be retrieved from downhole once the sealing element 155 disengages the casing 250, such as via a suitable downhole tool, or during retrieval of the tubing string up to surface. The sealing element 155 can be additionally, or alternatively, provided with mechanical structures, such as resilient components (e.g., the garter springs), facilitating reversion of the sealing element to the initial run-in configuration to facilitate retrieval of the valve assembly 100.

With reference to FIG. 9, in addition to FIGS. 5 to 8, the actuation assembly 160 will be described in more detail. In the illustrated implementation, the actuation assembly 160 can be fluid-pressure activatable. In other words, the actuation assembly 160 can be operated to displace the housing 102, or a portion thereof, to actuate the sealing element 155 via fluid pressure, such as via a differential pressure between one or more sections of the valve assembly 100 (e.g., along the injection segment fluid passage 126, along the valve housing fluid passage 106, etc.) and the surrounding reservoir. In this implementation, the actuation assembly 160 can be coupled to the injection segment 120, such as to the injection segment mandrel 124 as shown for example in FIG. 6. The actuation assembly 160 can have a portion thereof adapted to have pressure exerted thereon to displace at least one of the tubing string segments 50*a*, 50*b* and the valve housing 102. It is thus noted that operating the actuation assembly 160 actuates the sealing element 155 for setting the position of the valve assembly 100 within the wellbore. As will be described further below, the actuation assembly 160, in cooperation with other components of the valve assembly, can define one or more pressurizing compartments within the valve housing 102 configured to enable fluid pressure to create the force required to operate and move the components of the valve assembly 100.

Referring back to FIGS. 6 and 7, the first and second tubing string segments 50*a*, 50*b* can each include respective first and a second segment heads 166*a*, 166*b* and first and second segment mandrels 168*a*, 168*b* connected to and extending from the corresponding segment head. As will be further described below, each segment head 166*a*, 166*b* can be adapted to engage the inner surface of the tubular wall 103, and be slidably mounted within the valve housing 102, with each corresponding segment mandrel 168*a*, 168*b* enabling connection of the tubing string segments 50*a*, 50*b* with a separate component, for example. As seen in FIGS. 6 and 7, the first tubing string segment 50*a* is adapted to be positioned within the valve housing 102 for connecting with the injection segment mandrel 124. In some implementations, the injection segment mandrel 124 is connected to the first segment head 166*a* via any suitable method, such as via threaded connectors, via interference fit, via slot-and-key connection and/or via fasteners. It is noted that the first segment head 166*a* can include an inner diameter configured to enable insertion of an end-portion of the injection segment mandrel 124 therein for connecting the injection segment mandrel 124 to the first segment head 166.

It is noted that the tubing string segments 50*a*, 50*b* define a string fluid passage 165 adapted to be fluidly connected with the fluid passageway 126 of the injection segment 120 for allowing fluid flow through the valve assembly 100 and along the wellbore string. The internal diameters of the passageways 165, 126 can be substantially the same to define a generally continuous central passage the length of the valve assembly, as shown for example in FIG. 6. In the illustrated implementation, the first segment head 166*a* is shaped, sized and adapted to be slidably mounted within the valve housing 102 such that axial movement between the tubing string segments 50*a*, 50*b* and the valve housing 102 is permitted along at least a portion thereof. It is noted that the first segment head 166*a* is shaped and sized such that downhole movement of the valve housing 102 is limited by the abutment of the coupling element 112 with the first segment head 166*a* (see FIG. 6). As such, uphole movement of the valve housing 102 is similarly limited due to the presence of the sealing element 155 and the injection segment 120, which is connected to the first tubing string segment 50*a*.

In addition, the first segment head 166*a* can be provided with one or more seals 119 (e.g., O-rings) arranged between the first segment head 166*a* and the valve housing 102 such that fluid flow is prevented therebetween, and thereby promoting fluid pressure against the actuation assembly 160.

In this implementation, the coupling element 112 is part of the actuation assembly 160 and is adapted to have pressure exerted on a surface area of a portion thereof, such as a downhole surface 201*a*, thereby urging the coupling element 112 uphole. Therefore, the tubular wall 103 is correspondingly urged uphole and toward the injection segment 120. It is appreciated that at least a portion of the downhole surface 201*a* of the coupling element 112 is preferably transverse relative to the string fluid passage 165 such that fluid pressure within the string fluid passage can exert pressure thereon to urge the coupling element 112 uphole. For example, the downhole surface 201*a* can include an annular surface area, shown in FIG. 9, and which will be discussed further below in relation to the pressurizing chambers.

It is noted that the injection segment 120 remains axially aligned with the valve housing 102 due to its connection with the first tubing segment 50*a*. More specifically, the first segment head 166*a* is shaped and sized to block rotation of the longitudinal axis thereof such that the tubing string segments 50*a*, 50*b*, the injection segment 120 and the tubular wall 103 remain substantially parallel to one another during operation of the valve assembly 100.

Still referring to FIGS. 5 to 9 and 11, the actuation assembly 160 can include a partition ring 170 (seen in FIGS. 6, 7 and 9) extending inwardly within the central passage 106 of the valve assembly. The partition ring 170 can be fixed with respect to the tubular wall 103 and can form a one-piece structure with the wall 103. The partition ring 170 can be shaped and sized to abut on the first segment head 166*a* when displacing the valve housing 102 uphole, thereby preventing further uphole movement thereof. It should be noted that the partition ring 170 can extend circumferentially within the passage 106 of the tubular wall 103 around one or more arc portions thereof, or along the entire circumference (i.e., 360 degrees) in order to abut on the first segment head 166*a*. In this implementation, the partition ring 170 extends around the entire inner diameter of the tubular wall 103 and defines a central aperture 172 through which the first segment mandrel 168*a* can extend. The partition ring 170 can be configured to have pressure exerted on a downhole surface 201*b* thereof, thereby urging the valve housing 102 uphole to actuate the sealing element 155.

In this implementation, the first segment mandrel 168*a* is slidably mounted within the partition ring 170 such that axial movement of the valve housing is permitted (e.g., the first segment mandrel 168*a* slides through the central aperture 172 during axial displacement of the valve housing 102). In addition, a seal 119 can be arranged between the partition ring 170 and the first segment mandrel 168*a* such that fluid flow between the partition ring 170 and first segment mandrel 168*a* is prevented. The partition ring 170 can include a groove into which the seal 119 is inserted. It is appreciated that the first segment head 166*a* is provided on a first side 171, such as an uphole side, of the partition ring 170, and that the first segment mandrel 168*a* extends through the central aperture 172 and beyond a second side 173, such as a downhole side, of the partition ring 170.

In some implementations, the second tubing segment 50*b* is positioned on the second side 173 of the partition ring 170 and is connected to the first tubing segment 50*a*. As will be described below, the second tubing segment 50*b* is secured to the first tubing segment 50*a* and configured to facilitate uphole movement of the valve housing 102, via the actuation assembly 160, in order to actuate the sealing element 155. In this implementation, the second tubing segment 50*b* includes the second segment head 166*b* slidably mounted within the valve housing 102 (e.g., on the second side 173 of the partition ring 170) such that axial movement of the valve housing 102 relative to the second segment head 166*b* is enabled. Moreover, the second tubing segment 50*b* can be provided with one or more seals 119 (e.g., O-rings) arranged between the second segment head 166*b* and the valve housing 102 such that fluid flow is prevented therebetween, and thereby promoting fluid pressure against the downhole surface 201*b* of the partition ring 170.

As previously mentioned, the partition ring 170 is adapted to abut against the first segment head 166*a* to limit the range of motion of the valve housing 102, which in turn limits the range of motion of the coupling element 112 (e.g., due to its connection to the tubular wall 103). It is further noted that exerting pressure on both the coupling element 112 (e.g., on the downhole surface 201*a*) and the partition ring 170 (e.g., on the downhole surface 201*b*) facilitates uphole movement of the valve housing 102. More specifically, increasing the surface area on which fluid pressure can be applied correspondingly increases the overall force applied on the actuation mechanism 160 and promotes uphole movement of the valve housing 102 to actuate the sealing element 155. In the illustrated implementation, fluid flowing along the valve assembly 100 can exert pressure on the downhole-facing surfaces 201*a*, 201*b* (see FIG. 9), thereby creating a cumulative force to displace the valve housing 102 uphole. It should be noted that the pressure applied to the coupling element 112 can be substantially the same as the pressure applied to the partition ring 170, although it is appreciated that one pressure can be greater than the other, for example. The downhole-facing surfaces of the coupling element 112 and the partition ring 170 can have the same shape and surface area, or they can be different.

In some implementations, the valve assembly 100 comprises fluid compartments 180 defined within the valve housing 102 and being in fluid communication with the fluid passages of the valve assembly (e.g., the injection segment passageway 126, the string fluid passage 165 and/or the valve housing fluid passage 106) and the surrounding reservoir. Fluids can thus flow into, or from, these fluid compartments to create a pressure differential on one or more components positioned within the housing 102. In this implementation, the valve assembly 100 includes one or more pressurizing compartments 182 configured to receive fluid being injected (e.g., pumped) within the well, thereby creating fluid pressure within these compartments 182. At least one component of the actuation assembly 160 communicates with the pressurizing compartment 182 such that the pressure within the compartment exerts a force on the corresponding portion of the actuation assembly 160 to move it downhole and/or uphole, for example. The portion of the actuation assembly 160 that is in contact with the pressurized fluid can be the downhole-facing surfaces 210*a*, 201*b*, which can define an uphole side wall of the compartment 182.

As seen in FIG. 6, the valve assembly 100 can include a first pressurizing compartment 184 in fluid communication with the fluid passageway 126 of the injection segment 120 to receive fluid therefrom. In this implementation, the first segment head 166*a* of the first tubing segment 50*a* defines a downhole wall of the first pressurizing compartment 184, and the downhole surface 201*a* of the coupling element 112 defines an uphole wall thereof, such that fluid pressure within the first pressurizing compartment 184 exerts a force on the coupling element 112 in order to displace the valve housing 102 uphole. In this implementation, the first pressurizing compartment 184 corresponds to an annular gap radially defined between the injection segment mandrel 124 and the tubular wall 103, and axially defined between the coupling element 112 and the first segment head 166*a*. In this implementation, the coupling element 112 has an annular lip 113 extending around an inner diameter thereof and being adapted to space the injection segment mandrel 124 from the inner surface of the coupling element 112. Therefore, and with reference to FIG. 6, the injection segment mandrel 124 can define an annular chamber 184*a* along the coupling element 112 and in fluid communication with the first pressurizing compartment 184. Moreover, the annular lip 113 can define a secondary downhole surface 201*c* against which fluid pressure can push to urge the valve housing 102 uphole.

More particularly, the sealing engagement between the injection segment mandrel 124 and the coupling element 112 prevents fluid within the first pressurizing compartment 184 from flowing in the uphole direction, and the first segment head 166*a* is illustratively coupled between the injection segment mandrel and the tubular wall, thereby creating a seal and preventing fluid within the first pressurizing compartment 184 from flowing in the downhole direction. As illustrated, the injection segment mandrel 124 can be provided with one or more openings 128 (also seen in FIG. 10) for establishing fluid communication between the fluid passageway 126 and the first pressurizing compartment 184, although other configurations are possible for providing fluid communication. Therefore, it is noted that, during operation of the well, for example during injection of fluids, some of the injected fluid can flow into the first pressurizing compartment 184, increasing the pressure therein to push against the coupling element 112 (e.g., against the downhole surfaces 201*a*, 201*c*).

Still referring to FIG. 6, the valve assembly 100 further includes an outlet compartment 186 provided between the first segment head 166*a* and the partition ring 170, and into which the partition ring 170 can move when the valve housing 102 is displaced uphole. The outlet compartment 186 includes one or more outlet openings 187 communicating with the wellbore (e.g., with the annular space between the valve assembly and the casing) in order to enable fluid within the outlet compartment 186 to evacuate therefrom when the partition ring 170 is displaced. With reference to FIG. 7, it is appreciated that moving the valve housing 102 uphole increases the volume of the first pressurizing compartment 184, while decreasing the volume of the outlet compartment 186 by a corresponding amount. It is also noted that the openings 128 of the injection segment mandrel 124 remain in fluid communication with the first pressurizing compartment 184 due to the connection between the first segment head 166*a* and the mandrel 124.

In some implementations, the valve assembly 100 includes a second pressurizing compartment 188 configured to receive fluid to increase the pressure therein and exert a force on the partition ring 170 (e.g., on the downhole surface 201*b* thereof). In this implementation, and with reference to FIGS. 6 and 7, the second pressurizing compartment 188 corresponding to a secondary annular gap defined between the valve housing wall 103 and the first segment mandrel 168*a*, with the partition ring 170 sealing an uphole end thereof, and the second segment head 166*b* sealing a downhole end thereof. Furthermore, the first segment mandrel 168*a* can be provided with one or more openings 169 (also seen in FIG. 11) for establishing fluid communication between the string fluid passage 165 and the second pressurizing compartment 188. Fluid can thus flow into the second pressurizing compartment 188 to increase the pressure therein and exert a force on the partition ring 170. Although the second pressurizing compartment 188 promotes uphole movement of the valve housing 102 by exerting additional force on the valve housing 102 (i.e., on the partition ring), it is appreciated that the actuation assembly 160 can include a single component (e.g., the coupling element 112) communicating with a single pressurizing compartment (e.g., the first pressurizing compartment) for enabling uphole movement of the valve housing 102.

It is appreciated that moving the valve housing 102 uphole increases the volume of the second pressurizing compartment 188. It is also noted that the openings 169 of the first segment mandrel 168*a* remain in fluid communication with the second pressurizing compartment 188 due to the connection between the first segment mandrel 168*a* and the second segment head 166*b*. Moreover, in this implementation, the second segment head 166*b* can be relatively tubular, and provided with an annular projection 177 extending radially outwardly therefrom, and therefore having a greater outer diameter than the other portions of the second segment head 166*b*. More specifically, the annular projection 177 can have an outer diameter which is substantially the same as the tubular wall 103 of the valve housing 102, thereby preventing entry of the annular projection 177 within the valve housing 102 and limiting axial movement of the valve housing 102 in the downhole direction.

In this implementation, the annular projection 177 has an abutment surface adapted to have the downhole end of the tubular housing 103 abut thereon. In this implementation, the second segment mandrel 168*b* corresponds to the downholemost component of the valve assembly 100, and is thereby adapted to be connected to a separate component of the wellbore string. For example, in this implementation, the second segment mandrel 168*b* can be shaped and adapted to receive a conduit therein, or extend into the separate conduit, although it is appreciated that other components can be connected to the second segment mandrel 168*b*, such as another valve assembly 100. The conduit can be connected to the second segment mandrel 168*b* via any suitable method, such as via threaded connectors, via interference fit, via slots and key connection or via fasteners, for example)

In some implementations, the valve housing 102 can be releasably secured to the tubing string segments 50 prior to a fluid pressure threshold being reached for displacing the valve housing 102 uphole. For example, in the present implementation, the tubular wall 103 can be releasably secured to the first segment head 166*a* via one or more shear pins 190. It is appreciated that the shear pins 190 are configured to break once a predetermined force is applied thereto (i.e., to the piston head). As such, the valve assembly 100 can be run downhole without having its position be set along the wellbore as soon as fluid flows into the pressurizing compartments 182, and can thus be positioned in the desired location and subsequently set. In some implementations, the actuation assembly operation pressure, i.e., the pressure required to displace the valve housing 102 uphole to actuate the sealing element 155 can be between about 250 psi and 5000 psi, for example. It is appreciated that shear pins 190 can be additionally, or alternatively, connected to the second segment head 166*b*, or that other mechanisms for releasably connecting the valve housing can be used.

In some implementations, once the tubular wall 103 is released (e.g., once the shear pins break), the valve housing 102 can be moved axially. As described above, fluid can flow into the pressurizing compartments such that fluid pressure along the fluid passage (and within the fluid compartments) is greater than the pressure within the surrounding reservoir, thereby moving the housing uphole. However, if fluid pressure within the reservoir and/or within the outlet compartment becomes greater than the fluid pressure within the fluid passage (e.g., within the pressurizing compartments), the valve housing 102 can revert back to the run-in position, seen in FIG. 6, which can cause the sealing element 155 to disengage from the casing (or surrounding wellbore surfaces) and allow the valve assembly 100 to move along the wellbore once again. In other words, a generally constant fluid flow can be required to maintain the valve housing 102 engaged with the sealing element 155, which also maintains the sealing element 155 engaged with the casing to set the position of the valve assembly 100 along the wellbore.

It is noted that providing a substantially constant fluid flow along the wellbore can imply having a substantially constant flow of fluids being injected into the reservoir through the injection port 125. This configuration can be useful in various operations, such as in waterflooding operations for hydrocarbon recovery, geothermal circulation of a working fluid, solvent injection into a reservoir (e.g. to facilitate dissolution of reservoir minerals in production fluid), subsurface disposal of waste fluids or CO2, in situ mining, CO2 flooding, water alternating gas flooding, polymer flooding, straddle stimulation, acidizing, among other applications. It is further noted that, as described above, ceasing injection of fluid can cause the valve housing 102 to at least partially revert to the run-in position, thereby disengaging the sealing element 155 from the casing. Therefore, it is appreciated that the valve assembly 100 can be retrieved from down the wellbore once the sealing element 155 has disengaged the casing. It should thus be understood that the actuation assembly 160 can be configured to set the position of the valve assembly down the well (e.g., via fluid-pressure activation of the sealing element), and also enable recovery of the valve assembly 100 by allowing the sealing element to disengage the casing and unset the position of the valve assembly 100. It should further be noted that, if the sealing element disengages the casing (e.g., unintentionally or accidentally), the pressure within the wellbore can be increased in order to re-engage the sealing element and continue downhole operations.

Figure 12:
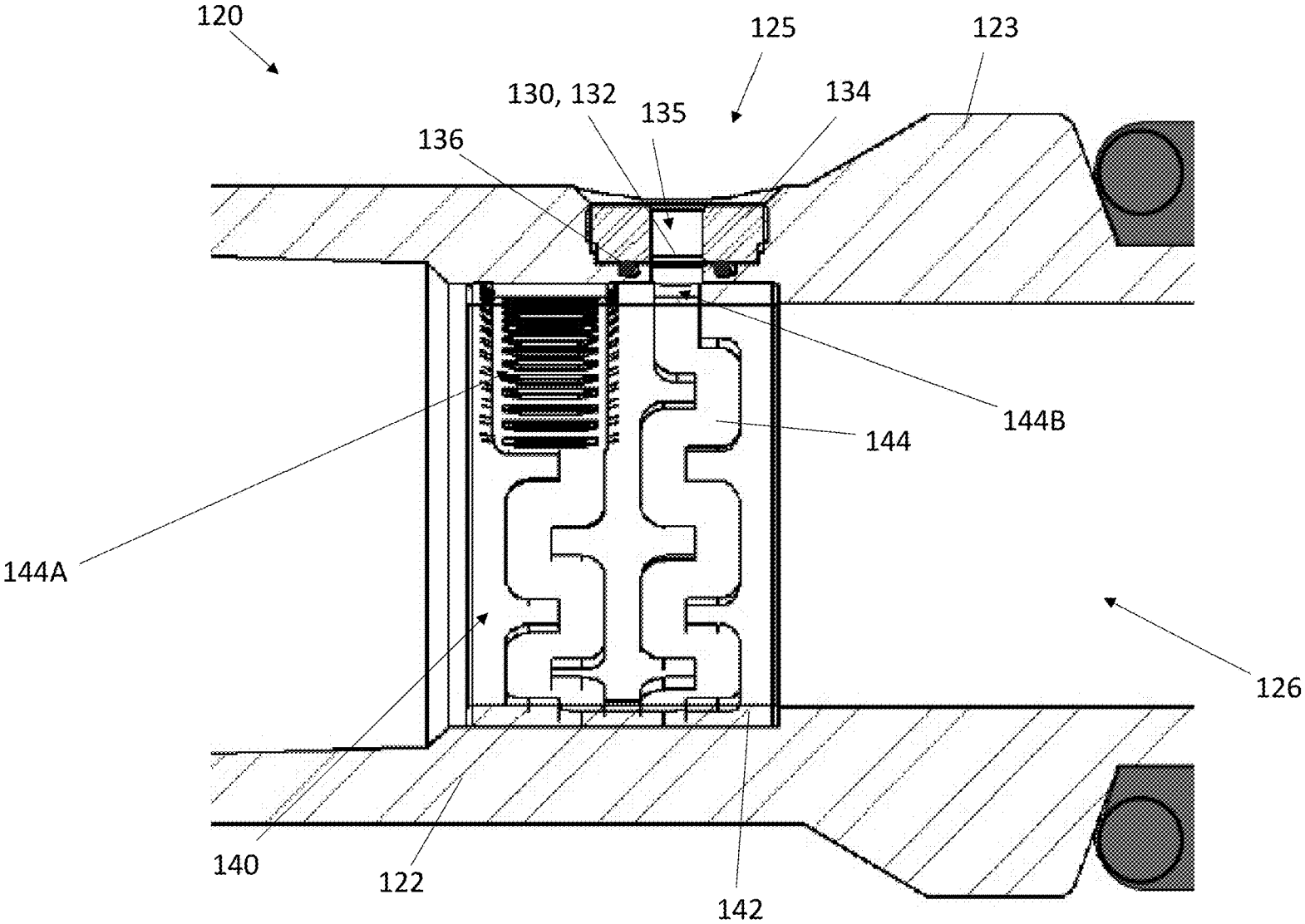
FIG. 12 is an enlarged view of the injection head shown in FIG. 10, showing a flow restriction component, according to an implementation.
Figure 13:
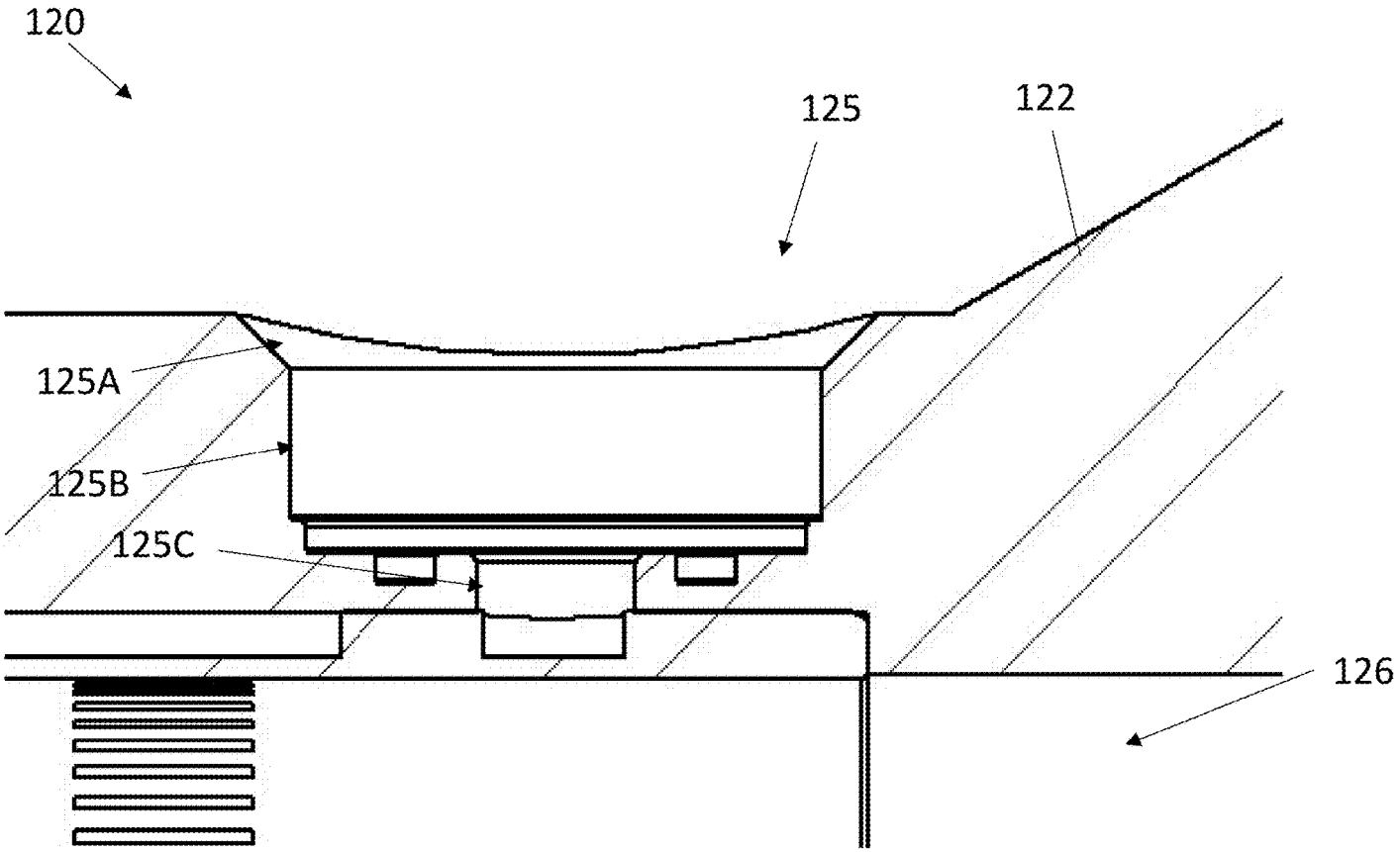
FIG. 13 is an enlarged view of the injection port shown in FIG. 12, showing a tapered geometry of the injection port, according to an implementation.

As seen in FIGS. 12 and 13, the injection segment 120 of the present implementation includes a single injection port 125. Additionally, the injection segment 120 can include a frangible or breakable barrier 130 adapted to occlude the injection port 125, thus preventing fluid communication between the fluid passage 126 and the surrounding reservoir. The breakable barrier 130 can be configured to maintain the injection port 125 occluded when fluid pressure within the fluid passage 126 is below a predetermined pressure threshold, such as below about 5000 psi, below about 3000 psi, or below about 500 psi. The threshold can be defined based on other fluid pressures that may be used in the wellbore, such as the actuation pressure of the piston mechanism (i.e., the pressure required to actuate the sealing element). For example, the predetermined pressure threshold can be higher than the sealing element actuation pressure in order to prevent injection of fluids into the reservoir prior to setting the position of the valve assembly. It should be appreciated that the valve assembly 100 can include more than one breakable barrier 130, therefore reducing the risk of accidentally injecting fluid into the reservoir. The breakable barriers could thus be arranged in series within the injection port 125.

It is also noted that, when the breakable barrier 130 is present, the valve assembly 100 is initially in the closed configuration. Once the predetermined pressure threshold is reached, the breakable barrier 130 is defeated and collapses, bursts, is removed, or otherwise breaks, thus operating the valve in the open configuration. It is appreciated that the breakable barrier 130 can be fully broken or removed from the injection port 125 to provide a fully opened port. However, in some implementations, the breakable barrier 130 can be configured to partially collapse in order to have a portion thereof remain within the injection port 125 to at least partially obstruct fluid flow between the passage 126 and the reservoir. As such, the valve assembly 100 can be toollessly operated from the closed configuration to the open configuration via an increase in the fluid pressure within the valve. It is noted that, once a flow of fluid is initiated along the wellbore, the valve does not require intervention from downhole tools, such as shifting tools deployed on coiled tubing to transition the valve to the open configuration. In other words, the valve is fluid pressure-activated from the closed configuration to the open configuration.

In some implementations, the breakable barrier 130 can include a burst disc 132 shaped and configured to cover or occlude the injection port 125, although other configurations are possible. For example, one or more plugs can be installed within the injection port 125 and retained therein using shear pins or any other similar and suitable device for retaining the plug in place. The breakable barrier 130 can alternatively include dissolvable components, such as a dissolvable plug, dissolvable retaining pins or rings, or a combination thereof. It is appreciated that the dissolvable components define a time-based mechanism and do not require predetermined pressures (e.g., via pump rates) to actuate the valves. Alternatively, the injection port 125 can be occluded using a piston-activated mechanism, such as a piston configured to be fluid-pressure activated (e.g., using differential pressure) to open the injection port 125. It is appreciated that each valve assembly 100 can be provided with the same type and design of breakable barrier 130, or with different types or designs of breakable barriers depending, for example, on the location of the valve along the wellbore. Each injection port 125 and barrier 130 can be identical for each valve provided along the well, or one or more of the ports and/or barrier can be different to provide a different function, such as rupturing at a different fluid pressure, being activated in a different manner, providing a different flow area, and so on.

As seen in FIG. 12, in this implementation, the breakable barrier 130 includes a barrier body 134 configured to be installed within the injection port 125 and receive the burst disc 132. In some implementations, the burst disc 132 and barrier body 134 can be two separate components configured to cooperate within the injection port 125. Alternatively, the burst disc 132 and barrier body 134 can form a single component configured to be inserted and secured within the injection port 125, and where the burst disc 132 forms a bottom surface of the barrier body 134. It is noted that the barrier body 134 includes a central passage 135 to allow fluid flow therethrough when the burst disc 132 has ruptured. The barrier body 134 can be connected to the valve (i.e., to the housing 102) within the injection port 125 via fasteners, or via any other suitable connection method (e.g., interference fit, cement, threaded connection, etc.).

The breakable barrier 130 can be provided with one or more seals 136 configured to prevent fluid from flowing through the injection port 120 when operating the valve in the closed configuration. In this implementation, the seal 136 can include an O-ring configured to be installed within the injection port 125. However, it is appreciated that other types of seals are possible and may be used, such as welding the barrier 130 within the port, installing the barrier 130 via compression fit, using shim stocks or any other suitable seal or sealing method. It is noted that interstices may be present between the burst disc 132, barrier body 134 and/or an inner surface of the injection port 125. In this implementation, the seal 136 (e.g., the O-ring) is provided on an inner side of the burst disc 132 (i.e., on the side of the fluid passage 126), although it is appreciated that seals can alternatively, or additionally, be provided on an outer side of the barrier 130.

In addition, still referring to FIGS. 12 and 13, the injection port 125 can have a distal portion 125A with tapered edges and being generally frusto-conical; a central portion 125B defined by cylindrical side walls and having a bottom seat that can receive the seal or a bottom part of the breakable barrier, for example; and a proximal portion 125C that is narrower than the central portion and is defined within the housing of the valve assembly. The distal portion 125A can be wider than the central portion 125B which can facilitate insertion of the breakable barrier 130. The proximal portion 125C can have a diameter than is generally the same as the diameter of the central passage 135 of the barrier body 134, for example. The proximal portion 125C is also configured to provide fluid communication with the flow restriction component of the valve. Thus, in some implementations, the port 125 has a configuration where the distal, central and proximal portions are aligned along a same central axis that extends radially through the wall of the valve housing. It is also noted that the port 125 can have various other shapes and configurations.

In addition, the injection segment 120 can further comprise a flow restriction component 140 provided in between the port 125 and the fluid passage 126 to restrict the flowrate from the passage 126 through the port 125 when the valve is in the open configuration. The flow restriction component 140 can take various forms. For example, the injection segment 120 can include a valve sleeve 142 with a restricted passage configured to control the flowrate of injection fluid being injected into the surrounding reservoir. In this implementation, the valve sleeve 142 is provided with a fluid channel 144 allowing fluid flow therethrough, and thus fluidly connecting the fluid passage 126 and the injection port 125. The fluid channel 144 can be shaped and configured to provide a resistance to fluid flow, therefore providing additional control on the flowrate of fluid being injected into the surrounding reservoir. For example, the fluid channel 144 can be elongated and configured such that the open configuration of the valve 100 corresponds to a choked configuration, where the fluid flowrate from the fluid passage 126 into the reservoir is restricted. The fluid channel 144 can take the form of a tortuous path that winds boustrophedonically across a portion of the valve sleeve 142. The tortuous path can have various other configurations.

Furthermore, in this implementation, the fluid channel 144 can be defined between an outer surface of the valve sleeve 142 and an inner surface of the injection segment 120 overlaying the valve sleeve 142. It should also be noted that, in this implementation, the valve sleeve 142 is securely connected within the injection segment 120 (e.g., via press-fitting) such that the fluid channel 144 remains aligned with the injection port 125 before, during and after injection fluid has effectively been injected into the reservoir. However, it is appreciated that other configurations are possible and may be used, such as slidably connecting the valve sleeve 142 within the injection segment 120 such that the valve sleeve can be shifted between two or more positions for selectively aligning the fluid channel 144 with the injection port 125 (e.g., the proximal portion 125C).

In the present implementation, referring to FIGS. 12 and 13, the fluid channel 144 includes a channel inlet section 144A defined in the inner surface of the valve sleeve 142, and a channel outlet section 144B defined in the outer surface of the valve sleeve 142. The channel outlet section 144B being in fluid communication with the injection port 125 to enable fluid flow from the fluid passage 126, through the channel 144, and to the injection port 125. The channel outlet section 144B can have a channel width that is generally the same as or smaller than the diameter of the proximal portion 125C of the port 125. The port 125 can thus be designed to extend radially through the valve housing, while the flow restriction component takes the form of an elongated channel that extends circumferentially around an inner part of the valve via the sleeve, thereby providing fluid communication between the external environment and the fluid passage 126 of the valve.

In some implementations, the port 125 and the breakable barrier 130 can also be configured to provide little to no flow restriction to injection fluids, while the flow restriction component (e.g., elongated fluid channel having a tortuous path) provides flow restriction through that valve. This arrangement can facilitate fluid pressure activation of the valves at reasonable flowrates in a well completion system with multiple valve assemblies 100 arranged along its length. Once a first breakable barrier is ruptured due to fluid pressures, the port 125 can allow full flow of the injection fluid into the reservoir at that open valve which could hamper fluid activation of the other valve assemblies. However, the flow restriction component controls the fluid injection rate through the open valve assembly and thereby enables the fluid pressure to be maintained at sufficient levels to rupture the breakable barriers of the other valve assemblies at reasonable flowrates. The flow resistance therefore prevents over-injection of the fluid via the early activated valve assemblies and enables pressure to be maintained along the wellbore. The flow restriction component can thus be designed to provide the desired flow restriction during the initial valve opening phase of the process to enable flowrates to be kept within a certain range.

In addition, since the flow restriction component can cause a pressure drop, e.g., across the length of the tortuous path, this pressure drop can be taken into account when designing the system and when providing the fluid pressure, e.g., using pumps at surface. For example, the fluid channel 144 can be designed and tested in order to determine the flowrate restriction and the pressure drop across the channel at different potential conditions such as fluid types, flow rates, temperatures, pump types, pressure drops in upstream conduits, and the like. Thus, the adequate fluid pressure and flow rates can be delivered in order set the position of the valve assembly (e.g., via actuation of the sealing element) and/or break the barrier 130 of each of the desired injection valves. It should be noted that providing the adequate fluid pressure can be further based on various characteristics of the reservoir, such as the reservoir pressure and the reservoir permeability. For example, the lower the reservoir pressure, the higher the flowrate will be through the injection ports for the same restriction.

In addition, it is possible to provide a well completion system where some valve assemblies are different from others in terms of the flow restriction and pressure at which the barrier breaks. For instance, one or more valves near the toe of the wellbore may have a lower breakage pressure compared to one or more valves as the heel, to account for pressure drop effects along the wellbore. This could be done by providing different burst discs for different valves. In another example, one or more valves near the toe could have flow restriction components that provide lower flow restriction (e.g., via shorter or less tortuous paths) compared to those closer to the heel. It is also possible to provide valves with particular flow restriction and fluid breakage pressures at particular locations along the wellbore as per the well operator's specifications to account for certain geological or well characteristics (e.g., thief zone, water-bearing zone, natural fracture(s)).

In some implementations, different burst discs 132 and/or different types of breakable barriers 130 can be installed for each injection segment 120. For example, valves installed further downhole (e.g., closer to the toe of the wellbore) can be provided with burst discs configured to break at lower pressures than burst discs of valves installed proximate the heel of the wellbore. As such, surface injection pressures can be maintained at reasonable levels, since the pressure required to open the valves proximate the toe of the wellbore is not required to be the same as the pressure required to open the valves proximate the heel.

In addition, the flow restriction component can have a different configuration for each or some of the valve assemblies along the wellbore. For example, the valves proximate the heel can be provided with a flow restriction component configured to cause a predetermined pressure drop, whereas the valves further downhole can have flow restriction components configured to cause a lower pressure drop (e.g., with a shorter channel or a larger orifice), and where the valves furthest downhole can be provided with an even lower pressure drop or possibly a straight opening extending between the wellbore passage and the reservoir. It is also appreciated that a nozzle, such as a carbide nozzle, can be installed within one or more of the injection ports 125 to create a pressure drop, which may be in addition to or as an alternative to the flow restriction component. Moreover, it is noted that a single valve can be provided with two or more injection ports 125 with respective breakable barriers 130, therefore increasing the injection rate into the reservoir of that valve. In a multi-port injection valve, there may be a distinct flow restriction component for each port or a flow restriction component that feeds into multiple ports.

Figure 14:
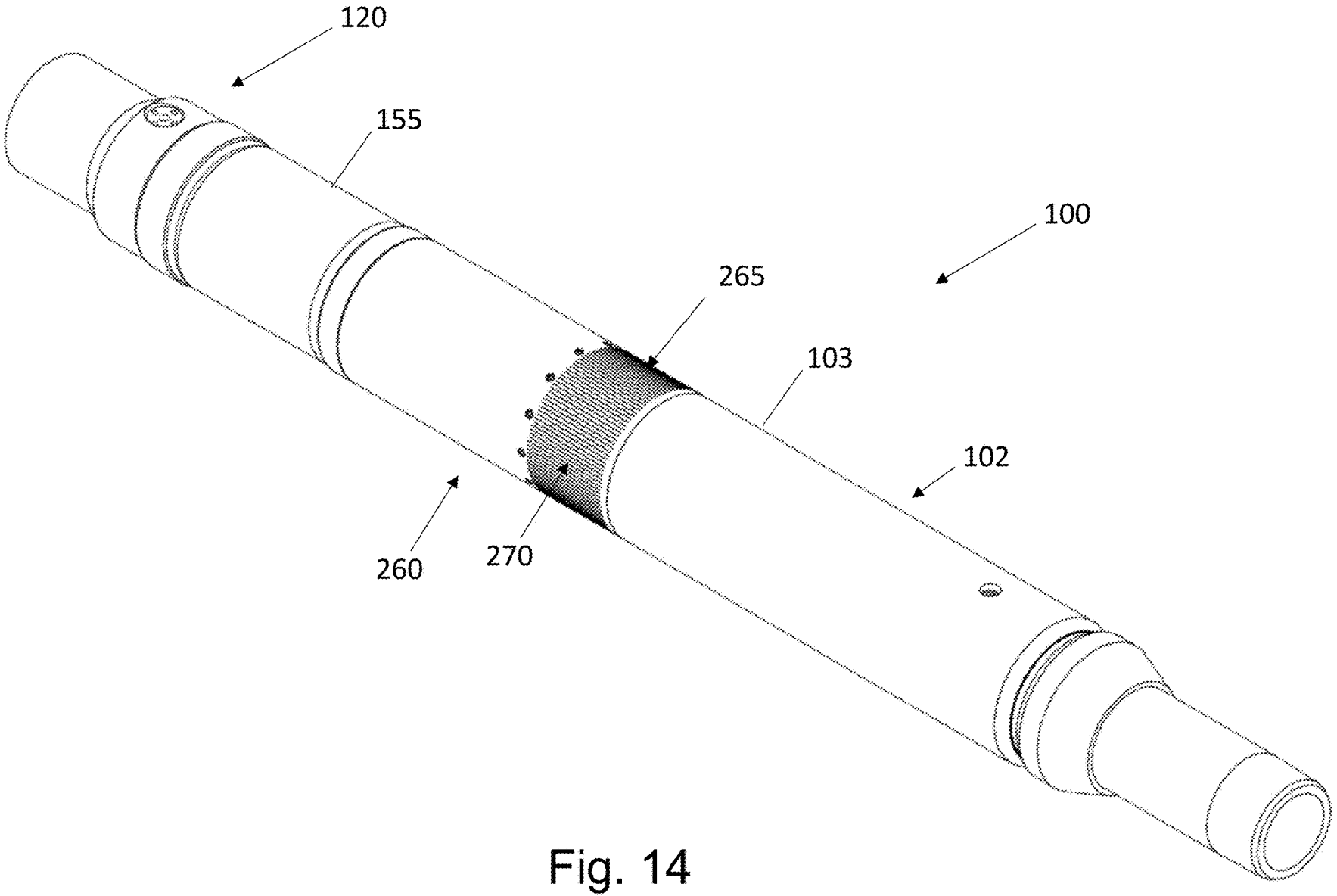
FIG. 14 is a perspective view of another implementation of the valve assembly comprising a production segment, according to an implementation.
Figure 15:
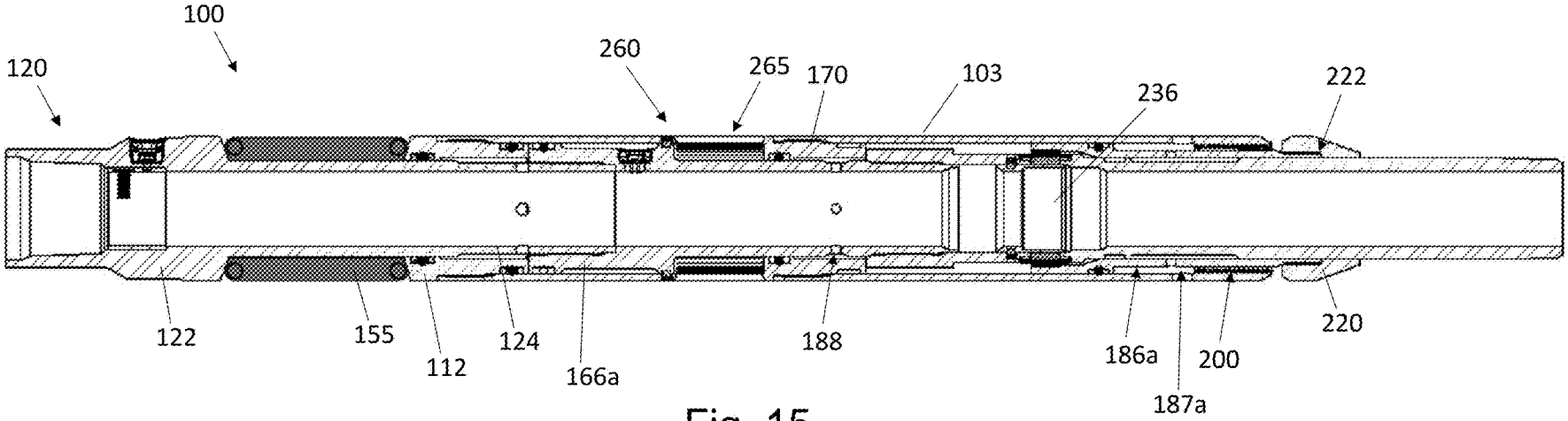
FIG. 15 is a transverse cut view of the valve assembly shown in FIG. 14, showing a locking assembly and a release mechanism, according to an implementation.
Figure 16:
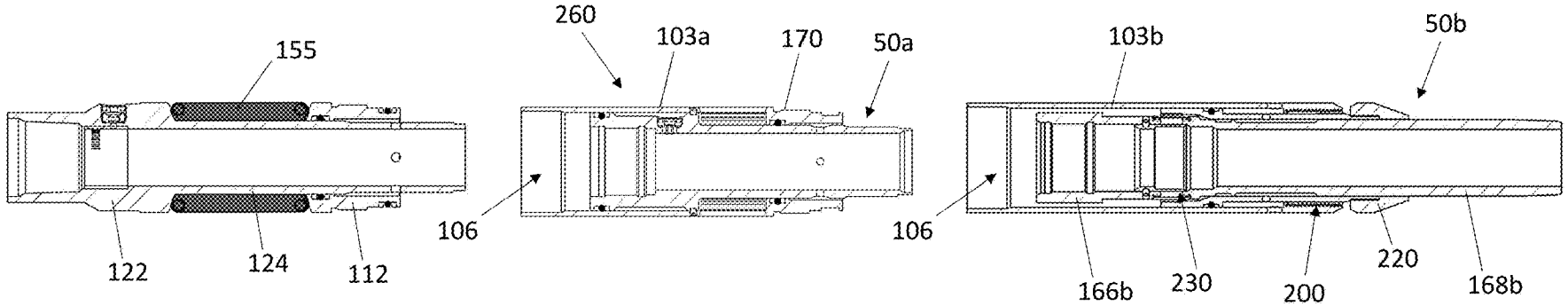
FIG. 16 is an exploded view of the valve assembly shown in FIG. 15, showing multiple tubular components of the valve assembly connectable to one another, according to an implementation.

Now referring to FIGS. 14 to 16, another implementation of the valve assembly 100 is illustrated. Similar to the previously described implementations, the valve assembly 100 includes the injection segment 120 for injecting fluid into the reservoir, the sealing element 155 coupled to the injection segment mandrel 124 between the injection head 122 and the coupling element 112, and the actuation assembly 160 operable via fluid flow to actuate the sealing element 155. In this implementation, the valve assembly 100 further includes a locking assembly 200 configured to maintain the piston mechanism 162 in the operational configuration, thereby maintaining the sealing element 155 engaged with the casing, and the valve assembly 100 stationary within the well. In some implementations, the locking assembly 200 can be adapted to prevent downhole movement of the valve housing 102, such as after having been pushed uphole (i.e., after having moved uphole and actuated the sealing element). Therefore, fluid injection can be interrupted, or completely stopped, without disengaging the sealing element from the casing or wellbore surface. It should thus be understood that the locking assembly 200 can enable production operations, among others, using the valve assembly 100, as will be described further below.

Figure 17A:
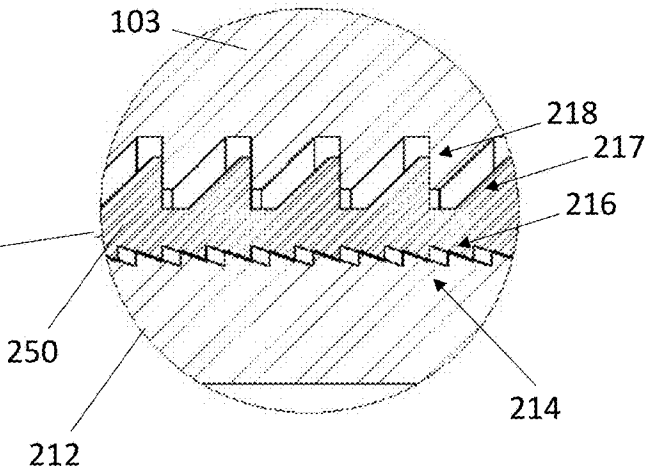
FIG. 17A is an enlarged view of the ratcheting system shown in FIG. 17, showing sets of angled teeth configured to enable relative movement between components in a desired direction, according to an implementation.
Figure 17:
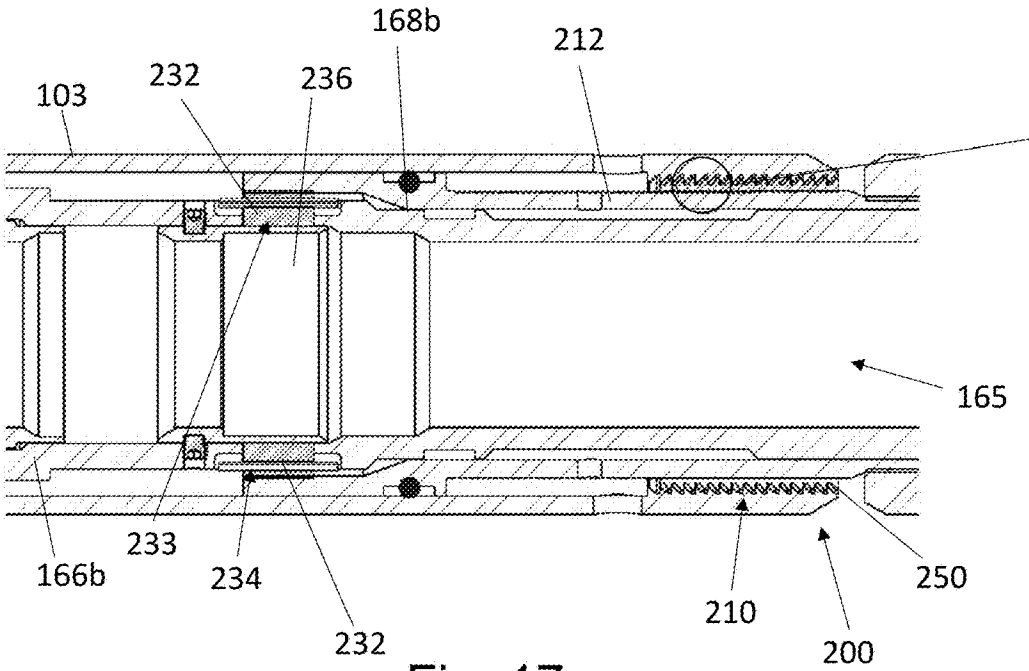
FIG. 17 is an enlarged view of the locking assembly and release mechanism shown in FIGS. 15 and 16, showing a ratcheting system, according to an implementation.

With reference to FIGS. 17 and 17A, in addition to FIGS. 14 to 16, the locking assembly 200 can include a ratcheting system 210 adapted to enable uphole movement of the valve housing 102 while preventing downhole movement thereof. More specifically, the ratcheting system 210 can include interlocking components configured to enable the valve housing 102 to move uphole and be ratcheted into the operational configuration to actuate the sealing element. In this implementation, the ratcheting system 210 includes a ratcheting mandrel 212 coupled to the second segment mandrel 168*b*. The ratcheting mandrel 212 is adapted to cooperate with the tubular wall 103 of the valve housing to allow the valve housing 102 to be ratcheted and locked to the operational position. As seen in FIG. 17A, the ratcheting mandrel 212 includes a first set of angled teeth 214 along an outer surface thereof adapted to cooperate with a second set of angled teeth 216 coupled to the tubular wall 103. It is noted that the shape and angle of each one of the first and second set of angled teeth 214, 216 enable uphole movement of the valve housing 102 relative to the ratcheting mandrel 212, while preventing downhole movement.

In this implementation, the ratcheting mandrel 212 is slidably mounted within the valve housing 102 and coupled to the second segment mandrel 168*b* in a manner such that uphole movement of one of the valve housing 102 is enabled as the ratcheting mandrel 212 engages the tubular wall 103. In other words, the valve housing 102 (e.g., the tubular wall 103, the coupling element 112 and the partition ring 170) can be moved uphole using fluid pressure to actuate the sealing element, while the ratcheting mandrel 212 prevents downhole movement of the valve housing 102, for example, when the fluid pressure within the valve assembly is reduced and/or during production operations. As seen in FIGS. 15 and 16, the second segment mandrel 168*b* can be provided with a retaining member 220 having a slot 222 shaped and sized to receive the downhole end of the ratcheting mandrel 212. Therefore, it is appreciated that downhole movement of the ratcheting mandrel 212 relative to the second segment mandrel 168*b* is prevented. Instead, attempts to displace the ratcheting mandrel 212 downhole engages the slot 222 and pushes against the retaining member 220, and thus further prevents movement in the downhole direction. Additionally, the outer diameter of the retaining member 220 is such that the tubular wall 103 is adapted to abut thereon if displaced in the downhole direction (e.g., upon failure of the ratcheting system 210).

Figure 18:
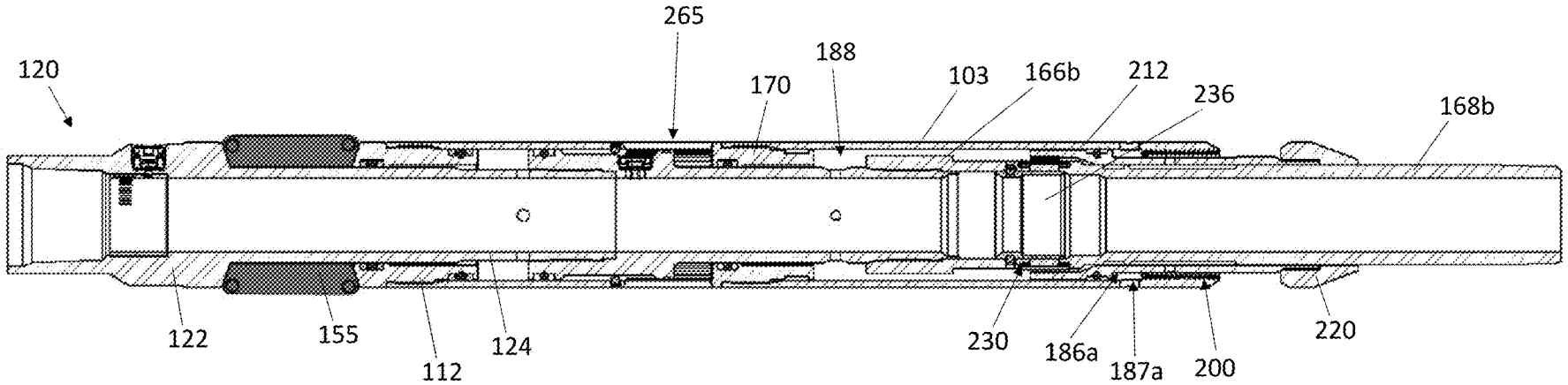
FIG. 18 is a transverse cut view of the valve assembly shown in FIG. 14, showing the actuation assembly engaging the sealing element for operation thereof in the operational configuration, according to an implementation.
Figure 19:
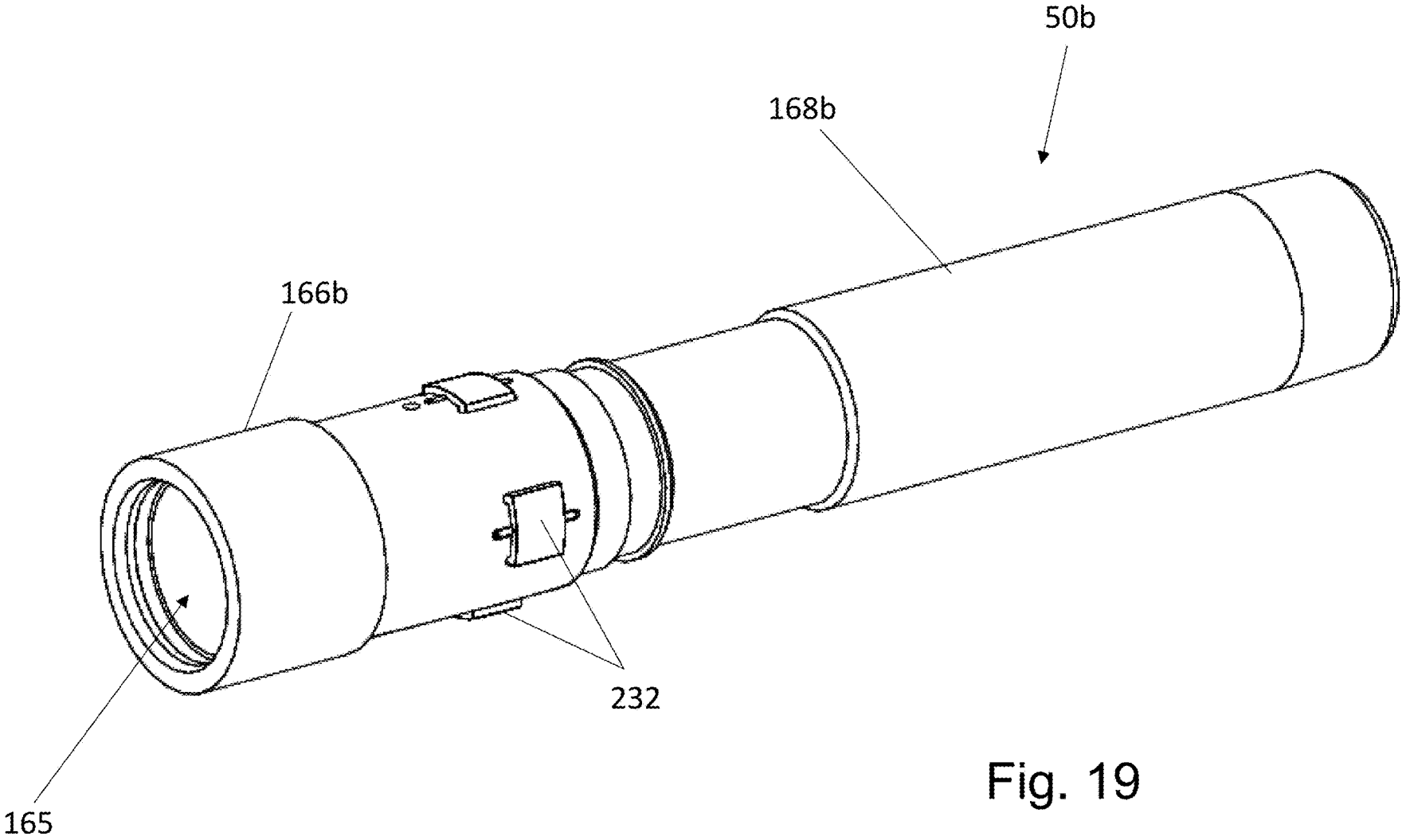
FIG. 19 is a perspective view of a fluid conduit provided with release members extending in a thickness thereof, according to an implementation.

In some implementations, the uphole end of the ratcheting mandrel 212 can be coupled between the second segment mandrel 168*b* and the tubular wall 103, such as via compression fit. Therefore, it is noted that the outer surface of the ratcheting mandrel 212 engages the inner surface of the tubular wall 103, and that the inner surface of the ratcheting mandrel 212 engages the second segment mandrel 168*b*. The uphole end of the ratcheting mandrel 212 is therefore in sealing engagement with the tubular wall 103 and the second segment mandrel 168*b* such that fluid flow between these components is prevented. As seen in FIGS. 15 and 18, when moving from the run-in configuration (FIG. 15) to the operational configuration (FIG. 18), the second segment head 166*b* and the ratcheting mandrel 212 communicate with the second pressurizing compartment 188 such that fluid pressure can build up and exert an uphole force on the partition ring 170 during injection operations. The valve housing 102 is thus ratcheted, via the first and second set of angled teeth 214, 216, and locked in the operational configuration. In this implementation, the valve assembly 100 further includes a second outlet compartment 186*a* provided with one or more outlet openings 187*a* communicating with the surrounding reservoir in order to enable fluid within the second outlet compartment 186*a* to evacuate therefrom and allow uphole displacement of the valve housing 102 (e.g., relative to the ratcheting mandrel 212).

Figure 20:
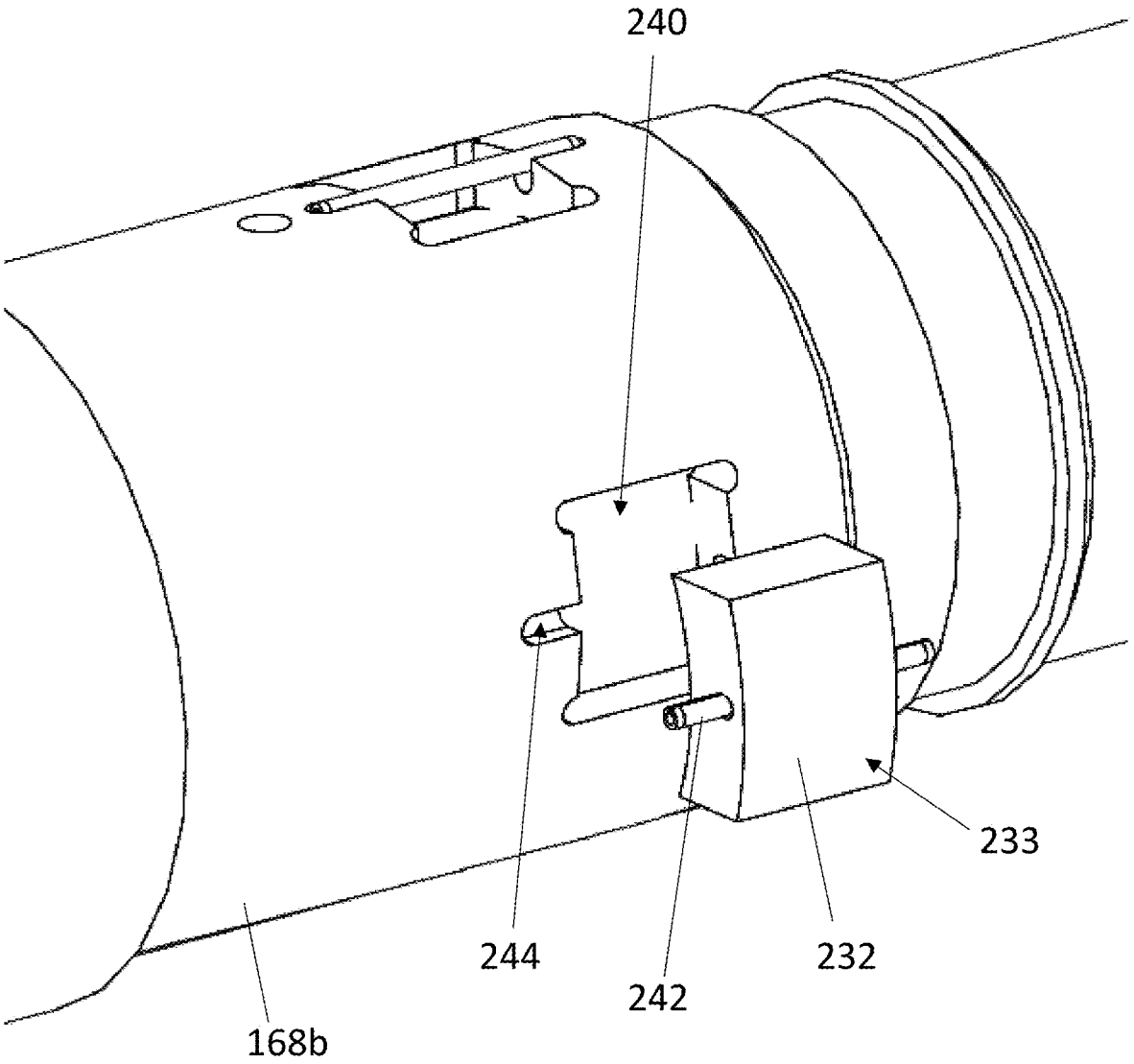
FIG. 20 is a perspective view of the fluid conduit shown in FIG. 19, showing a release member spaced from a corresponding slot defined in the fluid conduit, according to an implementation.

Still referring to FIGS. 15 to 20, the locking assembly 200 can be provided with a release mechanism 230 operable to enable downhole movement of the valve housing 102 in order to disengage the sealing element 155 and allow for the valve assembly 100 to be retrieved. In some implementations, the release mechanism 230 is configured to disengage the ratcheting components (e.g., the sets of angled teeth) from one another, thereby allowing downhole movement of the valve housing 102. In this implementation, the release mechanism 230 includes one or more pegs 232 provided about the second piston mandrel 175 and adapted to extend through a thickness thereof. As seen in FIGS. 17 to 20, the pegs 232 include a first end 233 communicating with the string fluid passage 165 of the piston mechanism, and a second end 234 adapted to engage the ratcheting mandrel 212. In some implementations, the pegs 232 can have any suitable shape and size, such as cylindrical, cubic and/or elongated, for example, and the release mechanism 230 can include any suitable number of pegs. In this implementation, and as seen in FIG. 20, the pegs 232 are shaped as curved blocks adapted to generally follow a curvature of the second segment mandrel 168*b*, and are adapted to extend through complementarily shaped peg slots 240 defined in the second segment mandrel 168*b*, although other configurations are possible.

Referring to FIGS. 17 to 20, the release mechanism 230 further includes a release sleeve 236 configured to cooperate with the one or more pegs 232 and exert an outwardly oriented radial force on the pegs 232. In this implementation, the release sleeve 236 is mounted within the string fluid passage 165 and engages the first end 233 of the one or more pegs 232 and urges the one or more pegs 232 radially outwardly. It should thus be understood that the one or more pegs, under compression from the release sleeve 236, are adapted to push against the ratcheting mandrel 212 and maintain the ratcheting mandrel 212 in sealing engagement with the tubular wall 103 of the valve housing. In this implementation, the release sleeve 236 is slidably mounted along the string fluid passage 165 and is displaceable to uncover and disengage the one or more pegs 232. The pegs 232 are in turn adapted to disengage the ratcheting mandrel 212 and no longer exert pressure thereon. As such, the ratcheting mandrel 212 can be displaced in a manner where the cooperating set of angled teeth 214, 216 can be spaced and disengaged from one another, thereby releasing the ratcheting mandrel 212 from the tubular wall 103, and allowing downhole movement of valve housing 102.

In some implementations, the pegs 232 can be disengaged, via movement of the release sleeve 236, and allowed to move (e.g., "fall") into the string fluid passage 165 and flow along the wellbore. Alternatively, a portion of the pegs 232 can abut against a portion of the second segment mandrel 168*b* when disengaged from the ratcheting mandrel 212, thereby releasing the ratcheting mandrel 212 and maintaining the pegs 232 in position around the second segment mandrel 168*b*. As seen in FIG. 20, in this implementation, each peg 232 is provided with a transversal rod 242 extending therethrough and configured to block the peg 232 from moving into the second piston mandrel 175. More specifically, the peg slot 240 can be provided with laterally extending grooves 244 adapted to receive the rod 242 when the release sleeve is moved and the peg 232 is allowed to fall radially inwardly. It is appreciated that other means, methods and/or devices are possible and may be used to prevent the pegs 232 from falling into the string fluid passage. It is further appreciated that maintaining the pegs in position about the second segment mandrel 168*b* enables the pegs to be retrieved along with the valve assembly 100.

Figure 23:
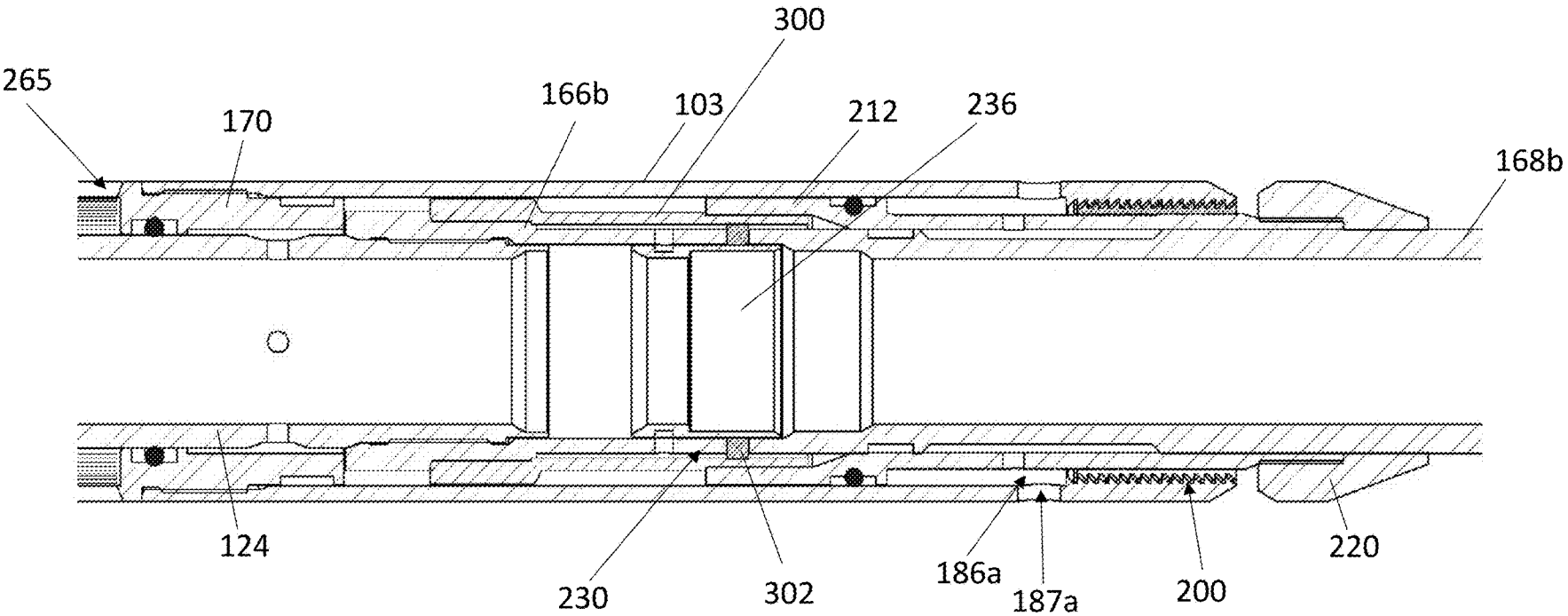
FIG. 23 is a transverse cut view of a valve assembly, showing the release mechanism comprising a release sleeve slidable along the fluid conduits, according to an implementation.

Referring to FIG. 23, in another implementation, the release mechanism 230 can include a collet 300 that engages both the ratcheting mandrel 212 and pressure pegs 302. When the release sleeve 236 is shifted uphole, the pressure pegs 302 no longer push against the collet 300 which disengages from the ratcheting mandrel 212 and allows downhole movement of the valve housing 102. The downhole movement of the valve housing 102, in turn, releases the sealing element 155. The collet 300 can have a threaded engagement with the ratcheting mandrel 212 in the engaged position which is held in place by the pressure pegs 302, and once the pressure pegs 302 are released, the collet 300 and the ratcheting mandrel 212 become loose with respect to each other so that the ratcheting mandrel 212 and the rest of the valve housing 102 can move downhole. This collet implementation has similarities with the implementation shown in FIG. 18, for instance in that there is still a part that may drop out of the way for the collet to deflect. This collet implementation has an advantage that the pressure pegs (e.g., pins or dogs) that drop out of the way are loaded more or less entirely radially from the reaction between the collet 300 and release sleeve 236, which can reduce radial space requirements and increase axial load capability of the lower mandrel.

Figures 24A, 24B, 24C:
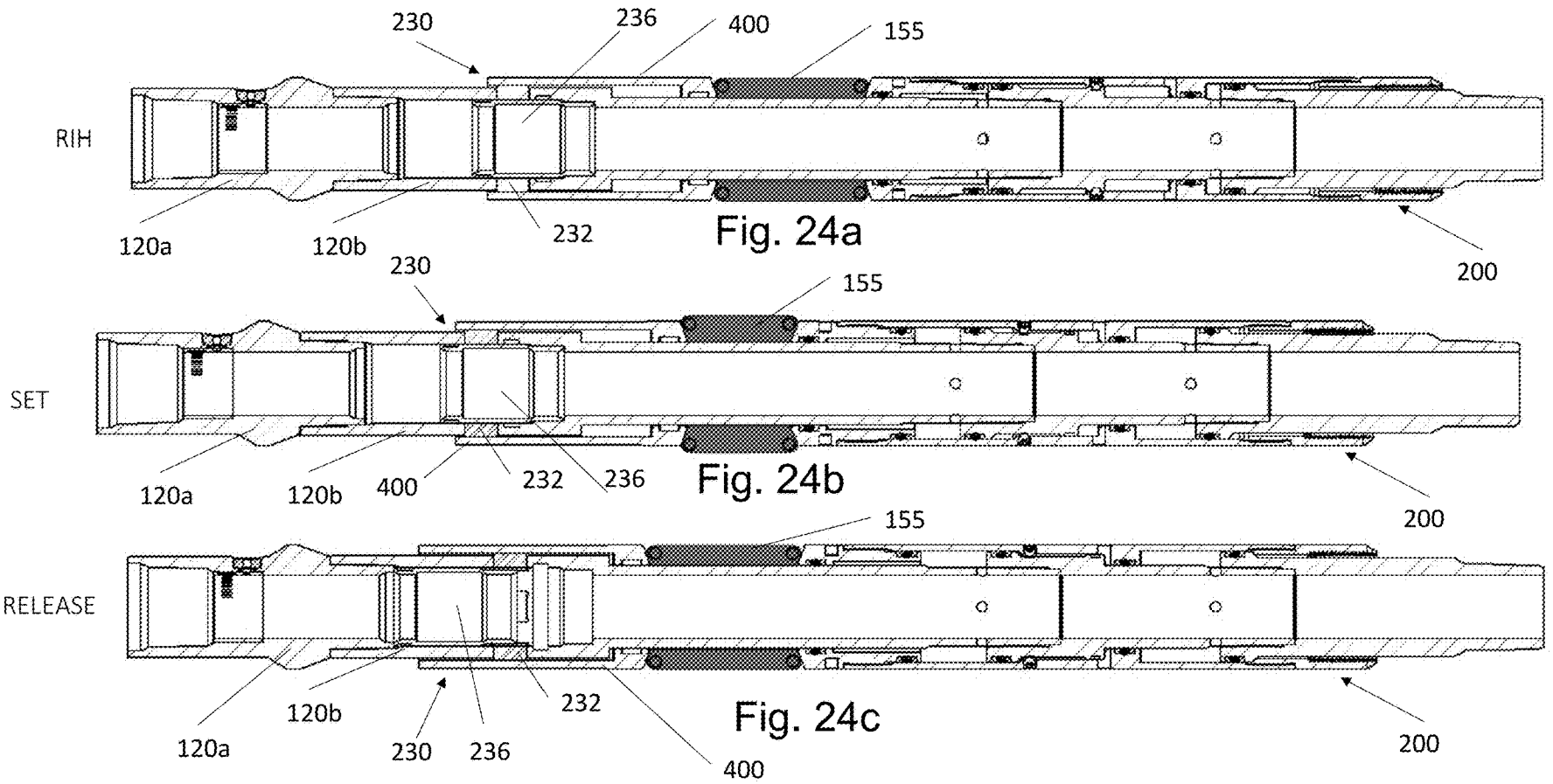
FIGS. 24*a* to 24*c* are transverse cut views of another implementation of a valve assembly, showing the valve assembly in a run-in configuration (FIG. 24*a*), a set configuration (FIG. 24*b*) and a released configuration (FIG. 24*c*), according to implementations.

Referring now to FIGS. 24*a* to 24*c*, in another implementation, the release mechanism 230 can be separate from and on the other side of the sealing element 155 compared to the locking assembly 200. The locking assembly 200 can thus remain engaged and it is the release mechanism 230 located on the upper side of the sealing element 155 that enables movement required to decompress the sealing element 155. The release mechanism 230 includes a release sleeve 236 and pegs 232 (e.g., dogs) that hold an upper gauge ring 400 in place. When the release sleeve 236 is shifted upward, the pegs 232 disengage and release the gauge ring 400 which moves uphole, which in turn allows the sealing element 155 to relax. This implementation facilitates decoupling of the release mechanism 230 from the locking assembly 200. In addition, the injection segment 120 can include sub-components 120*a*, 120*b* that are coupled together. The release sleeve 236 and the other components of this release mechanism 230 can be operatively connected to the second sub-component 120*b* as illustrated, for example. FIG. 24*a* shows the valve assembly 100 in a run-in configuration, FIG. 24*b* in a set configuration, and FIG. 24*c* in a released configuration.

In addition, the implementations of the release mechanism 230 shown in FIGS. 18 and 23, for example, can include a bypass flow path that enables fluid to be released once the release sleeve 236 is shifted. For example, referring to FIG. 18, once the release sleeve 236 shifts uphole and the pegs disengage from the ratcheting mandrel 212, the seal between the second segment head 166*b* and the ratcheting mandrel 212 can be unsealed to allow fluid to flow from the second pressurizing compartment 188, between the second segment head 166*b* and the ratcheting mandrel 212 and then out of a port into the wellbore. This bypass flow path enables depressurizing of the compartment 188 if flow out through the openings 169 is not possible or compromised. Appropriate ports and construction of the components can be provided to allow the bypass flow path to be formed after shifting the release sleeve 236 to initiate the release mechanism 230.

Figure 25A:
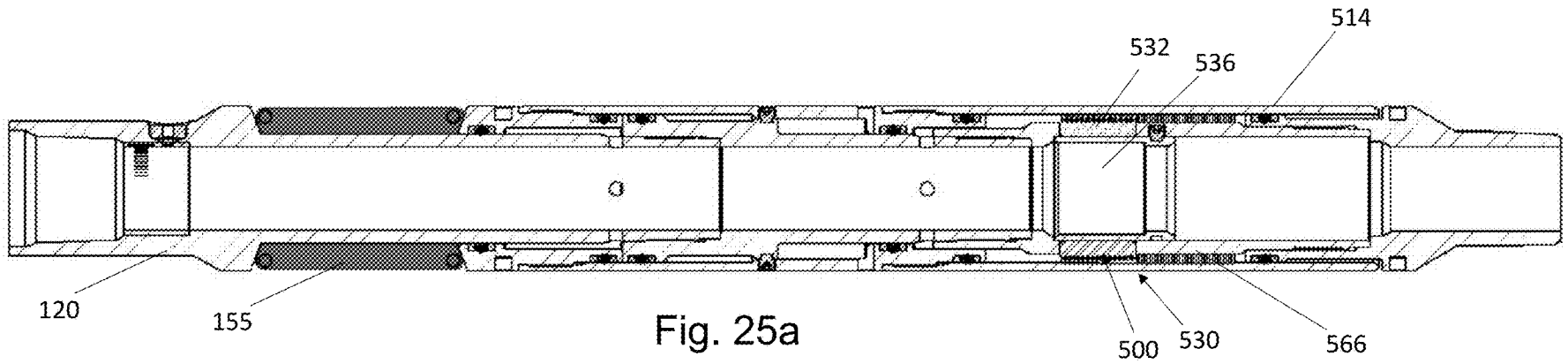
FIGS. 25*a* and 25*b* are transverse cut views of another implementation of a locking assembly and release mechanism, showing a lock ring provided about release members extending through a fluid conduit, according to an implementation.
Figure 25B:
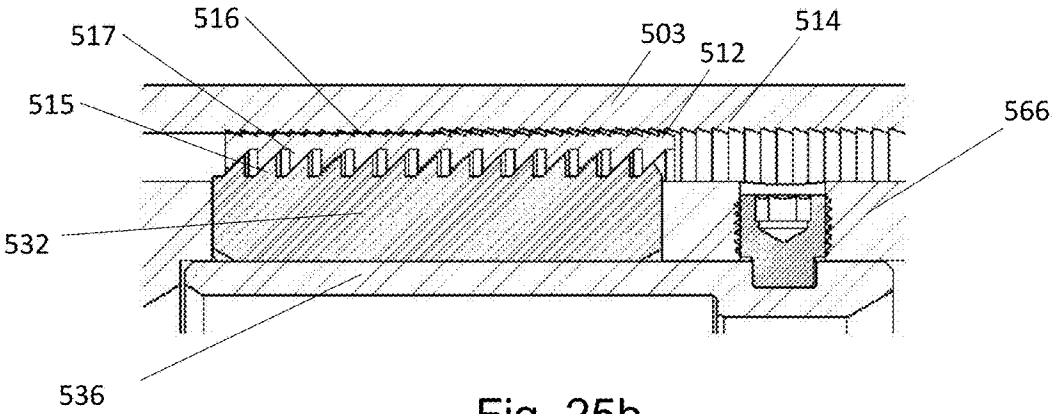
Figure 25C:
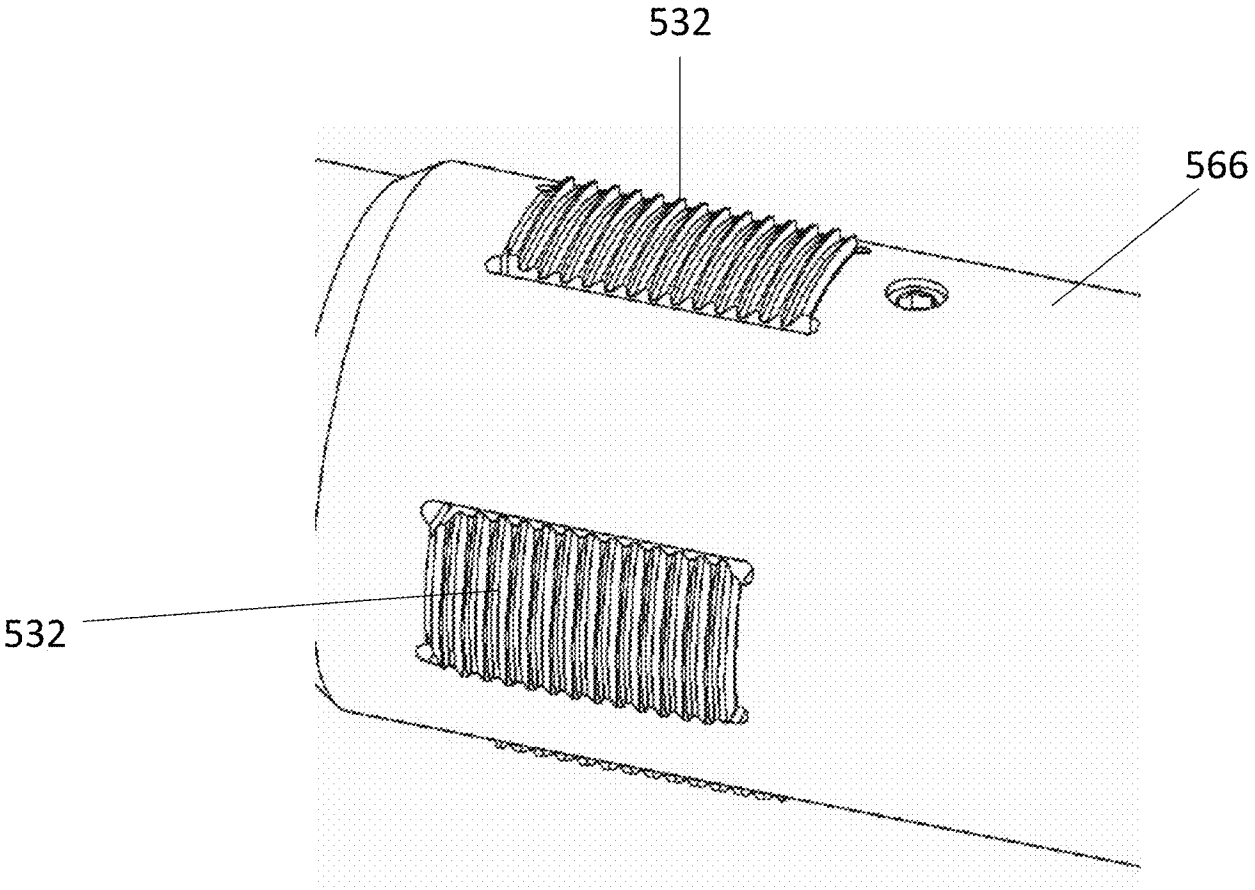
FIG. 25*c* is a perspective view of the fluid conduit shown in FIGS. 25*a* and 25*b*, showing release members extending through slots defined in the fluid conduit, the release members having ratcheted surfaces, according to an implementation.
Figures 26A, 26B, 26C:
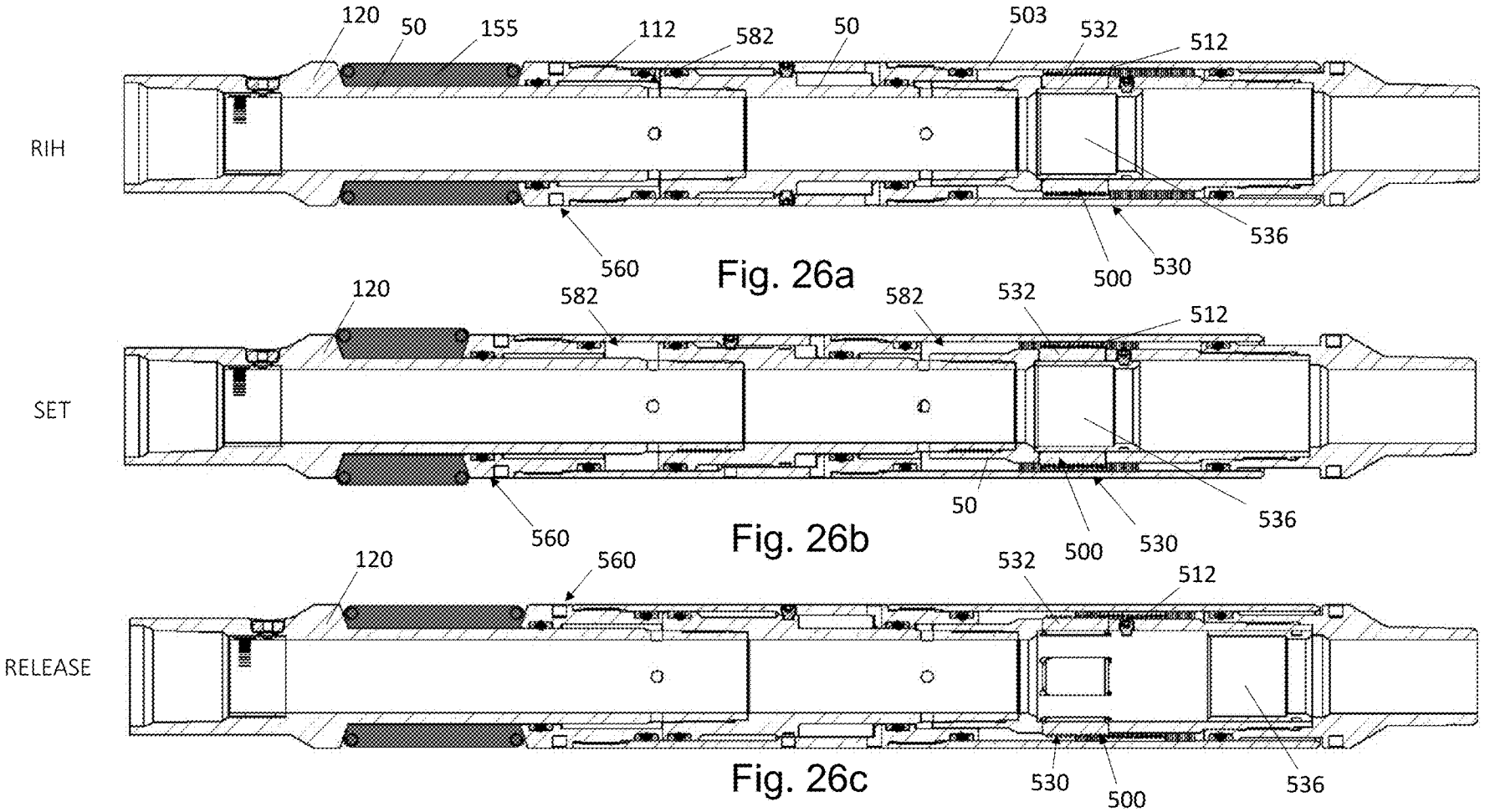
FIGS. 26*a* to 26*c* are transverse cut views of another implementation of a valve assembly, showing the valve assembly in a run-in configuration (FIG. 26*a*), a set configuration (FIG. 26*b*) and a released configuration (FIG. 26*c*), according to implementations.

Referring now to FIGS. 25*a* to 25*c*, another implementation of the release mechanism 530 is shown. The release mechanism can be provided with pegs 532 (e.g., dogs) which form part of a locking mechanism 500. More particularly, the pegs 532, a ratcheting ring 512, and a tubular wall 503 of the valve housing have teeth that cooperate and engage in a similar manner as the locking assembly 200 of FIGS. 17, for example, but where the direction is reversed. The pegs 532 include angled teeth 515 that cooperate with teeth 517 of the ratcheting ring 512 which also has additional angled teeth 516 on the opposed side for engaging and ratcheting with corresponding teeth 514 of the tubular wall 503 of the housing, as shown in FIG. 25*b*. FIG. 25*c* shows the pegs 532 protruding through openings in a tubing string segment 566. FIG. 26*a* shows this valve assembly 100 with integrated locking and release mechanisms in a run-in configuration, FIG. 26*b* in a set configuration, and FIG. 26*c* in a released configuration.

In some embodiments, the release mechanism 530 of a given valve assembly is selectively and independently operable relative to the release mechanism of another valve assembly positioned along the wellbore string. As such, each valve assembly can be disengaged from the wellbore independently, which can prevent sealing elements from one or many valve assemblies from getting stuck or dragging along the inner surface of the wellbore, thus facilitating retrieval of the wellbore string from the wellbore. Using a downhole shifting tool, for example, each release sleeve 536 can be independently shifted from a secured position (FIGS. 26*a* and 26*b*) to a released position (FIG. 26*c*). Operating the release mechanism 530 in the released position releases the pegs 532 from the lock ring 512 and enables movement of the tubular wall 503 and actuation assembly 560 (e.g., the coupling element 112). It is noted that enabling movement of the actuation assembly can cause the actuation assembly to become disengaged from the sealing element 155, allowing it to operate in a released configuration (FIG. 26*c*).

In some implementations, the sealing element 155 can remain at least partially engaged with the wellbore after operation of the release mechanism. As such, it may be required to assist in unsetting the sealing element, to unset the valve assembly. In an exemplary implementation, the sealing element can be bonded to a tubing string segment 50, such as to the injection segment 120, thereby defining a bonded tubing string. Once the release mechanism 530 has been operated to unlock the locking assembly 500, the bonded tubing string can be shifted (e.g., pulled uphole), which in turn pulls on the sealing element, to assist in unsetting the sealing element from the wellbore. In other words, the sealing element can be manipulated, directly or indirectly, to be moved away from the actuation assembly, such as by pulling on the bonded tubing string.

In some implementations, the release sleeve 536 is sheared from within the tubing string element 50 using a shifting tool (e.g., deployed on coiled tubing, wireline, slickline, tubing or a dart) to enable sliding movement therealong. Once sheared and moved to the released position, the shifting tool is adapted to travel along the wellbore string to any subsequent valve assembly to shear and move respective release sleeves 536. The valve assemblies can therefore be selectively (e.g., via operation via the shifting tool) and independently (e.g., one by one without affecting the other valve assemblies) disengaged from the wellbore to enable retrieval of the wellbore string. It is appreciated that using a shifting tool to operate the release mechanisms 530 enables operators at surface to know when a valve assembly has been released from the wellbore, which can increase accuracy and efficiency of downhole operations, such as during retrieval of the wellbore string and valve assemblies.

In order to prevent the sealing element from reengaging the wellbore, the valve assembly can include an isolation device configured to isolate fluid access to the actuation assembly, thereby preventing fluid-pressure operation thereof. For example, the actuation assembly can include a piston assembly, which defines pressure chambers or compartments 582 in which fluid flows to exert pressure on surfaces of the piston(s) for operation thereof. In such implementations, the isolation device can be adapted to deactivate the piston assembly by blocking access to these pressure compartments 582. The isolation device can include a sliding sleeve adapted to be shifted to isolate the pressure access to the piston assembly such that tubing pressure cannot apply force to the piston. This can enable fluid circulation along the tubing string without having to provide fluid pressure to the sealing elements of the valve assemblies.

In some implementations, the internal profile of the release sleeve 536 can be customized from one valve assembly to another such that a first type of shifting tool can be deployed to shear and move a select number of release sleeves, while another type of shifting tool can be deployed to move other release sleeves, as so on. It should also be noted that the release sleeves can be positioned and adapted to be sheared and shifted in either the downhole direction, the uphole direction, or both.

Figure 27A:
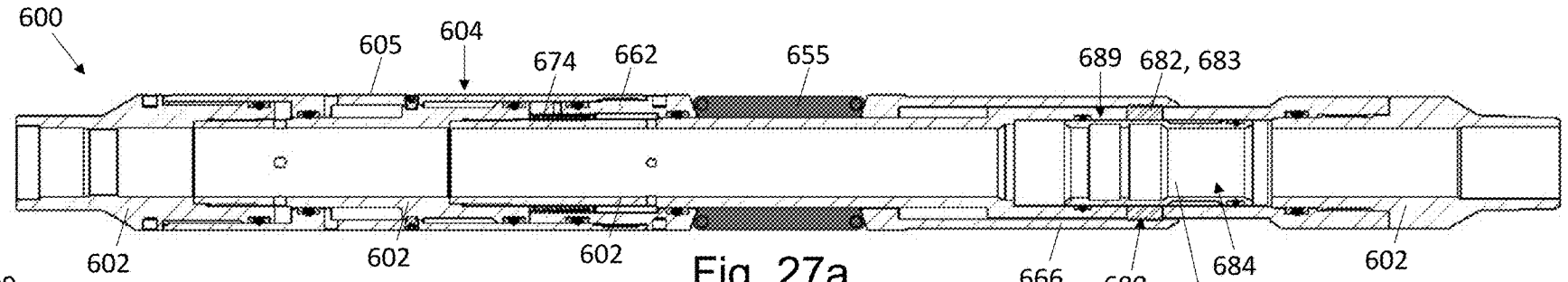
FIGS. 27*a* to 27*c* are transverse cut views of another implementation of a valve assembly, showing the valve assembly in a run-in configuration (FIG. 27*a*), a set configuration (FIG. 27*b*) and a released configuration (FIG. 27*c*), according to implementations.
Figure 27B:
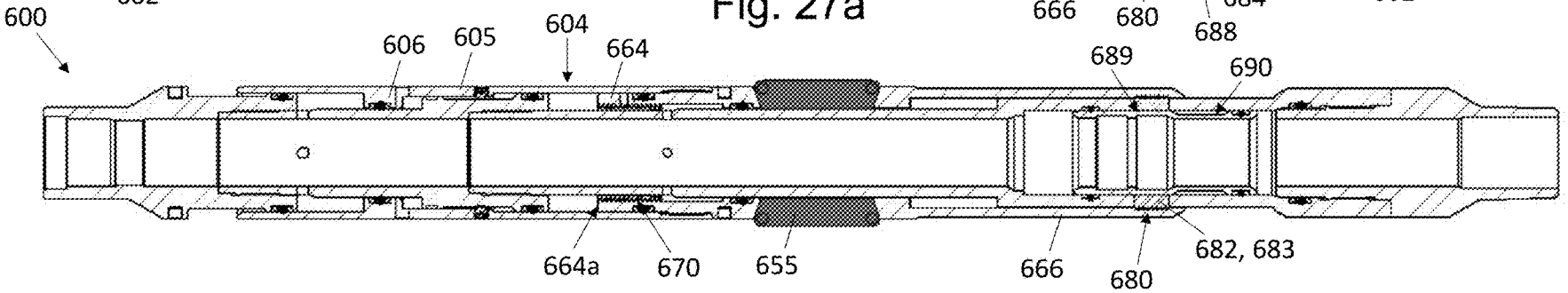
Figure 27C:
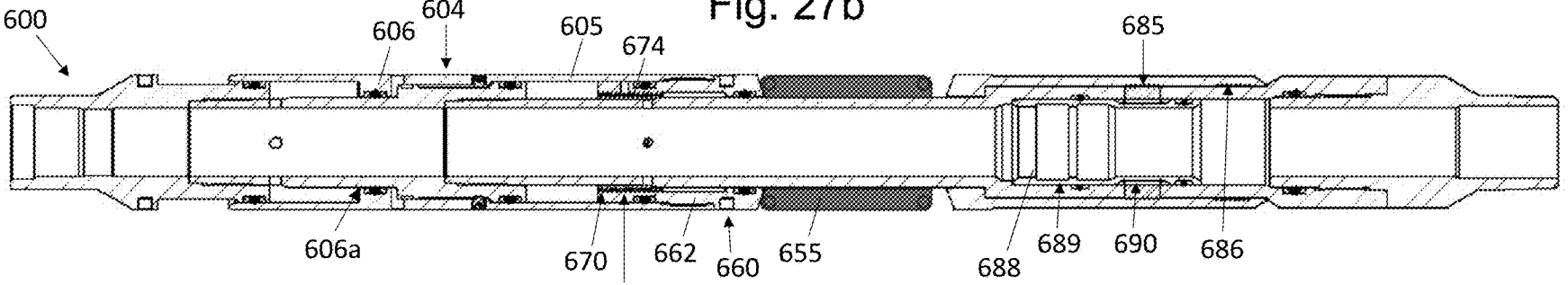

With reference to FIGS. 27*a* to 27*c*, an implementation of a downhole component 600 is shown. As will be described below, the downhole component 600 includes similar structural elements as the valve assembly described above. For instance, the downhole component 600 includes fluid conduits 602 connectable to one another and to the wellbore string and enabling fluid flow therethrough to allow integration of the downhole component 600 along the wellbore string. The downhole component 600 also include a housing 604 comprising a tubular wall 605 defining a passage therethrough adapted to receive the fluid conduits 602, or at least one conduit segment, therein. In addition, the downhole component 600 includes a sealing element 655 and an actuation assembly 660 capable of engaging the sealing element 655 for operation thereof.

The sealing element 655 is operatively connected to the fluid conduits and is operable between a run-in configuration (FIG. 27*a*), where the sealing element is disengaged from an inner surface of the wellbore, an operational or set configuration (FIG. 27*b*), where the sealing element is engaged with the inner surface of the wellbore and sets the position of the downhole component along the wellbore, and a released configuration (FIG. 27*c*), where the sealing element is allowed to disengage the inner surface of the wellbore. The actuation assembly 660 is operable to engage and configure the sealing element from the run-in configuration to the operational configuration. More specifically, the actuation assembly 660 includes an actuation member 662 connected to the tubular wall 605 and being fluid pressure-activatable to cause the actuation member to engage and operate the sealing element from the run-in configuration to the operational configuration. The actuation member 662 can include a piston head 664 slidably coupled to the fluid conduits and defining one or more radial surface 664*a* adapted to have fluid exert pressure thereon to move the actuation member toward the sealing element for engagement therewith.

As mentioned, the actuation member 662 can be connected to the housing 604 such that the housing is also slidably coupled to the fluid conduits. In this implementation, the housing can include an internal projection 606 defining a second radial surface 606*a* on which fluid can exert pressure to move the actuation member toward the sealing element for engagement therewith. As such, it is noted that the housing and actuation assembly can define a double-piston assembly, where two radial surfaces enable fluid to exert pressure thereon. However, it is appreciated that a single-piston assembly can be used to enable movement of the actuation member toward the sealing element for engagement therewith.

In this implementation, the actuation assembly 660 further comprises a blocking member, or gauge ring 666 releasably secured to the fluid conduits and adapted to engage the sealing element 655 opposite the actuation member 662. In other words, the sealing element is positioned between the blocking member and the actuation member, and as the actuation member 662 is moved toward the sealing element 655, the blocking member prevents movement of the sealing element, thereby squeezing the sealing element therebetween. The sealing element then extends outwardly under the squeezing pressure to engage the inner surface of the wellbore, which corresponds to operating the sealing element from the run-in configuration to the operational configuration.

The downhole component 600 also includes a locking mechanism 670 operatively connected to the actuation member 662 and configurable in a locked configuration to prevent disengagement of the actuation member from the sealing element, and a release mechanism 680 operatively connected to the blocking member 666 and being operable to release the blocking member from the fluid conduits to enable movement thereof away from the actuation member to enable configuration of the sealing element from the operational configuration to the release configuration. It should therefore be understood that the actuation member is adapted to move toward the sealing element while the blocking member is secured on the other side of the sealing element for configuration thereof in the operational configuration. Moreover, the blocking member is releasable from the fluid conduits and adapted to move away from the actuation member to enable the sealing element to relax and disengage the inner surface of the wellbore, which corresponds to operating the sealing element from the operational configuration to the released configuration).

Still referring to FIGS. 27*a* to 27*c*, the locking mechanism 670 includes a ratcheting system 672 configured to enable movement of the actuation member 662 and the tubular wall 605 in a first direction relative to the fluid conduits 602 and prevent movement of the actuation member and the tubular wall in a second direction relative to the fluid conduits 602 when operating the locking mechanism in the locked configuration. The ratcheting system 672 illustratively includes a lock ring 674 provided between and engaging the fluid conduits and the actuation member 662 to at least partially control relative movement therebetween. Similar to previous implementations of the ratcheting system, the lock ring 674 includes sets of angled teeth along an outer surface and along an inner surface thereof for engaging the actuation member and the fluid conduits, respectively. In the illustrated implementation, the actuation member 662 is adapted to be ratcheted in the downhole direction and toward the sealing element. Therefore, it is noted that the ratcheting system prevents uphole movement of the actuation member and of the tubular housing.

The blocking member 666 is adapted to remain secured to the fluid conduits, thereby preventing the sealing element from sliding along the fluid conduits, thereby forcing it to extend outwardly as the actuation member is in engagement therewith. Upon operation of the release mechanism 680, the blocking member 666 is released from the fluid conduit and is allowed to slide therealong. As such, the sealing element can relax and push against the blocking member (e.g., in the downhole direction) as it moves to the released configuration to disengage the wellbore. It is noted that the actuation member 662 remains locked in place via the locking mechanism 670 (e.g., the ratcheting system 672), thereby preventing uphole movement of the sealing element when moving to the released configuration.

In this implementation, the release mechanism 680 includes a release member 682 provided about at least one of the fluid conduits and adapted to engage and secure the blocking member 666. The release mechanism 680 further includes a biasing member 684 adapted to bias the release member 682 in engagement with the blocking member 666 to maintain the blocking member in position prior to operation of the release mechanism. In this implementation, the release member 682 includes pegs 683 extending through a thickness of the fluid conduit to communicate with the conduit passage. Each peg 683 having an outer engagement profile 685 configured to extend into a complementarily-shaped recess 686 defined along an inner surface of the blocking member 666. The outer engagement profile 685 being adapted to prevent movement of the blocking member when engaged with the complementarily shaped recess 686. The biasing member 684 is slidably coupled within the fluid conduit and is adapted to overlay, bias and support the pegs 683 in engagement with the complementarily shaped recess from within the conduit passage.

As seen in FIGS. 27*a* to 27*c*, the biasing member 684 includes a release sleeve 688 slidably coupled within the fluid conduits and having a biasing surface 689, such as along an outer surface thereof, adapted to engage the release member from within the conduit passage. The release sleeve 688 is adapted to be shifted along the conduit passage to have the outer surface thereof disengage the release member (e.g., the pegs). Once disengaged from the release sleeve 688, the pegs 683 are allowed to "fall into" respective slots defined in the thickness of the corresponding fluid conduit, thereby moving away and disengaging the blocking member 688. In other words, shifting the release sleeve 688 enables the pegs 683 to move radially inwardly and away from the blocking member to have the outer engagement profile 685 disengage the complementarily-shaped recess 686. As such, movement of the blocking member 666 is enabled, which allows the sealing member 655 to relax and disengage the wellbore. In this implementation, the release sleeve is shifted in the uphole direction between the biasing position and the release position. However, it is appreciated that the release sleeve can alternatively, or additionally adapted to be shifted in the downhole direction.

In this implementation, the release sleeve 688 includes an inset region 690 defined along the outer surface thereof. As seen in FIG. 27*c*, the release sleeve can be shifted to align the inset region 690 with the pegs 683, which enables the pegs to retract and move at least partially within the conduit passage. Alternatively, the release sleeve 688 can be shifted to become adjacent the pegs 683, where no portions of the release sleeve are aligned with the pegs. As such, the pegs are free to fall within the conduit passage and can either be recovered at surface or pumped further downhole. The release sleeve 688 can be held in place within the fluid conduit using any suitable means, such as via interference fit or using one or more fasteners, such as shear screws, for example. It is appreciated that the interference fit is configured to hold the release sleeve in place during operation of the wellbore string (e.g., injection, production, etc.), but enables a shifting tool to shift and slide the release sleeve along the fluid conduit.

In some implementations, once the release element 655 has relaxed and disengaged the wellbore following the operation of the release mechanism, the actuation member 662 is no longer capable of engaging the sealing element. Therefore, normal operations can be conducted along the wellbore string, such as fluid injection, and the actuation member will no longer be fluid-pressure activated to engage the sealing element. In this implementation, the internal projection 606 of the tubular wall 605 is adapted to abut against a fluid conduit head portion which extends radially outwardly to contact the inner surface of the tubular wall 605. It is thus noted that downhole movement of the tubular wall 605, and therefore of the actuation member 662, is prevented (e.g., the piston assembly bottoms out). In other words, the fluid conduits can include structural components which define a stop against which the actuation assembly is adapted to abut to prevent further engagement of the sealing element.

It should be noted that the downhole component 600 is illustratively not provided with a port or a valve enabling fluid communication between the fluid passage and the reservoir, although alternate implementations can include one or more ports. The downhole component can be used to seal desired sections of the wellbore to define intervals therealong, and can be used in cooperation with the valve assemblies described herein. For example, the wellbore string can include downhole components and valve assemblies provided in alternance along the wellbore string. Any other configurations of the wellbore string using any one of the described implementations (downhole components and/or valve assemblies), or combination thereof, are also possible.

While some possible implementations of locking and release mechanisms have been described herein, it is noted that various changes and alternative implementations could also be used. For instance, the locking mechanism can be removed from the downhole component and/or valve assembly, with the actuation assembly being held in engagement with the sealing element via continuous pressure exerted on the actuation member, such as via a generally continuous injection of fluid down the wellbore string. The release mechanism described herein is mechanically operated via a shifting tool. However, it is appreciated that the release sleeve can be designed to define radial surfaces adapted to have fluid exert pressure thereon such that the release sleeves are fluid-pressure operable. It should be noted that fluid-pressure operable release sleeves can be operated generally simultaneously along the entire wellbore as the wellbore pressure is increased. Alternate implementations of the release mechanism are also possible, such as releasing the blocking member via a rotational movement. For example, the blocking member can be at least partially threaded onto the fluid conduits, and can therefore be rotated (e.g., "unscrewed") along the fluid conduits to move away from the sealing element.

In addition, while the locking and release mechanisms described herein have been shown associated with valve assemblies or downhole components having various other features, such as injection segments, actuation assemblies, and various other components, it is noted that implementations of the locking and release mechanisms can be incorporated into other valves or downhole tools where such axial locking and release may be used, e.g., for setting and then releasing a sealing element such as a packer.

It should also be noted that the position of the various components can vary from one implementation to another. For instance, the release mechanism shown in FIGS. 24*a* to 24*c* is located uphole of the sealing element, with the actuation member and locking assembly being positioned downhole of the sealing element. Inversely, the implementation shown in FIGS. 27*a* to 27*c*, illustrates a release mechanism positioned downhole of the sealing element, and an actuation member and locking assembly positioned uphole of the sealing element. Alternatively, both the release and locking mechanisms can be provided on the same side of the sealing element, such as those shown in the implementation of FIGS. 26*a* to 26*c*. Therefore, it should be appreciated that the various movable components of the valve assemblies and downhole components can be adapted to move in either direction (i.e., uphole and/or downhole) for operation of the mechanisms and assemblies thereof.

Referring more specifically to FIGS. 17 and 17A, the release mechanism 230 can further include a ratcheting ring 250 configured to facilitate disengagement of the ratcheting mandrel 212 from the tubular wall 103 of the valve housing 102. The ratcheting ring 250 can be coupled between the ratcheting mandrel 212 and the tubular wall 103 of the valve housing 102, and include the second set of angled teeth 216 along an inner surface thereof, and a third set of angled teeth 217 along an outer surface thereof. As seen in FIG. 17A, the tubular wall 103 includes a fourth set of angled teeth 218 configured to cooperate and engage the third set of angled teeth 217 to allow movement of the ratcheting ring 250 in a first direction, such as the uphole direction, and prevent movement in a second direction, such as the downhole direction. It is thus appreciated that ratcheting the valve housing 102 uphole includes moving the ratcheting ring 250 uphole relative to the ratcheting mandrel 212, thereby moving the second set of angled teeth 216 relative to the first set of angled teeth 214. The ratcheting ring 250 is maintained in position relative to the tubular wall 103 due to the cooperation between the third and fourth sets of angled teeth 217, 218.

It is noted that the teeth of the third and fourth sets of angled teeth 217, 218 are illustratively larger than the teeth of the first and second sets of angled teeth 214, 216 such that movement and/or disconnection of the ratcheting ring 250 relative to the ratcheting mandrel 212 is easier than movement and/or disconnection of the ratcheting ring 250 from the tubular wall 103. In other words, the smaller set of teeth (e.g., the first and second sets of angled teeth 214, 216) requires a smaller range of motion to disengage the teeth from one another, relative to the larger set of teeth (e.g., the third and fourth sets of angled teeth 217, 218), which requires a larger range of motion. As such, the smaller set of teeth facilitate uphole movement of the ratcheting ring 250 and valve housing 102 relative to the ratcheting mandrel 212, while the larger set of angled teeth are adapted to maintain the ratcheting ring 250 in position relative to the tubular wall 103. In addition, the larger set of angled teeth (e.g., the third and fourth sets of angled teeth 217, 218) can be adapted to cooperate to together to push the second set of teeth 216 downward and into the first set of teeth 214, thereby further securing the teeth together, and preventing downhole movement of the valve housing 102.

Figure 21:
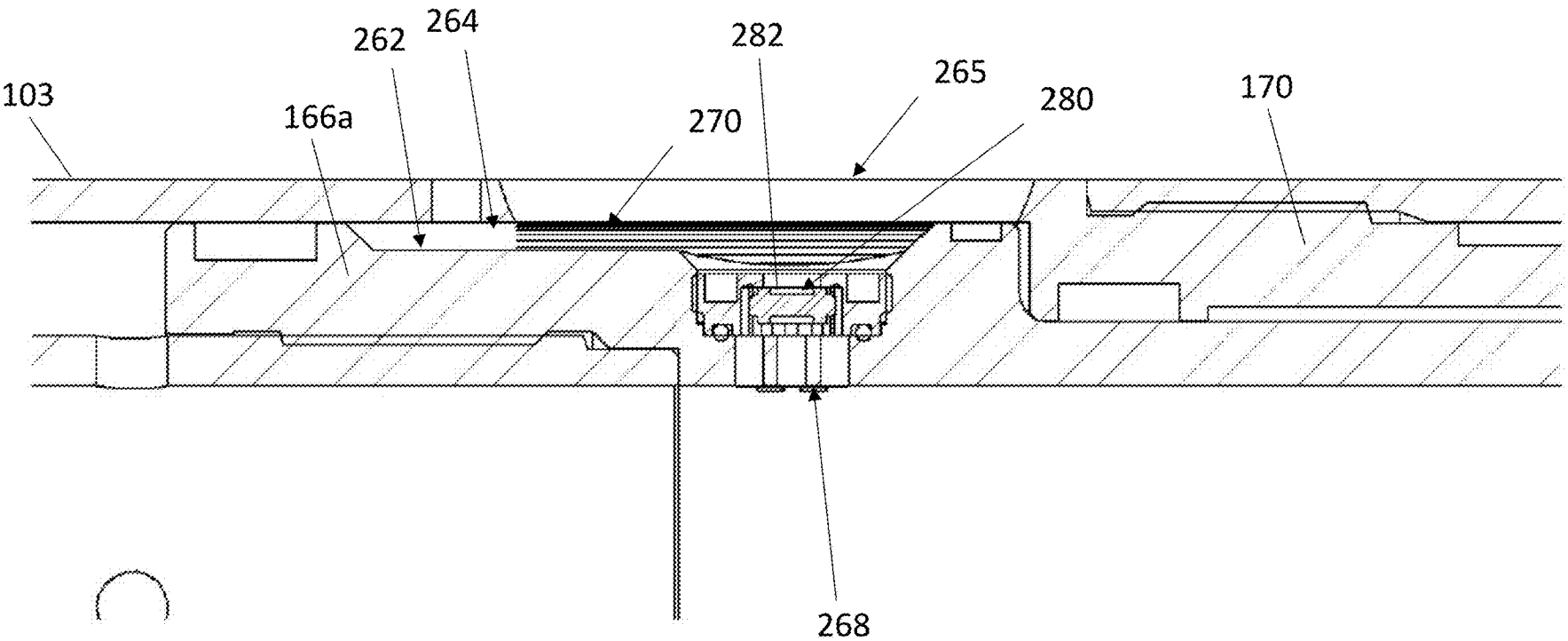
FIG. 21 is a transverse cut view of the production segment shown in FIG. 15, showing slits defined in the tubular housing and a check valve provided in a fluid conduit, according to an implementation.

Referring to FIG. 21, and with continued reference to FIGS. 14 to 20, the valve assembly 100 can include a production segment 260 adapted to enable production of fluids from the surrounding reservoir. In this implementation, the production segment 260 includes one or more production ports 265, through which fluid communication between the interior of the valve housing (e.g., the fluid passage) and an environment external to the valve assembly 100 (e.g., the reservoir) is established. In the present implementation, the production ports 265 are defined through a portion of the tubular wall 103 such that fluid communication between the fluid passage and the reservoir is established. In this implementation, prior to moving the valve housing 102 uphole, and the operating the sealing element 155 in the operational configuration, and as seen in FIG. 15, the production ports 265 communicate with the fluid passage between the first segment head 166*a* and the partition ring 170 such that fluid flow in both the uphole and downhole directions is prevented. More specifically, the partition ring 170 sealingly engages the tubular wall 103 to prevent downhole fluid flow, and the uphole end of the first segment head 166*a* sealingly engages the tubular wall 103 to prevent uphole fluid flow. It is noted that, in this implementation, the partition ring 170 includes a structure similar to the coupling element 112 and is configured to facilitate connection of separate components of the valve housing 102 together. For example, and as seen in FIG. 16, the production segment 260 of the valve assembly comprises a first portion of the tubular wall 103*a*, which is connected to a second portion of the tubular wall 103*b* via the partition ring 170.

Figure 22:
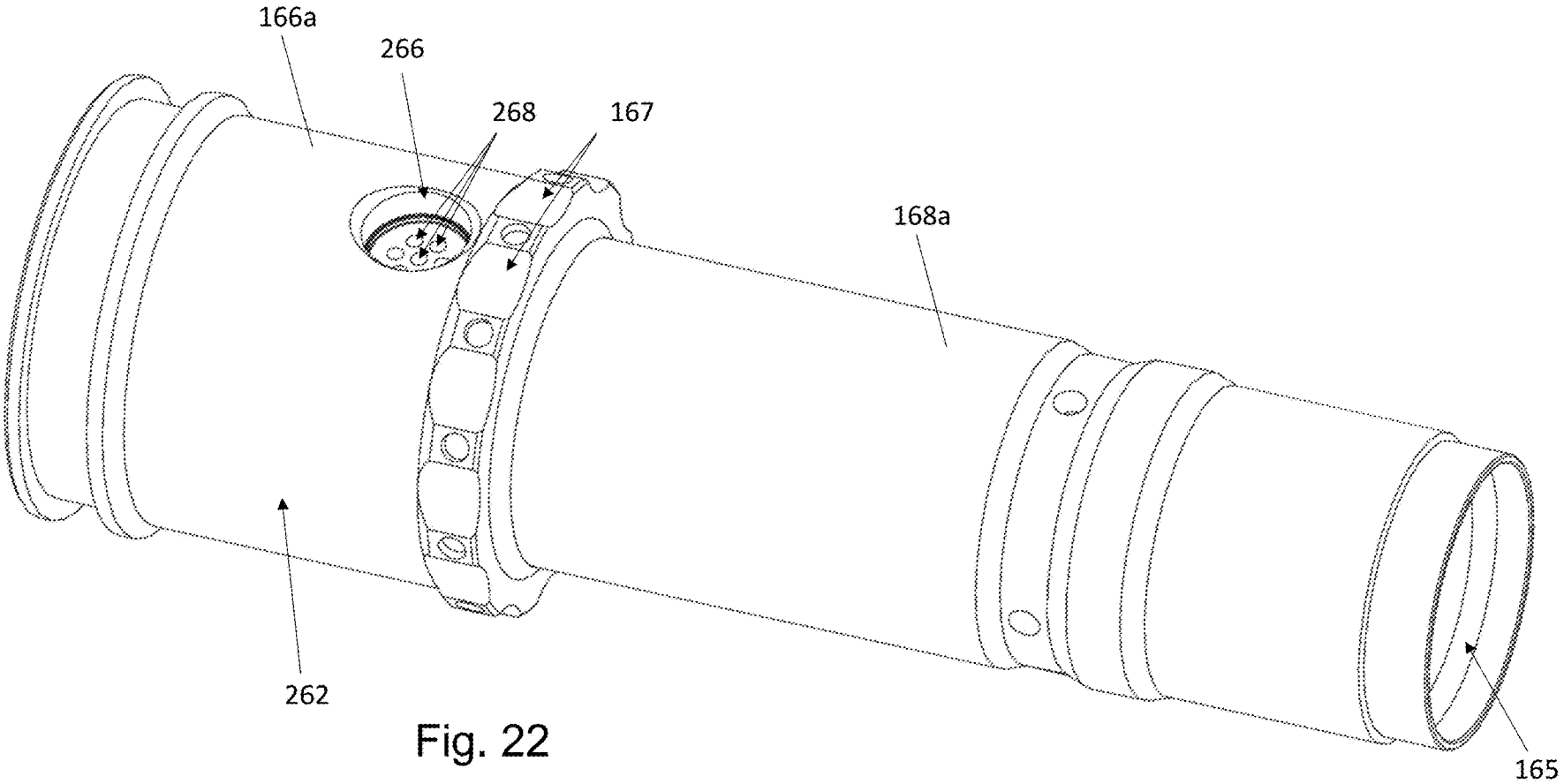
FIG. 22 is a perspective view of the fluid conduit provided with the check valve shown in FIG. 21, showing production holes defined through a production port, according to an implementation.

As seen in FIGS. 21 and 22, when in the operational configuration, the first segment head 166*a* is generally aligned with the production ports 265. In this implementation, the first segment head 166*a* can be provided with one or more secondary production ports 266 (seen in FIG. 21) adapted to allow production fluids to flow into the string fluid passage 165 and be recovered at surface. Furthermore, the first segment head 166*a* can include an inset region 262 defining a production fluid chamber 264 communicating with the production ports 265. Once within the production fluid chamber 264, fluid can flow through the secondary production port(s) 266 and into the string fluid passage for production to surface. Referring more specifically to FIG. 22, in some implementations, the downhole surface of the first segment head 166*a* can be provided with axial openings 167 adapted to allow fluid to flow into the production fluid chamber 264 and reach the secondary production port 266. As such, it is noted that, when the valve assembly is in the run-in position (e.g., where the first segment head 166*a* is spaced from the partition ring 170), production fluid can flow through the production port 265, through the axial openings 167 and into the string fluid passage of the valve assembly 100 through the secondary production port 266.

In this implementation, the production port 265 includes a plurality of openings, such as slits 270, defined through the tubular wall 103. In some implementations, the slits 270 are provided at regular intervals around the tubular wall, although other configurations are possible. As seen in FIG. 14, the slits 270 can be narrow, such as between about 0.008" and 0.25" wide to prevent undesired particles/materials from entering the valve assembly 100 and being produced up to surface. In addition, the slits 270 can be generally elongated (e.g., between about 0.0625" and 12" long to promote fluid production through the plurality of slits 270. In some implementations, the length of each slits is between about 5 to 50 times greater than the width thereof, although other configurations are possible. The production segment 260 can include any suitable number of slits 270, such as four, eight, twelve, twenty, fifty or one hundred slits, for example. It is appreciated that the number of slits provided around the tubular wall 103 can depend on the dimensions of the slits 270 since larger slits 270 take up more space around the tubular wall. It should also be noted that the slits 270 can vary in dimensions between separate valve assemblies 100, or around the tubular wall of a single valve assembly 100, or a combination of both.

With reference to FIG. 22, the production segment 260 can include a plurality of secondary ports 266 (e.g., two, three, four, six, eight, etc) or can alternatively include a single secondary production port 266. The secondary production port 266 can be formed as a generally tubular opening through the first segment head 166*a*. In this implementation, the secondary production port 266 includes a plurality of production holes 268 extending through a bottom surface of the secondary production port 266, and through the piston head 166, thereby restricting the flowrate of fluids into the fluid passage of the valve assembly.

Referring back to FIG. 21, the secondary production port 266 can be provided with a flow control device 280 adapted to control the flowrate of fluid through the secondary production port. For example, the flow control device 280 can include a breakable barrier, such as the burst disc previously described in relation with the injection port, for example. In this implementation, the flow control device 280 includes a check valve 282 configured to allow fluid to flow in a first direction and prevent fluid flow in a second direction, opposite the first direction. It should be understood that, in the present implementation, the check valve 282 enables fluid production through the secondary production port 266, and prevents fluid from being injected into the surrounding reservoir through the secondary production port 266.

It should be noted that the check valve 282 enables for both injection and production operations to be accomplished using the valve assembly 100. More specifically, once the valve assembly is installed downhole, injection operations can be initiated via the injection segment, as described above. Injection of fluids into the reservoir can then be halted, with the valve housing 102 being locked in place via the locking assembly 200, and production operations can be initiated via the production segment. In the present implementations, it is noted that injection fluid and production fluid alternatively flow along the same fluid passage through the valve assembly 100. As such, it should be understood that the valve assembly 100 is configured to enable asynchronous injection and production operations, such as asynchronous frac-to-frac operations, for example although other operational configurations and processes are possible. For example, the valve assembly can be used for geothermal applications. It is also noted that the valve assembly can be used in relation to applications where the formation (e.g., the reservoir) is not required to be fractured but has a permeability that enables fluid injection or includes naturally formed fractured.

It should be appreciated from the present disclosure that the various implementations of the valve assembly and related components enable the valve assembly to be positioned at a desired location along the wellbore prior to operating the sealing element via the fluid pressure-activated actuation system. The flow restriction component of the injection segment delays the flow of fluid into the reservoir and enables the sealing elements of each valve assembly to be operated prior to injection operations being initiated. The sealing elements are selectively operable to engage the wellbore surface, and independently and selectively operable to disengage the wellbore surface such that the downhole component (e.g., a packer assembly and/or a valve assembly), along with the sealing element, are retrievable from down the wellbore. Moreover, the dual-piston assembly of the actuation assembly allows the sealing element to be operated at lower operational fluid pressures due to the additional surface area of the second piston (e.g., when compared to single-piston assemblies). The present valve assembly facilitates the deployment of wellbore systems due to the combination of the sealing element within the structure of the valve used to inject and/or produce fluids.

The present disclosure may be embodied in other specific forms. The described example implementations are to be considered in all respects as being only illustrative and not restrictive. For example, in the implementations described herein, the sealing elements installed on the valve assemblies are typically hydraulically set and are configured to set at a pressure below the threshold pressure of the burst discs of the injection segments. However, it is noted that other types of sealing elements can be used, such as swellable sealing elements configured to be set via absorption of fluids, and are therefore not dependent on fluid pressure. Using swellable sealing elements can enable installation of the valve assemblies downhole in the open configuration (e.g., without the breakable barrier) since fluids being pumped downhole would be initially absorbed by the swellable sealing elements. The valve assembly described herein can also be used for various downhole operations. In some implementations, the valve assembly is used as part of hydrocarbons recovery operations, where injection fluids are injected to enable the production of fluids including hydrocarbons. It should however be noted that the valve assembly can be used as part of other operations, such as gas flooding operations (e.g., using CO2), waterflooding operations, geothermal operations and acid solution mining operations, for example.

The present disclosure intends to cover and embrace all suitable changes in technology. The scope of the present disclosure is, therefore, described by the appended claims rather than by the foregoing description. The scope of the claims should not be limited by the implementations set forth in the examples, but should be given the broadest interpretation consistent with the description as a whole.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings comprises various components and although the optional configurations of the valve assembly as shown may consist of certain geometrical configurations as explained and illustrated herein, not all of these components and geometries are essential and thus should not be taken in their restrictive sense, i.e., should not be taken as to limit the scope of the present disclosure. It is to be understood that other suitable components and cooperations thereinbetween, as well as other suitable geometrical configurations may be used for the implementation and use of the valve assembly, and corresponding parts, as briefly explained and as can be easily inferred herefrom, without departing from the scope of the disclosure.

The invention claimed is:

1. A downhole component for integration along a wellbore string extending along a wellbore, comprising:

one or more fluid conduits connectable to the wellbore string and defining a conduit passage enabling fluid flow therethrough;

a sealing element connected to the one or more fluid conduits, the sealing element being operable between a disengaged configuration, where the sealing element is disengaged from an inner surface of the wellbore, and an engaged configuration, where the sealing element is engaged with the inner surface of the wellbore and seals portions of the wellbore on either side thereof;

an actuation assembly comprising:

a blocking member releasably secured to the one or more fluid conduits on a first side of the sealing element; and an actuation member slidably connected to the one or more fluid conduits on a second side of the sealing element, the actuation member being fluid-pressure operable to engage and operate the sealing element from the disengaged configuration to the engaged configuration; and a release mechanism operatively connected to the blocking member and being operable to release the blocking member to enable movement thereof away from the actuation member to enable the sealing element to revert to the disengaged configuration, wherein the release mechanism is adapted to be selectively and independently operated relative to additional release mechanisms associated with adjacent downhole components along the wellbore string, wherein the release mechanism comprises a release member, connected to the one or more fluid conduits and adapted to engage the blocking member, and a biasing member, adapted to releasably secure the release member in engagement with the blocking member to prevent movement thereof, and wherein the one or more fluid conduits comprise a plurality of slots extending through a thickness thereof and the release member comprises a plurality of pegs, each peg positioned in a respective slot and comprising a bottom end, communicating with the conduit passage for engagement with the biasing member, and a top end, adapted to engage the blocking member.

2. The downhole component of claim 1, wherein the actuation member comprises a piston assembly having a tubular wall slidably coupled to the fluid conduits and a piston head connected to the tubular wall adjacent the sealing element, the piston head defining radial surfaces adapted to have fluid exert pressure thereon to fluid-pressure operate the actuation member.

3. The downhole component of claim 2, wherein operating the release mechanism deactivates the piston assembly to prevent engagement of the actuation member with the sealing element.

4. The downhole component of claim 1, further comprising a locking mechanism operatively connected to the actuation member and configurable in a locked configuration to prevent disengagement of the actuation member from the sealing element.

5. The downhole component of claim 4, wherein the locking mechanism comprises a ratcheting system configured to enable movement of the actuation member toward the sealing element and prevent movement of the actuation member away from the sealing element.

6. The downhole component of claim 5, wherein the ratcheting system comprises a lock ring provided between at least one of the fluid conduits and the actuation member, the lock ring being configured to at least partially control relative movement between the fluid conduits and the actuation member.

7. The downhole component of claim 5, wherein the lock ring is secured to the fluid conduits and comprises an outer ring surface provided with first set of angled teeth, and wherein the actuation member comprises an inner surface provided with a second set of angled teeth adapted to cooperate with the first set of angled teeth to enable ratcheting the actuation member toward the sealing element.

8. The downhole component of claim 1, wherein, upon operation of the release mechanism, the blocking member is allowed to axially slide along the fluid conduit away from the actuation member to enable the sealing element to revert to the disengaged configuration.

9. The downhole component of claim 1, wherein the blocking member is releasably secured about a portion of one of the fluid conduits, and wherein the release member extends radially through a thickness of the fluid conduit to engage the blocking member, and wherein the biasing member is operatively coupled within the fluid conduit to bias the release member outwardly from within the conduit passage.

10. The downhole component of claim 1, wherein the biasing member comprises a release sleeve slidably coupled to the fluid conduit along the conduit passage, the release sleeve being adapted to engage the release member from within the conduit passage, and is further adapted to be shifted along the conduit passage to disengage the release member and enable disengagement of the release member from the blocking member.

11. The downhole component of claim 10, wherein the defeatable member is configured to releasably secure the release sleeve within the fluid conduit in general alignment with the release member to bias the release member in engagement with the blocking member.

12. The downhole component of claim 10, wherein the release sleeve is selectively shiftable within the fluid conduit using a shifting tool deployed on a coiled tubing, a wireline, a slickline, a tubing or a dart.

13. The downhole component of claim 12, wherein the release sleeve is shiftable in a downhole direction.

14. The downhole component of claim 10, wherein the release mechanism comprises a defeatable member configured to releasably secure the release sleeve within the fluid conduit in a desired position.

15. The downhole component of claim 14, wherein the defeatable member comprises at least one shear pin.

16. The downhole component of claim 1, wherein the pegs are adapted to move radially outwardly within respective slots when the release mechanism is in the secured position, and are adapted to move radially inwardly within respective slots when the release mechanism is in the released position.

17. The downhole component of claim 1, wherein at least one of the one or more fluid conduits comprises a conduit port defined through a thickness thereof for establishing fluid communication between a surrounding reservoir and the conduit passage.

18. The downhole component of claim 17, further comprising a breakable barrier installed within the conduit port, the breakable barrier being fluid pressure-activated to operate the at least one of the one or more fluid conduits between a closed configuration where the breakable barrier occludes the conduit port for preventing fluid flow into the surrounding reservoir, and an open configuration where the breakable barrier is removed from within the conduit port for allowing fluid flow into the surrounding reservoir.

* * * * *